US008931192B2

(12) United States Patent
Acworth et al.

(10) Patent No.: US 8,931,192 B2
(45) Date of Patent: Jan. 13, 2015

(54) ART DISPLAY SYSTEM AND METHOD

(75) Inventors: Brian Acworth, Centerport, NY (US); Greg Herth, Oakdale, NY (US)

(73) Assignee: Museum Light Co., Huntington, NY (US)

( * ) Notice: Subject to any disclaimer, the term of this patent is extended or adjusted under 35 U.S.C. 154(b) by 90 days.

(21) Appl. No.: 13/345,416

(22) Filed: Jan. 6, 2012

(65) Prior Publication Data

US 2012/0239521 A1 Sep. 20, 2012

Related U.S. Application Data

(63) Continuation-in-part of application No. 12/802,486, filed on Jun. 7, 2010, now abandoned, which is a continuation-in-part of application No. 12/653,126, filed on Dec. 8, 2009, now Pat. No. 8,291,628.

(51) Int. Cl.

| | |
|---|---|
| ***G09F 13/00*** | (2006.01) |
| ***F21S 8/06*** | (2006.01) |
| ***F21V 1/02*** | (2006.01) |
| ***F21S 6/00*** | (2006.01) |

(Continued)

(52) U.S. Cl.

CPC ... *F21S 8/06* (2013.01); *F21V 1/02* (2013.01); *F21S 6/002* (2013.01); *F21S 6/004* (2013.01); *F21S 6/005* (2013.01); *F21V 1/00* (2013.01); *F21V 1/06* (2013.01); *F21V 1/22* (2013.01); *F21V 17/007* (2013.01); *G09F 13/04* (2013.01)

USPC ..... 40/554; 40/463; 362/351; 362/362; D26/93

(58) Field of Classification Search

USPC ..... 705/26.1–27.2; 40/463, 554; 362/351, 362/362; D26/93

See application file for complete search history.

(56) References Cited

U.S. PATENT DOCUMENTS

| | | | |
|---|---|---|---|
| 137,306 | A | 4/1873 | House |
| 1,463,722 | A | 7/1923 | O'Boyle |

(Continued)

FOREIGN PATENT DOCUMENTS

| | | | |
|---|---|---|---|
| AU | 2008101089 | | 3/2009 |
| DE | 102006033944 | A1 | 1/2008 |

(Continued)

OTHER PUBLICATIONS

SESR dated Aug. 22, 2012 issued in related EP Application No. EP10194003 filed Dec. 7, 2010, 7 pages.

(Continued)

*Primary Examiner* — Michael Misiaszek
(74) *Attorney, Agent, or Firm* — Dentons US LLP

(57) ABSTRACT

A system for displaying an illuminated image which includes (1) a frame kit with interchangeable components and an assembled electric cord set and (2) a flexible sheet imprinted with an image which combine to make a unit for display of the image as on a table lamp or hanging lamp. The printed sheet is art paper or other media formed into a closed shape defined by the shape of the frame rims to which it is attached at both ends. One of the frame rims includes provision for the attachment of legs which connect the rim to a central hub, which provides support for a lamp holder. A slot is provided in the central hub so the complete electric cord set with the lamp holder attached can be inserted without disassembly. A website is set up whereby institutions or businesses can upload selected images with instructions for formatting for printing on the flexible sheet.

24 Claims, 53 Drawing Sheets

(51) Int. Cl.

| | |
|---|---|
| ***F21V 1/00*** | (2006.01) |
| ***F21V 1/06*** | (2006.01) |
| ***F21V 1/22*** | (2006.01) |
| ***F21V 17/00*** | (2006.01) |
| *G09F 13/04* | (2006.01) |

(56) References Cited

U.S. PATENT DOCUMENTS

| | | | | |
|---|---|---|---|---|
| 1,728,166 | A | 9/1929 | Horton | |
| 1,817,091 | A | 8/1931 | Miller | |
| 1,930,048 | A | 10/1933 | Harding | |
| 2,177,204 | A | 10/1939 | Buzick | |
| 2,483,354 | A * | 9/1949 | Stiffel | 362/358 |
| 2,483,357 | A | 9/1949 | Stiffel | |
| 2,637,805 | A | 5/1953 | Jacobs | |
| 2,677,756 | A | 5/1954 | Priester | |
| 2,680,317 | A | 6/1954 | Lewis | |
| 2,781,444 | A | 2/1957 | Noguchi | |
| 2,823,477 | A | 2/1958 | Willard | |
| 2,974,435 | A | 3/1961 | Eschenroeder | |
| 3,023,307 | A | 2/1962 | Okamoto | |
| 3,105,315 | A | 10/1963 | Snethen | |
| 3,304,640 | A | 2/1967 | Swartz | |
| 3,382,358 | A | 5/1968 | Pike | |
| 3,742,210 | A | 6/1973 | Chapman | |
| 3,764,801 | A | 10/1973 | Mainieks | |
| 3,787,676 | A | 1/1974 | Korach | |
| 4,075,684 | A | 2/1978 | Witz | |
| 4,163,998 | A | 8/1979 | Anderson | |
| 4,164,822 | A | 8/1979 | Batton | |
| 4,268,896 | A | 5/1981 | Mann | |
| 4,337,505 | A | 6/1982 | Heimo | |
| 4,344,115 | A | 8/1982 | Pickens | |
| 4,354,222 | A | 10/1982 | Gall | |
| 4,383,291 | A | 5/1983 | Gall | |
| 4,817,315 | A | 4/1989 | Kammerer | |
| 6,000,817 | A | 12/1999 | Chan | |
| 6,183,115 | B1 | 2/2001 | Durando | |
| 6,647,651 | B2 | 11/2003 | Cutright | |
| 6,821,002 | B1 | 11/2004 | Morgen | |
| D544,639 | S | 6/2007 | Galipeau | |
| 7,347,593 | B1 | 3/2008 | Swanson | |
| 2002/0112386 | A1 * | 8/2002 | Thomas | 40/554 |
| 2003/0067777 | A1 * | 4/2003 | Juang | 362/351 |
| 2005/0016667 | A1 | 1/2005 | Dwight et al. | |
| 2006/0239012 | A1 | 10/2006 | Bin | |
| 2008/0130297 | A1 | 6/2008 | Hui | |

FOREIGN PATENT DOCUMENTS

| | | | |
|---|---|---|---|
| FR | 2295683 | | 7/1976 |
| FR | 2295683 | A7 | 7/1976 |
| GB | 10198565.3 | | 3/2011 |
| JP | 2004296168 | A | 10/2004 |
| JP | 2007280629 | A | 10/2007 |
| JP | 2000268611 | A | 9/2009 |
| WO | WO83/01826 | A1 | 5/1983 |
| WO | WO92/04578 | A1 | 3/1992 |

OTHER PUBLICATIONS

United Kingdom Intellectual Property Office, International Search Report under Section 17, Application No. GB1002334.9, May 19, 2010. 1 page.

Orange County Industrial Plastics (OCIP), Plastic Industry Innovations & Solutions, Styrene Sheet, website, (c)2000, 1 page.

Hahnemule, FineArt InkJet Media, 2009, 2 pages, hahnemuehle.com.

Lamps Plus, photograph of lamp, 1 page, 2009.

Michelangelo lamp, photograph of lamp,1 page,2009.

Happy Trail, Roy Rogers & Trigger ,lampshade photograph,1 page, 2009.

Kokopelli Hand Painted Lampshade,www.aanativearts.com, 2 pages, 2009.

The Lampshade Shop, internet catalog excerpt, 1 page, 2009.

HP Researchers Show Prototype of Printed Plastic,Color Display, www.hpl.hp.com, 2 pages, 2004.

How Can You Digitize All Your Old Maps, Architectural Drawings, Sketches or Other Large Artwork,www.cameras-scanners-flaar.org, 3 pages, 2009.

HP Graphic Arts, HP Designjet L2500 Printer series—Key benefits, www.hp.com, 1 page, 2009.

* cited by examiner

*IF TABLE TOP UNIT IS A PEDESTAL MODEL SUBSTITUTE THE FOLLOWING: SLIDE ELECTRIC WIRE THROUGH SLOT IN SUPPORT FRAME, INSERT LAMP SOCKET, THREAD SUPPORT TUBE ONTO NIPPLE ON LAMP SOCKET, SCREW SECOND NIPPLE INTO OTHER END OF TUBE, INSERT INTO SECOND SUPPORT FRAME AND TIGHTEN NUT TO SECURLY ATTACH PEDESTAL.

ONE PIECE SUPPORT FRAME

*IF TABLE TOP UNIT IS A PEDESTAL MODEL SUBSTITUTE THE FOLLOWING: SLIDE ELECTRIC WIRE THROUGH SLOT IN SUPPORT FRAME, INSERT LAMP SOCKET, THREAD SUPPORT TUBE ONTO NIPPLE ON LAMP SOCKET, SCREW SECOND NIPPLE INTO OTHER END OF TUBE, INSERT INTO SECOND SUPPORT FRAME AND TIGHTEN NUT TO SECURLY ATTACH PEDESTAL.

MULTI-PART SUPPORT RIM

ART DISPLAY SYSTEM AND METHOD

RELATED APPLICATIONS

This application is a continuation-in-part of application Ser. No. 12/802,486, filed on Jun. 7, 2010 now abandoned, which application is a continuation-in-part of application Ser. No. 12/653,126, filed Dec. 8, 2009 now U.S. Pat. No. 8,291,628. Applicant claims priority under 35 U.S.C. §120 therefrom. Applicant also claims priority under 35 U.S.C. §119 from United Kingdom application number 1002334.9, filed Feb. 11, 2010, United Kingdom application number 1019865.3, filed Nov. 24, 2010 and European application number EP10194003 filed on Dec. 7, 2010.

FIELD OF THE INVENTION

The present invention relates to a method displaying a selected image in an illuminated display, using components sold fully assembled, partly assembled or ready to assemble in alternate configurations, all with easily exchangeable images.

BACKGROUND OF THE INVENTION

An example of the utilization of this invention is the museum shop market and this application will use production for this market as an example. It should be noted that the utilization of this invention is not intended to be limited to production for museum shops. It can be produced for a wide variety of institutions and businesses for many purposes using production methods, appropriate to those markets.

Museum gift shops often have items for purchase related to their purpose. With the advent of wide format high resolution digital printers and the availability of images on digital media, low volume, high quality reproductions of images are feasible, custom produced for each museum shop to reflect the museum's unique collection.

Visitors to museums are varied. Some arrive by car and would therefore be able to purchase a bulky item; place it in a car, and take it home. Others arrive by public transportation such as a subway or bus, and therefore their carrying capability is limited. Still others may visit a museum while on a distant trip; but they must return by air thereby limiting the bulk and fragility of their purchase at a museum shop. Purchasing compactly packaged components consisting of a customer selected electric/frame kit and a customer selected printed image sheet packaged separately but sold in combination with easy to follow instructions for home assembly requiring no tools or special skills solves this problem. For those who would balk at purchasing anything that would require even the minimum of assembly involvement, purchase of an assembled unit delivered at point of purchase or for shipment to their home, assembled and shipped by the museum, or by the company in accordance with a museum order, could also be accommodated by the museum shop.

A second factor favoring a compactly packaged kit is the fact that storage space for inventory is at a premium at a typical museum shop. This is addressed by compactly packaged kits that can be flexibly combined to fulfill a customer order.

A third factor favoring a frame kit is that same frame components can be assembled in alternate configurations depending on which model of the unit the customer prefers. In addition, the original configuration selection can easily be exchanged subsequently for another configuration at the option of the customer.

The prior art reveals many types of illuminated display units. Some are for the display of two dimensional art reproductions. A sampling of such patents follows. For example, the lamp shade of Lewis, U.S. Pat. No. 2,660,317, has a fenestration on its surface and a recessed plate for accepting an art object in sheet form to be illuminated indirectly by reflected light from the lamp. Buzick's picture display panel for lamp shades (U.S. Pat. No. 2,177,204) is primarily for display of black and white pictures printed on translucent paper by transmitted light. Morgen's light box lampshade (U.S. Pat. No. 6,821,002) provided uniform illumination on its surface for viewing photographic slides placed on its surface. The U.S. Pat. No. of Swanson (7,347,593) relates to a Giclee printed lamp shade that is capable of displaying a high resolution art reproduction made from a digital image file using a process for adhering an image printed on canvas to the surface of an existing lamp shade, where the printing in Swanson occurs before the canvas is adhesively secured to the base lamp shade.

Many other patents in the prior art deal with the bulkiness of lampshades. They relate to knockdown, collapsible, or foldable lamp shades which can be shipped or stored compactly and then assembled and used on a lamp. Four such U.S. patents and one US patent application are identified here as a sampling of the field. They are U.S. Pat. No. 3,742,210 of Chapman, U.S. Pat. No. 3,787,676 of Korach, U.S. Pat. No. 4,075,684 of Witz, U.S. Pat. No. 4,354,222 of Gall, and U.S. patent application US 2006/0239012 of Bin. None of these relate directly to the display of images.

Indeed, while the prior art teaches several approaches to the design of illuminated display units for displayirig images or storing lampshade frames more compactly, none describe an efficient method to display a selected image in the home or elsewhere on an illuminated display unit that is comprised of compactly packaged interchangeable components.

OBJECTS OF THE INVENTION

An example of this invention is to create an efficient business model that serves the needs of museum gift shops and their customers so that exhibits visitors have seen in the museum may be enjoyed in the home after being appreciated in the museum. Many other markets besides museum gift shops can be served. Along the way, a viable manufacturing business is also created.

Another object is to provide illuminated image display units consisting of a set of interchangeable components capable of constructing illuminated image display units for a plurality of presentation modes, such as free standing, pedestal mounted, ceiling suspended and the like.

Other objects which become apparent from the following description of the present invention.

SUMMARY OF THE INVENTION

Museums and particularly museum gift shops have been identified as one potential market for the utilization of this invention and display by a purchaser in a home is anticipated throughout this narrative. But this should be interpreted only as an example and should not be regarded as limiting the scope of the usefulness of the invention. Many institutions and/or businesses could be a potential market and the display unit could be located anywhere for any purpose.

The vehicle for the system and method is an illuminated display unit (IDU) for displaying two dimensional high quality reproductions of images. One aspect of the concept for the IDU of this invention that differs from that of an ordinary lamp and lampshade is that it facilitates the display of special images, which is an integral part of the lighting unit. In addition, low manufacturing cost, compact packaging in kit form, and ease of customer assembly without tools and without special skills are the hallmarks of the IDU. Although the manufactured frame parts are standardized in a range of circumferences to minimize cost, the technique for creating the image sheets, which are illuminated, permits a wide range of image heights to be accommodated by each standardized circumference frame. The IDU component parts can be assembled as a table-top, pedestal or suspended unit, or in other configurations to display images. The same frame elements can be used to illuminate and display a variety of image reproductions just by changing one image for another. Since the electrical parts are provided as a completely pre-wired electrical cord set and a unique slot is provided to insert the wire of the cord set into the frame, no electrical experience is required for customer assembly of the IDU.

Basically, in the preferred embodiment, the lamp socket is a standard AC powered lamp socket, which is secured to the hub of the support frame part with a hand-tightened nut. The image sheet is first formed into a cylinder, then one end of the cylinder is inserted into a slot and secured in a support frame member. The other end is then inserted and secured in a slot in second plain frame member. The frame members then form the cylinder into a conforming closed shape. For example, for table-top use the support frame is at the bottom and the plain frame is at the top of the image sheet. For suspended use this is reversed. For table-top use with a pedestal, a tube and a second support frame to serve as a base (or alternately a modified base) is added. In an alternate embodiment, the light source may be a light emitting diode (LED) light source or other light source, such as a compact florescent light source, and may be powered by a DC power source, such as, for example, a battery.

The production technique to be utilized for the museum shop market, of printing the image sheet by high resolution wide-format ink jet printers is well known, but while the material of the image sheet may be a flexible translucent sheet of various materials, such as styrene or laminated fabric, for example, in a preferred embodiment in this use the material of the image sheet is fine art grade paper, coated for optimal acceptance of inkjet printing, custom manufactured for the IDU application to insure heat resistance, archival type ink acceptance, a translucent appearance, and rigidity once formed into a closed shape which may be straight sided, such as a triangle, a continuous curve, such as a circle, or a combination of straight and curved sections, such as an expanded circle, such shape determined by the frame members to which it is secured at both ends. While any printer capable of printing a high quality image upon a flexible media may be used, a preferred embodiment for this market is a roll-fed wide format ink jet printer, such as printers made by companies as Epson, Canon, Hewlett Packard, Xerox and others which print on rolls having widths from 24 inches to 72 inches. For example, the 10-color 24 inch wide Epson 7900 is one such printer that can be used to print high quality image sheets yielding cylindrical shapes 23 11/16 inch in circumference, with 5/16 inch overlap.

The IDU of this invention will be described as having an elliptical crossectional cylindrical shape as the display surface of the image sheet. For instance, a 24 inch wide image sheet formed into an ellipse by the appropriate size frames would have a major oval diameter of approximately 9.2 inches and a minor diameter of about 5.7 inches. Using this type of printing method the circumference of the IDU display is fixed by the width of the sheet being printed, but the height of the image sheet can be easily varied since this is determined by how the rolled sheet is programmed to be printed and cut apart after printing for use in the IDU. In this way, actual image sheet heights can practically be infinitely varied.

The business model for this invention presupposes that a "company" is formed to produce image sheets and frame/electrical kits for IDU's that would interface with, for example, a variety of museum shops around the country or around the world. The company has a computer system which will communicate between the company and its customers.

The computer system has data processing systems by which the company and respective gift shops communicate via internet or a browser controlling communications over a network via a server, including images plus text required, formatted for printing by the company and includes a database for storing images for printing image sheets when ordered. All communications can be handled via internet for receiving and processing orders. Products can be shipped by common carrier. For example, when a museum gift shop gears up for support of a special museum exhibit, images related to the exhibit can be produced. For the initial order for a new image the company must first create an Image Art Unit (IAU) file with the exact edited digital representation of the image and any text required to be printed on an image sheet, plus cutting instructions. This is what will drive the wide format printer. The formatting for the IAU using the source digital image file can either be done by the company (with instructions from the museum), or it can be performed by museum personnel using the company's website and editing software. The museum also provides text for a description of the image information about the museum and this is printed separately by the company and included with the packaged image that is a component of the IDU, as are instructions for customer assembly.

The company uses pricing software which prices each image sheet corresponding to each desired IAU. Part of the pricing algorithm is based on the height and width of the particular resulting image sheet reflecting the actual substrate material and printing cost. Another pricing aspect may be the ink cost for a particular image sheet reflecting the actual digital color and color density information on each pixel of the image reproduction. Other aspects of pricing may include printer set-up charges and/or amortized formatting charges related to volume ordered. Once the pricing is set for the images, this is relayed to the museum gift shop. Based on demand estimates an initial order is placed by the museum for both the various image sheets as well as for IDU frame/electrical kits selected by the museum. The company will then schedule production and fulfill the initial order for image sheets and IDU frame/electric kits for the museum shop. Subsequent orders for IDU frame/electric kits, and/or image sheets will be fulfilled as required.

At the museum gift shop, customer order fulfillment can be accomplished in a number of ways. Customers may purchase pre-packaged image sheets and IDU frame/electric component kits ready for assembly, pay for them and leave. Or a customer may request an assembled IDU. This can be handled by on-demand assembly at the museum shop or from stock pre-assembled by the museum, or the museums shop can assemble the unit and ship it to the address given by the customer. Assembly for stock can be performed at the museum shop during slack periods. In addition the museum can place an order with the company for a specific unit to be assembled by the company and shipped directly to the customer.

In an alternate embodiment, a packaged unit could be partly assembled and include an assembled support frame with 3 or 4 or more legs, a lamp socket support hub and an electric cord set, a plain frame and an image sheet packaged ready to assemble as an illuminated display unit (IDU) of this invention. The packaging is less compact and less flexible than the previous kits embodiments but only the assembly of the image sheet to the frames by the customer is required.

In another alternate embodiment, the unit could be packaged by the company fully assembled and supplied to the museum with no assembly required by the customer.

When the IDU is sold as a component kit the support frame is assembled by inserting one end of each leg into a mating feature incorporated into one of the frame loops and the other end into a similar mating feature on a hub which serves as the lamp socket support disc in the center. The legs are "V-shaped". The V-shaped legs may be symmetrical or, in a further embodiment may be asymmetrical. The "V" shape of the legs is preferably asymmetric to place the vertex closer to the, outside of the frame rim than to the lamp support hub at the center, which provides more clearance from the surface of the light bulb and better stability for the support of the tabletop model. Marks are provided on the rims of the frames to correctly align the flexible image sheet with the frames.

The configurations for the various IDU models are as follows:

*For the tabletop model—

Bottom: Assembled support frame slot faces up, legs face down

Top: Plain frame slot faces down

*For the hanging model—

Bottom: Plain frame slot faces up

Top: Assembled support frame slot faces down, legs face down

*For the pedestal model—

Bottom: Assembled support frame slot faces up, legs face up

Top: Plain frame slot faces down

Base: Support frame slot faces down, legs face up

Note that these alternate configurations from one kit are only possible if the support frame is not made in one piece but in separate pieces for customer assembly as described herein.

Although the mating features are illustrated in one embodiment as a male and a female dovetail joint, other molded simple sliding and/or snap fit joining features, as are commonly known for joining pieces of an item can be used instead.

In one design, the tapered dovetail slots on the legs have the open end in the same direction at the end of each leg. The matching tapered dovetail lugs on the support frame and lamp socket support hub face alternately in opposite directions around their circumferences. Assembly is achieved by sliding the leg slots onto the hub and frame lugs. The legs may be installed either way up (by turning the legs over and moving each leg around the circumference of the support frame to the next set of rim lugs), depending on which leg position, up or down, is required for the model being assembled. There may be two sets of lugs on the lamp socket support disc at two different radii and/or there may be projections incorporated into the rim to compensate for different radii, so that a range of support rims can be accommodated by the same leg length.

In an alternate embodiment, the opposite distal ends of legs connecting the rim frame to the central lamp socket support hub have attachment extensions which mate with slots or holes associated with the support frame at one end and with the central lamp socket support hub at the other end. The extensions are inserted into and through slots or holes in the support frame and in the lamp socket support hub. As these extensions are pushed in toward the step region, molded cantilevered tongues are compressed until they again snap out locking extensions in the slots or holes. The cantilevered tip of each tongue is flexible, so that it compresses as the tongue is inserted into the leg attachment slot/hole and decompresses outward when through the slot/hole, thereby locking the legs in place in the respective slot/holes in the support frame at one end and in the lamp support hub at the other end.

With either design the legs may be detached from the rim and hub and reassembled in a different configuration if a different model IDU is desired.

In the preferred alternate embodiment, an illuminated display unit (i.e. IDU) is comprised of two component kits (1) a multi-part frame kit and electric cord set for assembly without the use of tools, and (2) an image sheet imprinted on fine art paper media such as the Toscana™ product provided by Hahnemuhle which is specially coated on one side for high quality inkjet printing.

The image sheet is unrolled and formed into a cylindrical shape then captured in a conforming shape within a circumferentially extending slot in the top and bottom frame members and locked in place using multiple resilient clips (rim inserts) which impinge on the top and bottom edges of the image sheet. Depending on how the frame parts are assembled the IDU can be configured as a tabletop, pedestal or as a pendant model. The clips can easily be taken out to permit the image sheet to be removed and exchanged at will since the image sheet is not bonded permanently to the frame. Changing the IDU configuration from table top, pedestal, or pendant to another configuration is also made easy simply by removing the image sheet, re-configuring the frame by disassembling and reassembling the component parts, then re-inserting and re-securing the image sheet.

The four steps that may be used to assemble either a tabletop or a pendant model of this preferred alternate embodiment are presented here as they also summarize the various parts of the IDU:

Table Top Model

1. Image Sheet Preparation—Remove the image sheet from box A.

Let it unroll and it will form a cylindrical shape. Put it down on a table with the ends of the roll facing up.

Remove the cover from the two sided adhesive tape that is located at one end of the image sheet.

Position that end of the image sheet above the other end so the full length of its edge is aligned between the two lines printed on the other end.

Press the two ends together and the image sheet is now formed into a continuous cylinder. Turn the cylinder over and place it horizontally on a table, then press down along the overlap to ensure a strong bond the full length of the overlap.

Note: You may want to practice this before removing the cover from the tape. Try positioning the edge of the sheet between the lines, starting at one end.

2. Frame Preparation—Remove the three legs, the triangular hub, and the two frames from box B. Leave the other items in the box.

Place the hub (either side up) on a table and push the ends of the long arms of the three legs (marked O) into the slots in the hub (marked O).

Place the frame with slots for the legs on a table with the side of the frame that does not have a perimeter slot facing up and push the short ends of the three legs (marked X) into the three slots in the frame (marked X).

Note: If you want to disconnect a leg after it is installed just tilt it and it will come out of the slot.

3. Install Electric Parts—Remove the electric assembly from box B. Only the frame inserts now remain in the box.

Pull the nut along the electric cord a short distance away from the bulb socket.

Slide the electric cord wire through the slot in the triangular hub so that the bulb socket is facing in the opposite direction to the legs.

Push the threaded nipple on the bulb socket through the center hole in the hub.

Slide the nut along the electrical cord up to the nipple on the bulb socket. Tighten the nut by hand until the bulb socket is secure in the hub.

4. Final Assembly—Remove eight frame inserts from box B. There is an extra frame insert in the box in case one is mislaid.

Position the image sheet cylinder vertically on a table so the picture faces up.

Position the vertical mark on the outside face of the plain frame so it aligns with the overlapping vertical edge of the image sheet cylinder.

Push the frame downward on to the image sheet cylinder so the cylinder engages the slot in the frame. Use the lugs on the inside of the frame to help guide the image sheet cylinder into position. The frame must be pushed all the way down so that the cylinder edge goes to the bottom of the slot all the way around.

Reach inside the cylinder and push four of the frame inserts into the four horizontal slots in the frame until they are all the way in and grip the edge of the image sheet securely. You can do this most easily by first inserting one end, then use two thumbs to both compress the insert and push the other end into the slot.

Turn the image sheet cylinder and rim upside down so the plain frame is now on the bottom.

With the legs facing in an upward position the frame which has three legs attached above the image sheet cylinder so that the vertical mark on the outside face of the frame aligns with the overlapping vertical edge of the image sheet cylinder.

Push the frame downward on to the image sheet cylinder and repeat the above installation steps for the cylinder.

Turn the unit right side up, screw in a 75 watt incandescent bulb, plug in the electric cord and the MuseumLight™ is operational.

Note: To release the MuseumLight™ image sheet cylinder from the frame, for instance to exchange one image sheet for another or to realign the existing image if necessary, just insert a screwdriver (or similar) in the space at either end of the insert between the insert and the rim and pry the insert out of the rim slot. When the insert are removed the image sheet cylinder will be released from the rim.

Pendant Model

1. Image Sheet Preparation—Remove the image sheet from box A.

Let it unroll and it will form a cylindrical shape. Put it on a table with the ends of the roll facing up.

Remove the cover from the two sided adhesive tape that is located at one end of the image sheet.

Position that end of the image sheet above the other end so the full length of its edge is aligned between the two lines printed on the other end.

Press the two ends together and the image sheet is now formed into a continuous cylinder. Turn the cylinder over and place it horizontally on a table, then press down along the overlap to ensure a strong bond the full length of the overlap.

Note: You may want to practice this before removing the cover from the tape. Try positioning the edge of the sheet between the lines, starting at one end.

2. Frame Preparation—Remove the three legs, the triangular hub, and the two frames from box B. Leave the other items in the box.

Place the hub (either side up) on a table and push the ends of the long arms of the three legs (marked O) into the slots in the hub (marked O).

Place the frame with slots for the legs on a table with the side of the frame that has a perimeter slot facing up and push the short ends of the three legs (marked X) into the three slots in the frame (marked X).

Note: If you want to disconnect a leg after it is installed just tilt it and it will come out of the slot.

3. Install Electric Parts—Remove the electric assembly from box B. Only the rim inserts and canopy kit now remain in the box.

Pull the nut along the electric cord a short distance away from the bulb socket. Slide the electric cord wire through the slot in the triangular hub so that the bulb socket is facing in the same direction as the legs.

Push the threaded nipple on the bulb socket through the center hole in the hub.

Slide the nut alone the electrical cord up to the nipple on the bulb socket. Tighten the nut by hand until the bulb socket is secure in the hub.

4. Final Assembly—Remove eight frame inserts from the frame and electric parts box B. There is an extra frame insert in the box in case one is mislaid. Only the canopy kit now remains in the box.

Position the image sheet cylinder vertically on a table so the picture faces down.

Position the vertical mark on the outside face of the plain frame so it aligns with the overlapping vertical edge of the image sheet cylinder.

Push the frame downward on to the image sheet cylinder so the cylinder engages the slot in the frame. Use the lugs on the inside of the frame to help guide the media cylinder into position. The frame must be pushed all the way down so that the cylinder edge goes to the bottom of the slot all the way around.

Reach inside the cylinder and push four of the frame inserts into the four horizontal slots in the frame until they are all the way in and grip the edge of the image sheet securely. You can do this most easily by first inserting one end, then use two thumbs to both compress the insert and push the other end into the slot.

Turn the image sheet cylinder and rim upside down so the plain frame is now on the bottom.

With the legs facing in a downward position the frame which has the legs attached above the image sheet cylinder so that the vertical mark on the outside face of the rim aligns with the overlapping vertical edge of the image sheet cylinder.

Push the frame downward on to the image sheet cylinder and repeat the above installation steps for they cylinder.

Connect to power supply in ceiling. Use the canopy parts that are in box B, if required. Note that this step must be done by a qualified electrician.

Screw in a 75 watt incandescent bulb, and your MuseumLight™ is operational.

Note: To release the MuseumLight™ image sheet cylinder from the frame, for instance to exchange one art media sheet for another or to realign the existing image if necessary, just insert a screwdriver (or similar) in the space at either end of the insert between the insert and the frame and pry the insert out of the frame slot. When the inserts are removed the image sheet cylinder will be released from the frame.

Besides the differences in the IDU from the previous embodiments, some changes have been made to streamline a new IDU set-up. Instead of providing software to a museum for formatting a new IDU, the formatting software is now an integral part of the company website so that the museum can do this itself and review the result immediately.

In general, the present invention is an illuminated display unit including:

A) A support frame having at least one surface along the inside of the frame;

B) An image sheet placed directly against at least one surface of the frame with an edge thereof abutting against at least one surface; and C) A fastener fastening the image sheet against at least one surface to retain the image sheet secure in the frame, whereby the image sheet is held securely for display without the use of adhesives or any attachment device potentially damaging the image sheet and D) Whereby the image sheet is releasable by releasing the fastener from the frame and allowing withdrawal of the fastener from the frame, thereby releasing the image sheet free of any damage.

Optionally, the frame can have slots formed in the loop member which engage with the fastener, so that the image sheet is held flat directly against the at least one surface of the frame with an edge thereof abutting against at least one surface. The fastener within the slot pressing the image sheet against at least one surface to retain the image sheet securely in the frame without the use of adhesives or any attachment device damaging the image sheet. The image sheet is releasable by releasing the resilient fastener from the loop frame member and allowing withdrawal of the fastener from the slot, thereby releasing the image sheet free of any damage.

In a preferred embodiment, the insert contained within the slot has a center leg pressing the image sheet against the surface to retain the image sheet secure in the frame. This preferred insert has separate resilient end legs on opposite sides of the center leg with a tooth on outer edges thereof to engage end edges of the slot, to retain the insert within the slot, with the center leg engaging with the image sheet, holding the image sheet in place on the support frame, so that the image sheet is held securely. The image sheet is releasable by pressing the end legs of the insert inwardly toward the center leg, to disengage the insert from the frame member and allow withdrawal of the insert from the slot, thereby releasing the image sheet free of any damage.

Optionally, the support frame is an extended member which is provided with multiple, spaced leg members.

Furthermore, the support frame includes a hub for supporting a lighting fixture.

The support frame has an annular shape rim for securing an image sheet which extends from the support frame, with the lighting fixture located within said annular shaped image sheet so that the image is viewable from outside of the annular shaped image sheet.

Before assuming its closed annular shape, the image sheet is a flat, flexible and transparent or translucent member with an image reproduced on a surface thereof.

The support frame and the hub can have integrally formed separate spaced leg attachments, for attaching legs.

These leg attachments may include slots in the hub along outer edges thereof and in the frame for releasable engaging the supporting legs from each attachment slot.

The hub has a central opening for receiving a light socket fixture, and a slot extending out from the central opening to allow for the wire of an assembled cord set to be inserted into the hub. The lighting element of the lighting fixture is enclosed within the confines of the closed shape image sheet, whereby the image is viewed from outside of the display unit.

In one embodiment the supporting legs are V-shaped and face downwardly to form a support for the display unit on a table top surface with the image sheet and lighting fixture extending upwardly.

In an alternate embodiment, the supporting legs and hub form a support for the display unit suspended from a wall bracket or ceiling forming a pendant with the supporting legs, image sheet and lighting fixture extending downwardly, so that the supporting legs are not extending above the support frame.

While it is theoretically possible to support and retain the image sheet with a single frame with fasteners, preferably the display unit has a second frame at the opposite end of the image sheet forming top and bottom frames holding the image sheet therebetween.

The image sheet will then have an annular shape determined by the frames to which it is attached.

The present invention also entails a method of assembling a transparent or translucent art sheet for display of an image formed on a surface thereof, including the steps of:

A) Rolling a rectangular shaped image sheet into a cylindrical configuration, with end edges overlapping and secured with an adhesive strip or otherwise secured;

B) Inserting an open end of the rolled image sheet into an annular supporting frame, with the supporting frame preferably having an L-shaped or U-shaped crossection with bottom and side adjacent surfaces along the inside of the L-shaped or U-shaped crossection of the frame and optionally having a slot formed in the rim member with the image sheet being held directly against the adjacent surface of the frame with an edge thereof abutting against the side adjacent surface;

C) Inserting fasteners into the frame, such as a frame insert within a slot, each frame insert having a center leg pressing the image sheet against the frame surface, to retain the image sheet secure in the frame, with each respective frame insert having separate and resilient spaced end legs, off opposite sides of the center leg, with a tooth on outer edges thereof, to engage end edges of each respective slot to retain the insert within the slot, with the center leg engaging the image sheet holding said image sheet in place on the frame;

D) Mounting a light source on the support frame and extending into a space formed within said image sheet for lighting the image sheet from within, for displaying the image on the image sheet;

E) The image sheet being held securely for display without the use of any attachment device damaging the image sheet; and F) Releasing the image sheet, by releasing the fastener, such as by pressing the end legs of each respective fastener inwardly toward the center leg, to disengage the fastener from the frame member and allow withdrawal of the fastener from the slot thereby releasing the image sheet free of any damage.

The method further includes providing the support frame with a central hub for mounting of said the electrical light source.

Supporting legs are provided for connecting the hub to the support frame. The supporting legs are shaped to act as legs to support the IDU on a table top surface with the image sheet extending upwardly from said support frame and the hub and supporting legs inside the image sheet, with the light source extending above the hub within the image sheet.

Alternatively, the supporting legs are provided for connecting the hub to the support frame with the supporting legs used to suspend the IDU as a pendant from a ceiling fixture or wall bracket, with the image sheet extending down from said support frame, and the hub and supporting legs inside the image sheet, with the light source extending down below the support frame within the image sheet.

BRIEF DESCRIPTION OF THE DRAWINGS

The present invention can best be understood in connection with the accompanying drawings. It is noted that the invention is not limited to the precise embodiments shown in drawings, in which:

FIGS. 33A-33E show the steps of assembling an image sheet into a cylinder shape prior to attachment to a frame for either a table top or pendant IDU, wherein:

FIG. 33A is a perspective view of a box containing a rolled up image sheet.

FIG. 33B is a perspective view of an image sheet unrolled with the release strip being pulled off one side of the two-sided tape attached to the edge of the image sheet.

FIG. 33C is a perspective view of the step of attaching the free ends of the image sheet after removing the release strip.

FIG. 33CC is a perspective enlarged detail of FIG. 33C to illustrate the accurate adhesion of the image sheet cylinder along the overlap.

FIG. 33D is a perspective view of an image sheet cylinder lying horizontally after assembly.

FIG. 33DD is an edge elevation detail of the overlapped seam of FIG. 33D showing directions of pressure required to permanently adhere the seam.

FIG. 33E is a perspective view of a vertically oriented completed image sheet cylinder.

FIGS. 34A-34D illustrate the steps of assembling the support frame of a table top IDU, wherein:

FIG. 34A is a perspective view of a box containing the frame members of an IDU.

FIG. 34B is a perspective view illustrating the step of inserting the three legs into the triangular socket support hub. The legs marked O are inserted into the socket support hub slots marked O.

FIG. 34C is a perspective view showing the step of attaching legs and hub to the support frame. The leg ends marked X are inserted into the rim slots marked X.

FIG. 34CC is a crossectional detail of the edge of the support frame showing the orientation of perimeter slot if assembled for the tabletop model IDU.

FIG. 34D is a perspective view of an assembled support frame.

FIG. 34E is a crossectional detail of the edge of the support frame showing the orientation of the perimeter slot if assembled for a pendant model IDU.

FIG. 35A-35F illustrate the steps of attaching the electrical components to the assembled support frame for a table top IDU and for a pendant IDU, wherein:

FIG. 35A is a side elevation of lamp socket with threaded nipple and a retaining nut on electrical wire.

FIG. 35B is a perspective detail showing insertion of electrical wire through a side slot into center hole of triangular socket support hub.

FIG. 35C is a perspective detail showing setting the nipple on the socket into hole in socket support hub.

FIG. 35D is a perspective detail showing nut dangling wire under socket support hub.

FIG. 35E is a side elevation detail showing nut engaging socket nipple to attach socket to socket support hub.

FIG. 35F is a side elevation in partial crossection showing support frame with socket attached and orientation of frame slot and socket for a tabletop IDU.

FIGS. 36A-36I illustrate the assembly steps to complete the assembly of a table top IDU by attaching the image sheet cylinder to the assembled frame members, wherein:

FIG. 36A is a perspective view of orientating the plain frame atop the image sheet cylinder.

FIG. 36B is a perspective view of the completion of action of 35A.

FIG. 36C is a perspective view illustrating insertion of four frame inserts to retain the image sheet in the slot in the plain frame.

FIG. 36CC is a perspective detail of a rim insert inserted in a horizontal frame slot.

FIG. 36D is a perspective view illustrating inverting an image sheet with the plain frame attached.

FIG. 36E is a perspective view showing support frame oriented atop open end of the formed image sheet.

FIG. 36F is a perspective view showing the completion of the action of 36E.

FIG. 36G is a perspective view illustrating insertion of four frame inserts to retain the image sheet in the support frame.

FIG. 36GG is a perspective detail of one rim insert inserted through one horizontal rim slot.

FIG. 36H is a perspective view illustrating inversion of assembled tabletop IDU so that legs can rest on a horizontal surface.

FIG. 36I is a perspective view showing addition of a lamp to the complete IDU.

FIG. 37A-37H illustrate the final assembly of a pendant IDU of this further alternate embodiment, wherein:

FIG. 37A is a perspective view of orienting the plain frame atop the image sheet cylinder.

FIG. 37B is a perspective view of the completion of action of 37A.

FIG. 37C is a perspective view illustrating insertion of four frame inserts to retain the image sheet in the slot in the plain frame.

FIG. 37CC is a perspective detail of a frame insert inserted through one horizontal frame slot.

FIG. 37D is a perspective view illustrating inversion of image sheet with plain frame attached.

FIG. 37E is a perspective view showing support frame oriented atop open end of the formed image sheet.

FIG. 37F is a perspective view showing the completion of the action of 37E.

FIG. 37G is a perspective view illustrating insertion of four frame inserts to retain image sheet in the support frame.

FIG. 37GG is a perspective detail of one frame insert inserted though one horizontal rim slot.

FIG. 37H is a perspective view illustrating adding a lamp to the complete pendant IDU.

DETAILED DESCRIPTION OF THE INVENTION

The present invention has broad applications to many fields for a variety of IDU's. For illustrative purposes only, a preferred mode for carrying out the invention is described herein.

Figure 1:
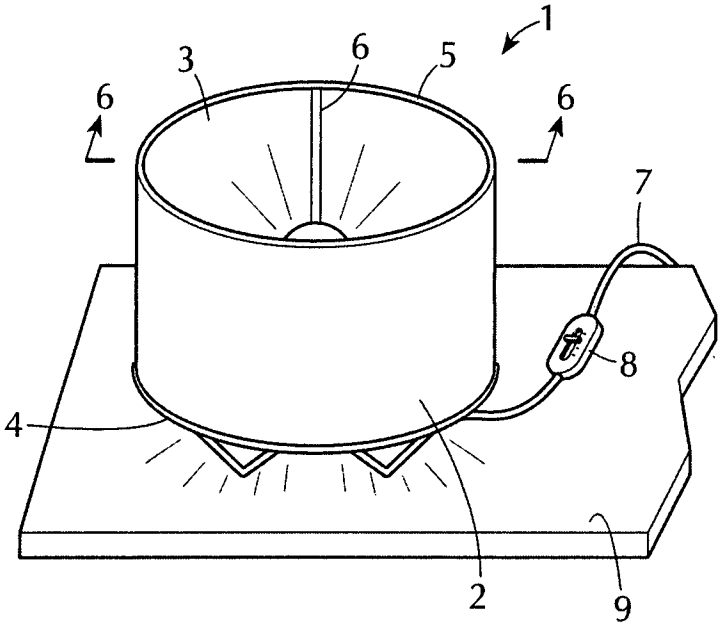
FIG. 1 is a perspective view of an assembled IDU in use on a table top.

FIG. 1 shows a table top 9 on which illuminated display unit (IDU) 1 with image sheet 3 displaying image 2 rests. Image sheet 3 is contained and shaped between a support frame 4 at the bottom edge incorporating support legs facing down and a plain frame 5 at top edge. A small overlap 6 of the free ends is at the rear of the display unit. Electrical control (switch or switch/dimmer) 8 is shown on electrical line 7.

Figure 1B:
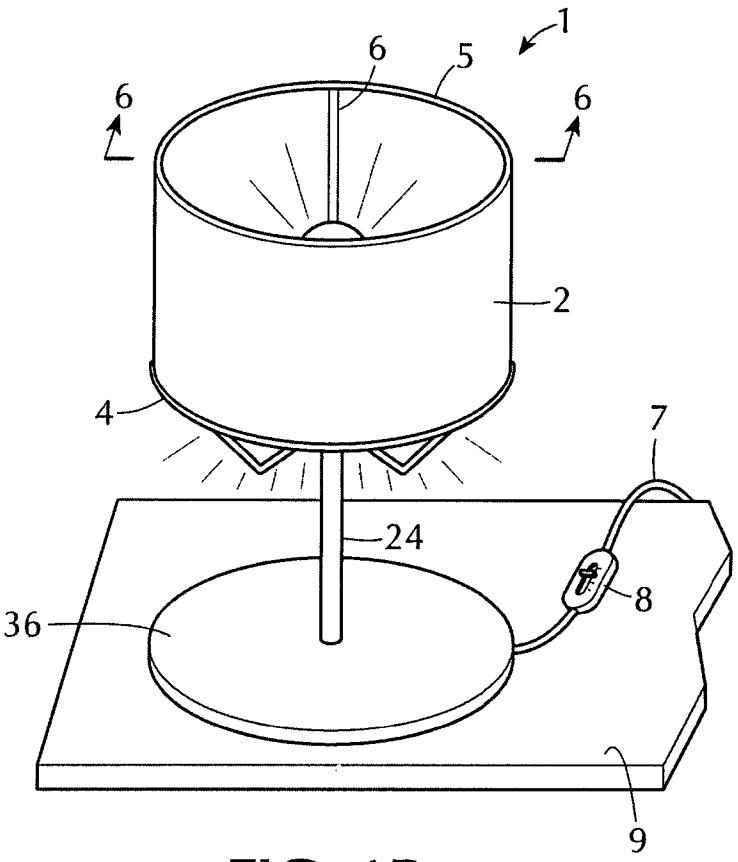
FIG. 1B is a perspective view of an assembled IDU with a base using a modified base in use on a table top.
Figure 1A:
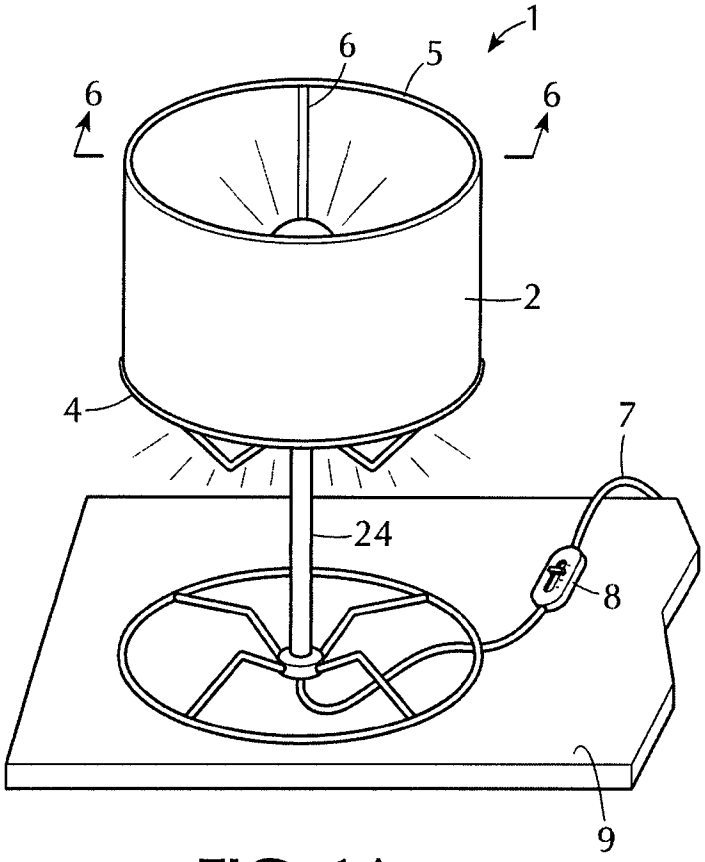
FIG. 1A is a perspective view of an assembled IDU with a pedestal using a second support frame at the base in use on a table top.

FIG. 1A is a similar image of the same IDU 1 but with a pedestal tube and second support frame added at the base, wherein the support legs extend upward within the region surrounded by image sheet 3 of the illuminated display unit (IDU) 1.

FIG. 1B is a similar image of the same IDU 1 but with a pedestal tube and with a modified base, also wherein the support legs extend upward within the region surrounded by image sheet 3 of the illuminated display unit (IDU) 1.

Figure 2:
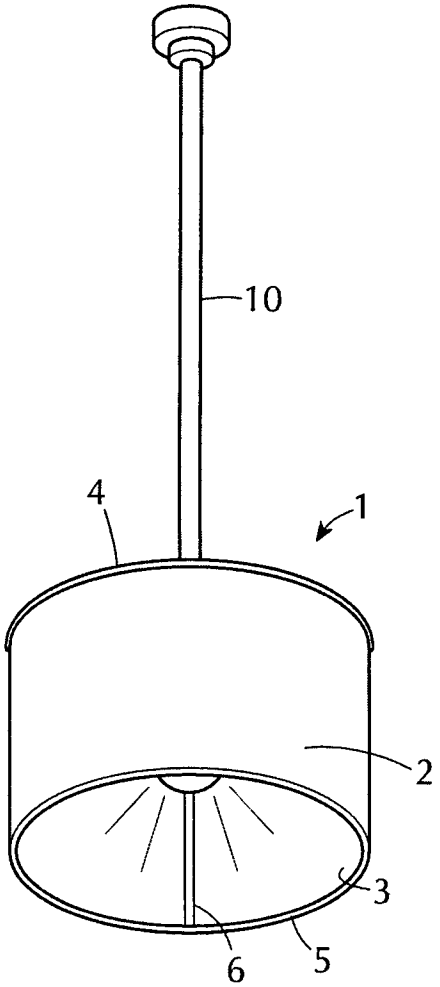
FIG. 2 is a perspective view of an assembled IDU suspended by a pulley cord.

FIG. 2 is a similar image of the same IDU 1 configured for hanging from pulley cord 10 with support legs at the top.

Figure 3A:
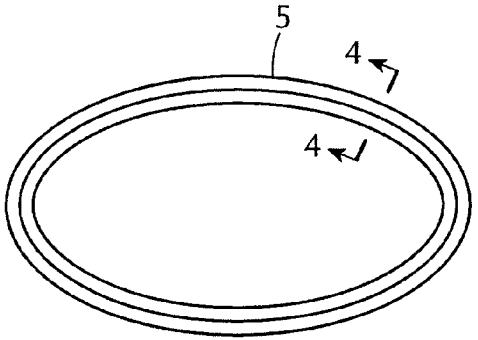
FIGS. 3A and 3B are top plan views of the two part frame set showing the plain frame as well as the support frame if molded in one piece, incorporating, in this case, 4 legs.
Figure 3B:
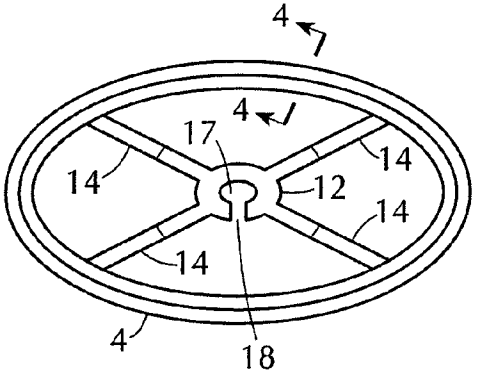

FIGS. 3A and 3B show the two frame parts. In this illustration the plain frame 5 is an oval shape. The support frame 4 is also oval but incorporates four legs (drawn flat) 14 leading at the center to a hub, such as a lamp socket support hub 12 with a central hole for the socket nipple 17 and a side slot for electric wire insertion 18.

Figure 4:
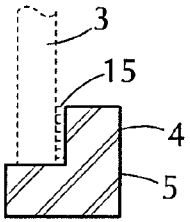
FIG. 4 is a crossection detail of the image sheet support surface of each frame member showing the edge of the image sheet abutting a layer of two sided attachment tape.

Each of the image sheet support edges of the frames in this illustration have a preferably L-shaped crossection (see FIG. 4) which supports a top or bottom edge of image sheet 3. These supports also have a layer of tape attached with a release liner 15. The release liner can be removed prior to assembly to expose an adhesive layer for permanent attachment of the image sheet to the frame. This is optional for the table top unit where gravity holds the image sheet tot eh support frame 4 and to the plain frame 5. For the hanging configuration where gravity tends to pull the three sections apart, the adhesive layer 15 must be exposed and used.

Figure 5:
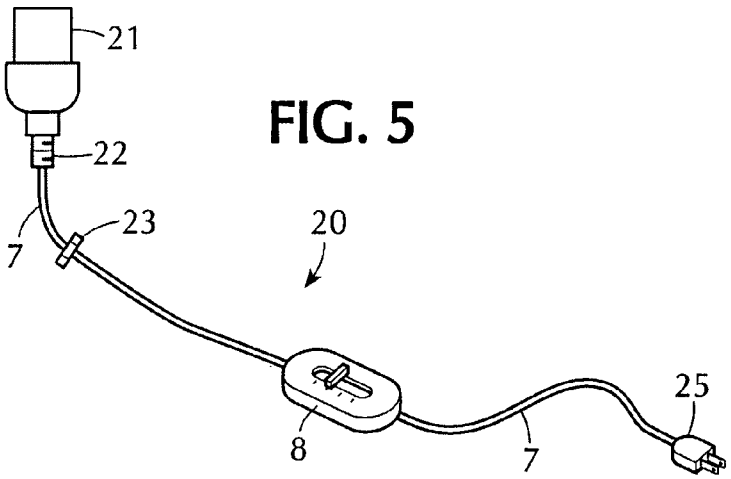
FIG. 5 is a plan view of the pre-wired electrical assembly that is part of the IDU kit. (In the case illustrated this is for a table top unit and incorporates a dimmer. Alternative electrical kits will be available, including an electric assembly with a pulley cord for pendant units.)

FIG. 5 shows a pre-wired electrical cord set for the table top model 20 consisting of lamp socket 21 with pre-attached short threaded nipple 22, nut 23, control 8, extension cord 7, and wall plug 25. Line cord 7 fits through slot 18 on socket support hub 12 which then permits short threaded nipple 22 to fit through the center hole 17 for attachment of the lamp socket even though the entire electrical set is pre-wired.

Figure 5A:
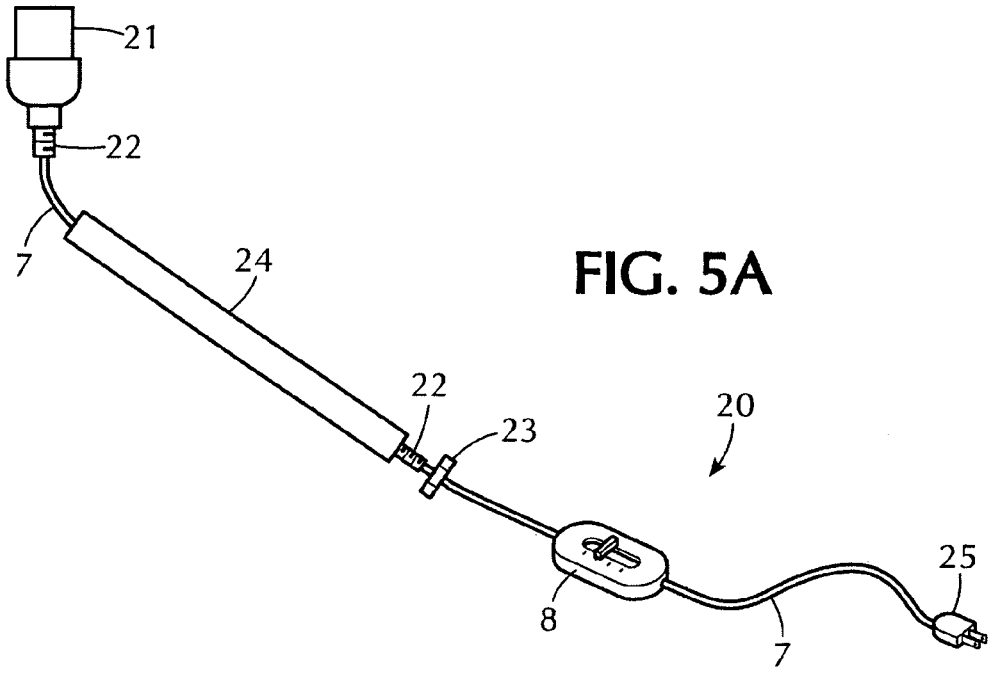
FIG. 5A is a plan view of an alternative electrical assembly for a table top unit with a pedestal that will use a second support frame as a base.

FIG. 5A shows a pre-wired electrical set for the pedestal model 20 consisting of lamp socket 21 with pre-attached short threaded nipple 22, tube with internal threads to fit nipples at both ends 21, with pre-attached short threaded nipple at the end opposite the lamp socket 22, nut 23, control 1, extension cord 7, and wall plug 25. Line cord 7 fits through slot 18 on socket support hub 12 which then permits short threaded nipple 22 to fit through the center hole 17 for attachment even though the entire electrical set is pre-wired.

Figure 5B:
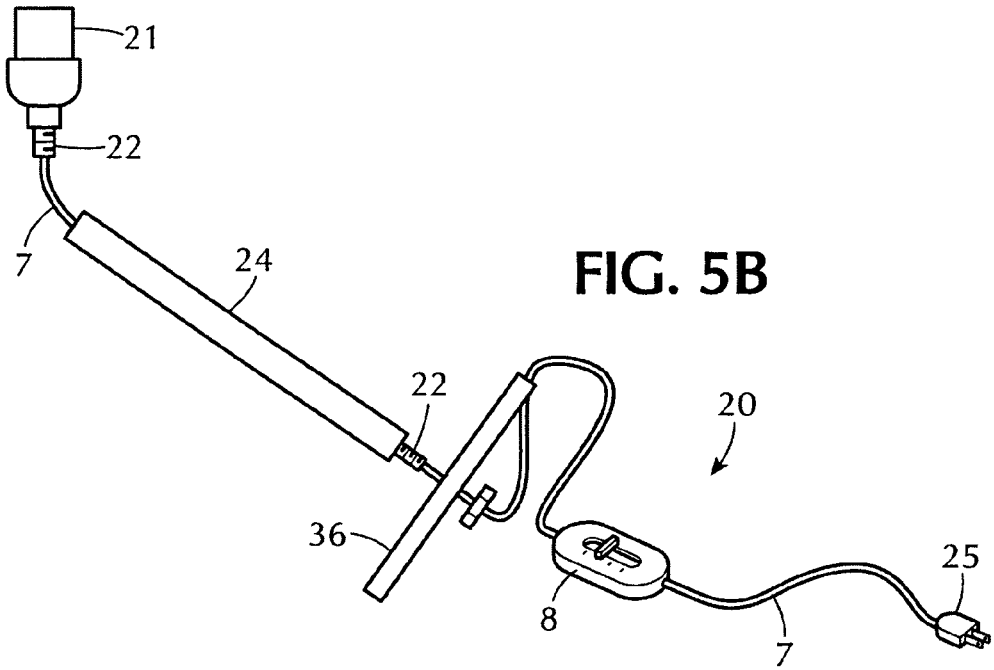
FIG. 5B is a plan view of an alternative electrical assembly for a table top unit with a pedestal using a modified base.

FIG. 5B shows the same electrical set as 5A but with a modified base unit 36 on line cord 7.

Figure 6:
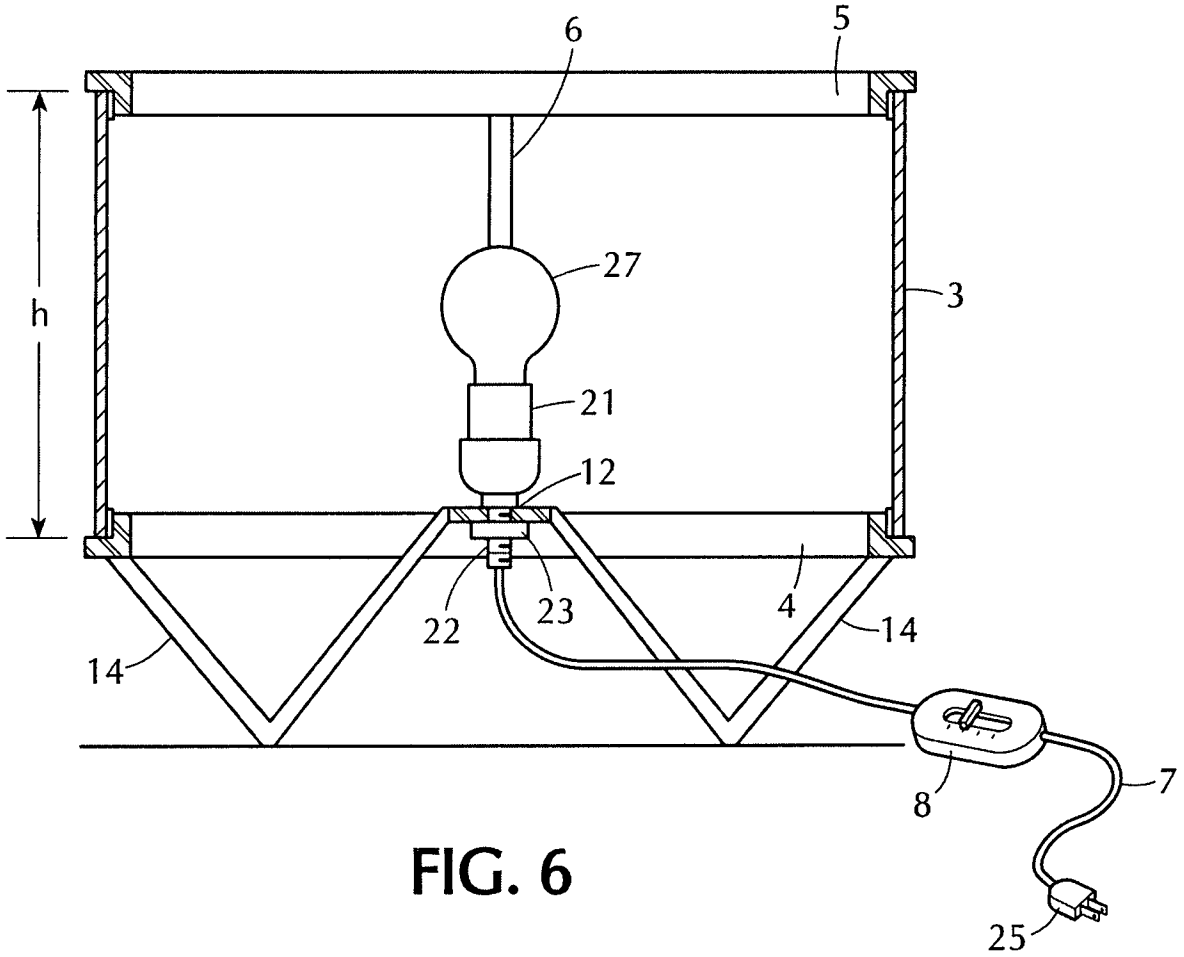
FIG. 6 is a side view crossection of an assembled table top IDU taken along the major diameter of an oval shape.

FIG. 6 shows how the various parts fit together for the table top model; bulb 7 (or optional CFL) is not part of the electrical kit because of fragility concerns. Note that legs 14 on support frame 4 angle down to create integral legs. The preferred fabrication of both frame parts is injection molding using a glass filled polycarbonate resin. In this illustration the support frame 4 would be formed as a single piece.

Figure 6B:
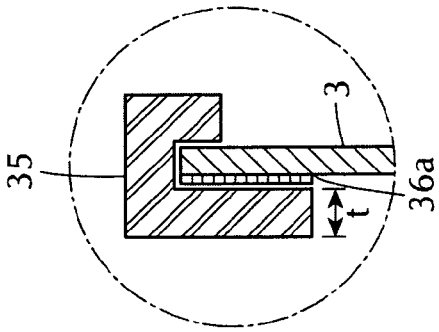
FIG. 6B is a side crossection detail of a modified edge shown in FIG. 6A.
Figure 6A:
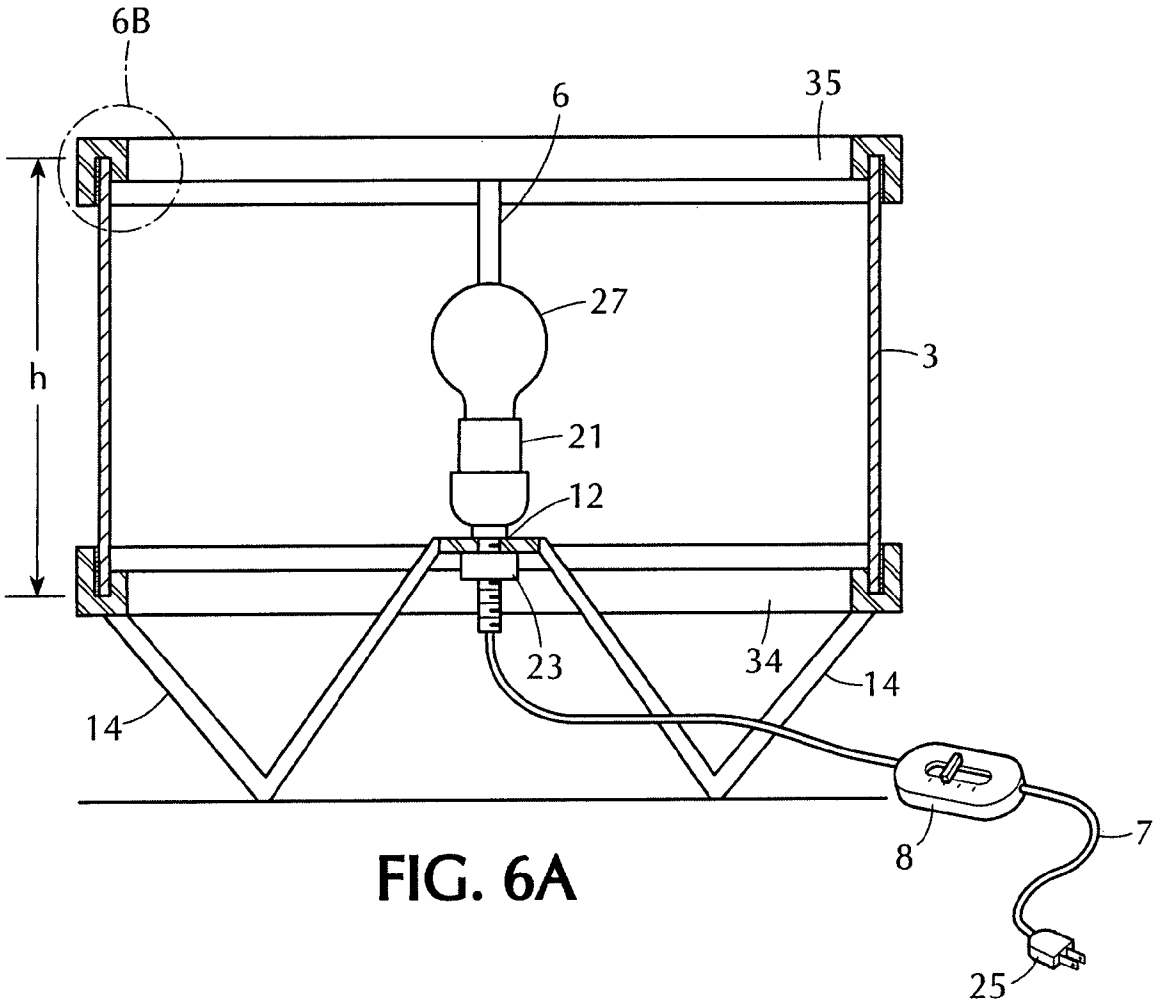
FIG. 6A is a side view crossection of an assembled table top IDU of an alternate embodiment using a frame with a slot to engage the image sheet edge.

FIG. 6A shows an alternate embodiment of an illuminated table top model display unit (IDU) using another design of a support edge with an outer support lip added on plain frame 35 and support frame 34. The detail of FIG. 6B shows how such an edge engages art sheet 3 at top edge. Note that double-sided tape with release liner 36A may be attached to art sheet 3 or to the frame edge is in either design. Frame edge material thickness T is nominally EDM 3/32" with other dimensions relatively scaled.

Figure 6C:
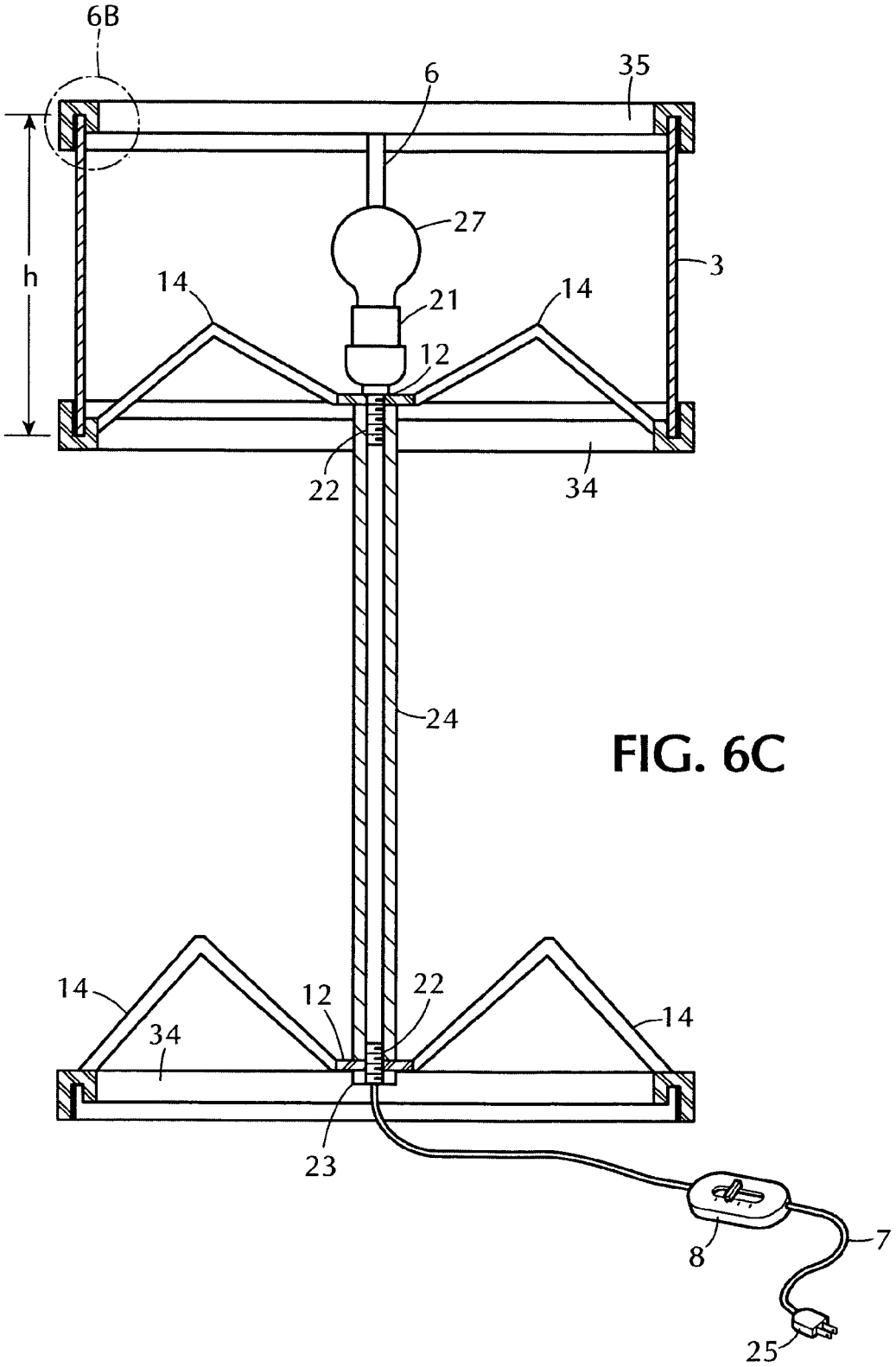
FIG. 6C is a side view crossection of an assembled table top IDU with a pedestal using a second support frame member as a base.

FIG. 6C shows a pedestal model illuminated display unit (IDU) which provides a pedestal between the image display unit and table top. This shows how the pedestal tube internally threaded at both ends 24 screws on to the short threaded nipple 22 an the lamp socket 21 and at the other end on to a second short nipple 22 which is inserted into center hub 12 on a second support frame 34, and held in place by nut 23. Legs 14 are shown extending upward within the region surrounded by image sheet 3 and on the bottom frame which would be possible if also made, with the legs thus oriented or if the support frame parts are provided separately for customer assembly as described on a later page herein concerning FIGS. 12-27.

Figure 6D:
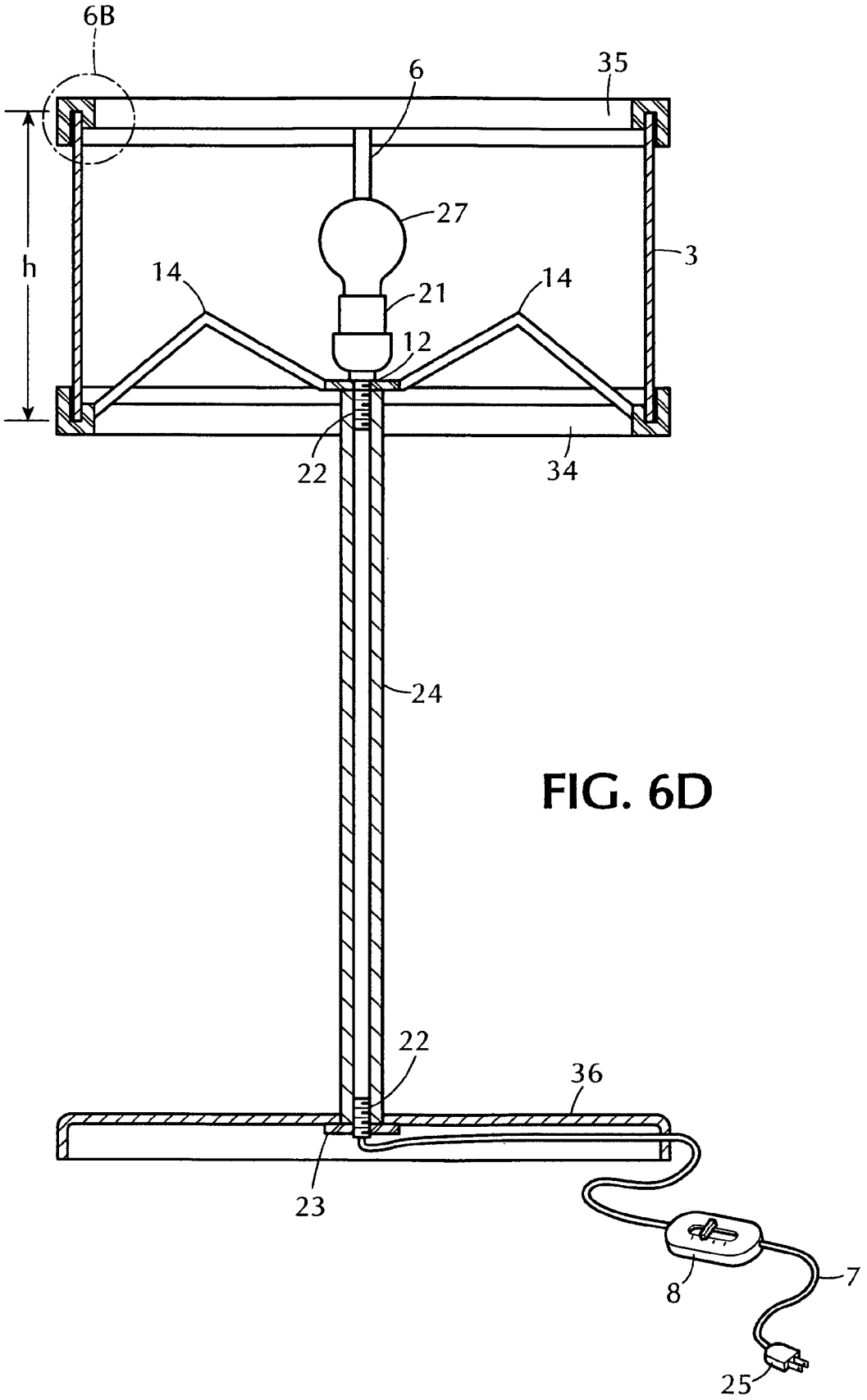
FIG. 6D is a side view crossection of an assembled table top IDU with a pedestal using a modified base.

FIG. 6D shows the modified base 36 illustrated in FIG. 1A, which assembles in same manner as the parts in FIGS. 6C but must be provided pre-threaded on the electric wire as part of the electric kit because it does not have the unique slot provided for wire insertion that is on the support frame 34. Legs 14 are shown optionally extending upward within the region surrounded by image sheet. Electric cord 7 preferably exits out through a hole in base 36.

Figure 7:
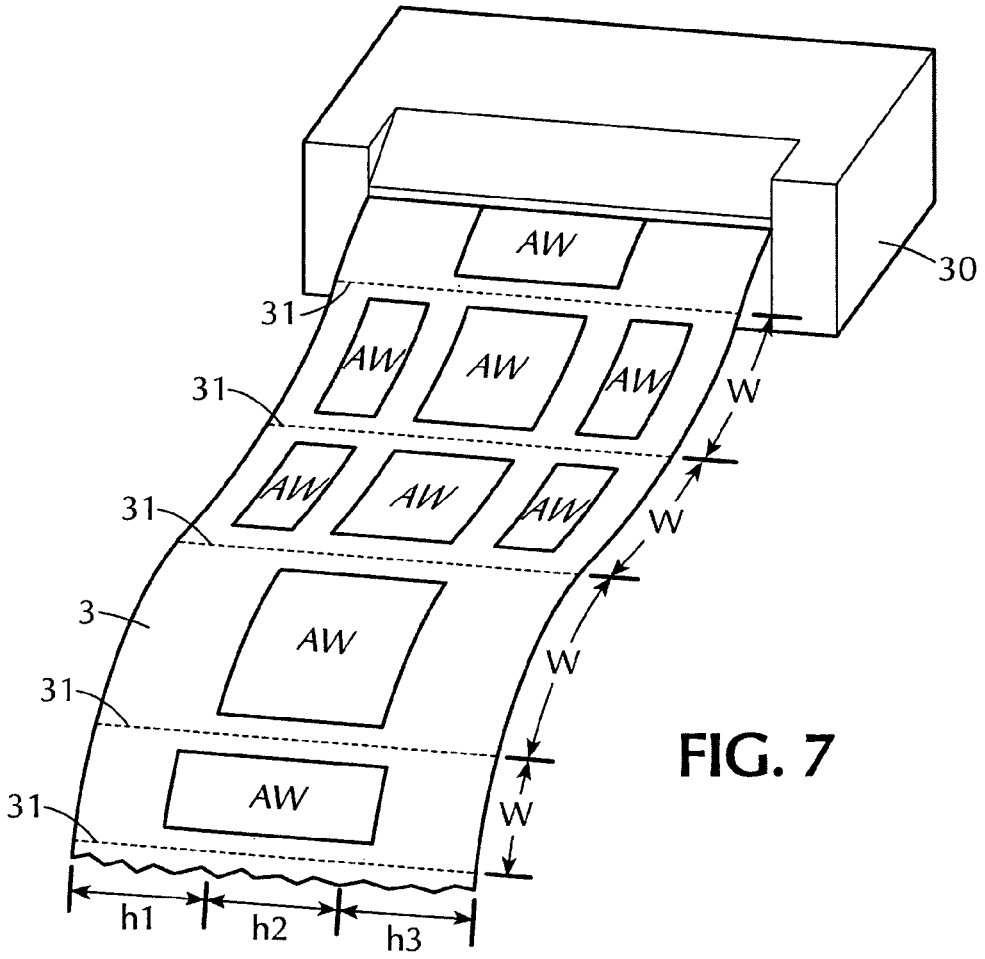
FIG. 7 is a perspective schematic view showing a continuous portion of image sheet material merging from a printer with a variety of images printed on image sheet sections (prior to cutting apart for each IDU).

FIG. 7 shows a printer, such as a wide format printer 30, spewing out a long sheet of image sheet material which will be sliced at dashed lines 31 to form individual strips (all of the same circumference length as the width of the image sheet material but cut in various lengths "W") which will become image sheets 3 displaying images "AW" after cutting into separate units. Note the heights of the different image sheets ("W") varies with the particular AW being printed since they are determined by the programmed instructions to the printer and are therefore infinitely variable. However, any printer capable of printing an image upon a flexible translucent or transparent such as a sheet of plastic, laminated textile or art paper may be used, wherein one or more images and lettering may be printed on the flexible sheet.

Figure 8:
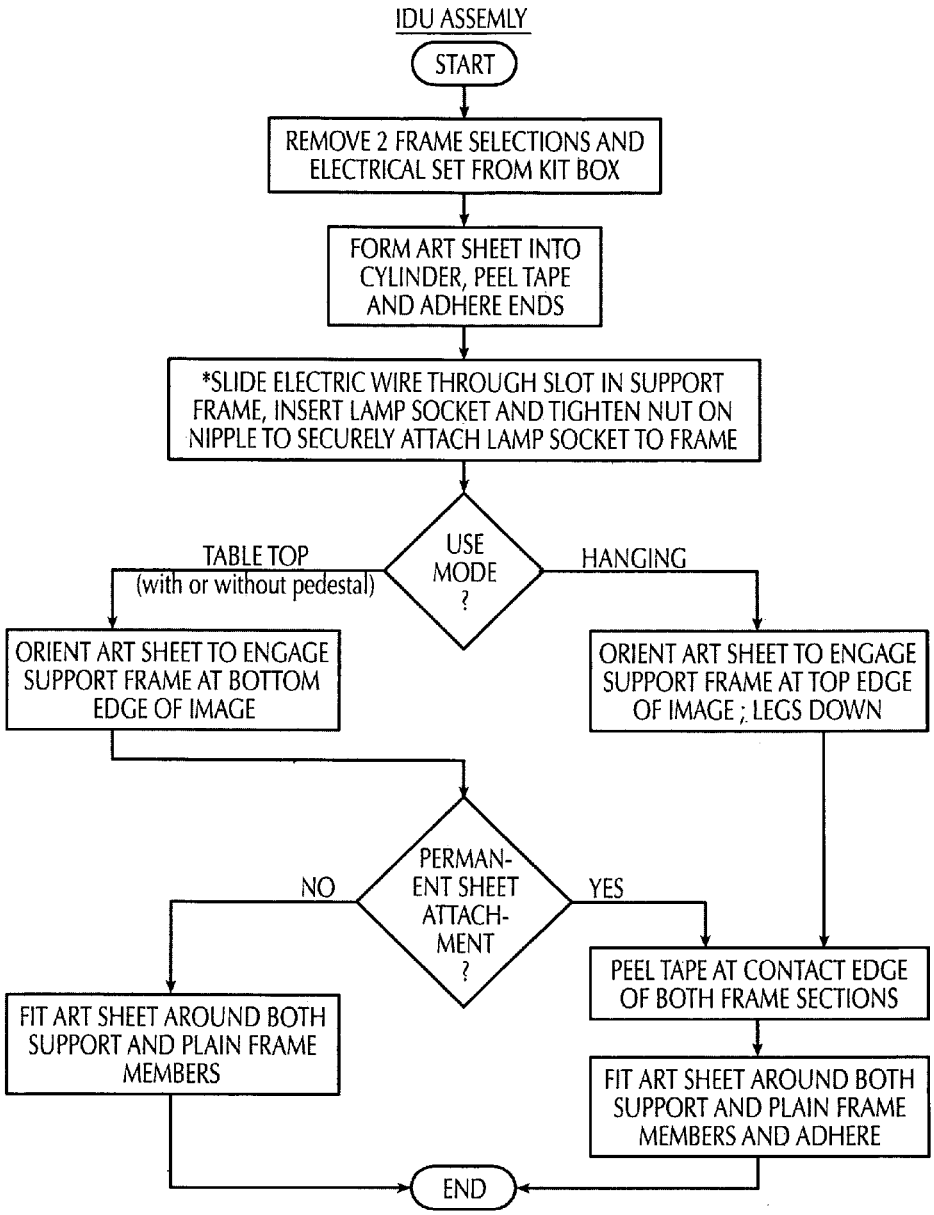
FIG. 8 is a flow chart describing the assembly of an IDU formed with a one piece support frame and a plain frame.

The IDU assembly flow chart of FIG. 8 is largely self-explanatory. Note that the orientation of the art to the support frame is different depending on whether a table top, pedestal or hanging version of IDU 1 is being assembled; this can be easily seen in FIGS. 1 and 2. Although permanent or temporary assembly is an option for a table top unit, the hanging version must be bonded together with the tape around the edge of the frame sections. Temporary assembly of the table top unit permits using the same frame kit serially for a variety of art sheet displays.

Figure 9:
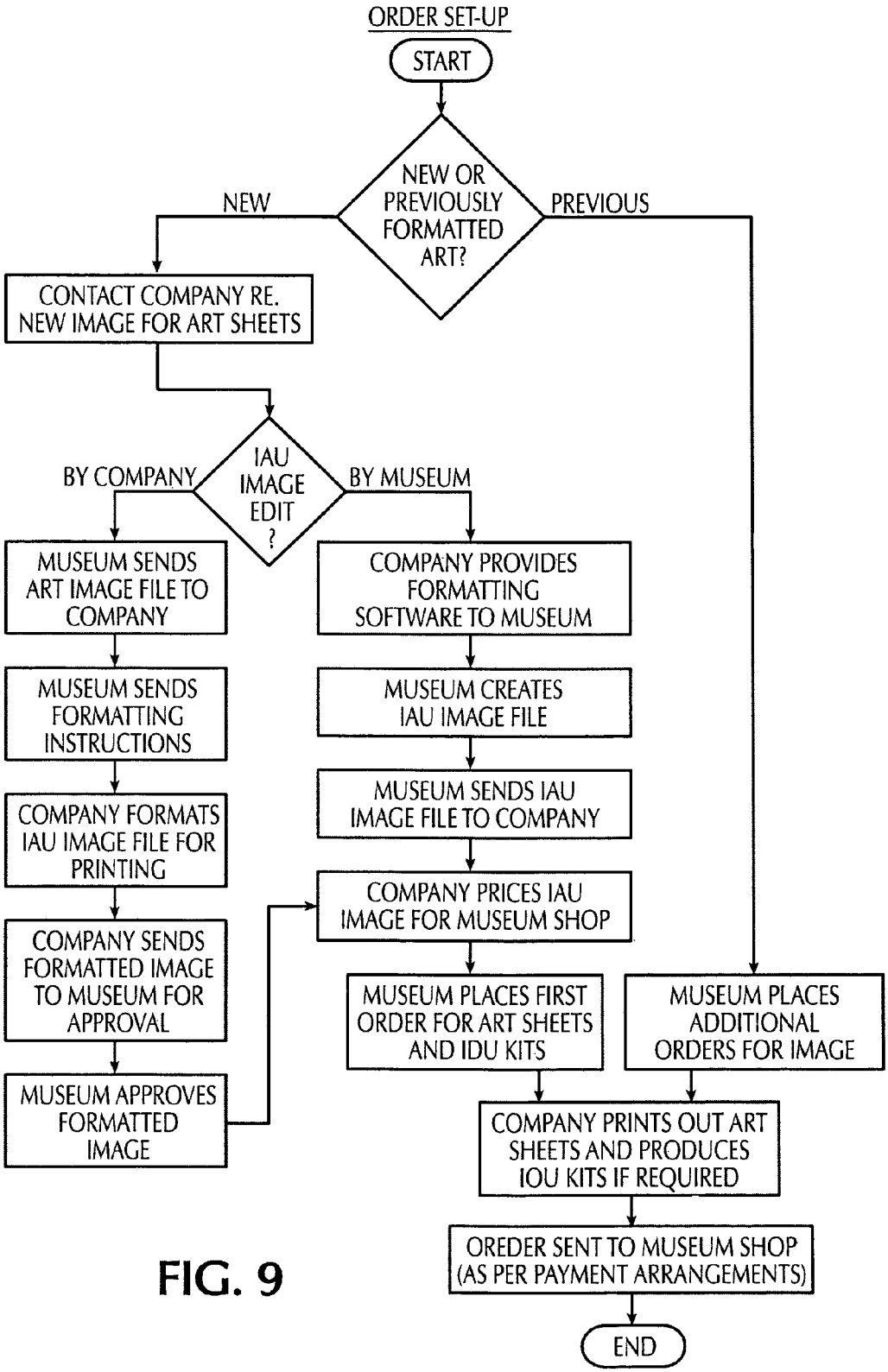
FIG. 9 is a flow chart of the initial order set-up supporting a new museum exhibit.

The process for the initial and subsequent order set-up with a museum gift shop was described in words in the summary section. FIG. 9 shows this process in flow chart form. This shows the optional methods of performing the formatting of the museum Image to create and Image Unit file of formatted digitized images that actually drives the printer to print out image sheets. The accurate pricing of each image sheet can only be performed after this step.

Figure 9A:
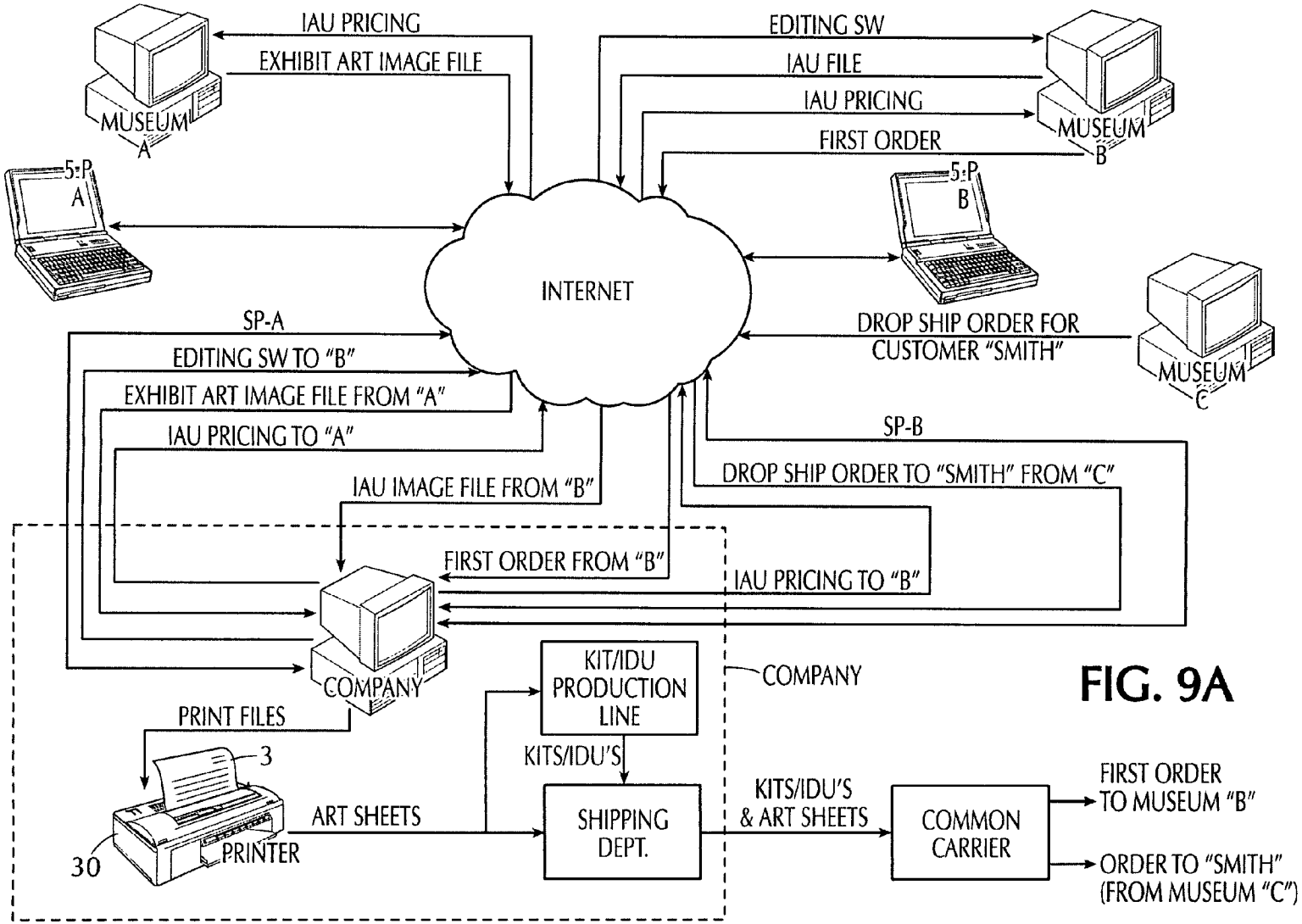
FIG. 9A is a block diagram reflecting the hardware and network entities involved in implementing the flow chart of FIG. 9.

The flow chart of FIG. 9A clearly illustrates the computer hardware and network entities involved in actually implementing the order process. The box labeled "Company" in FIG. 9A includes a computer system including a central processing unit (CPU) or microprocessor facilitating communications enabled by a server through the internet between the company and three different museum gift shops is shown. Museums A and B are involved in initial order set-up, but Museum A lets the company edit their exhibit image file while Museum B edits their, own exhibit image file to an IAU file using software provided by the company. In both cases, IAU pricing is provided by the company. Museum C sends a drop shop order to the company for a customer named "Smith". Both IDU kits as well as fully assembled IDU's with attached image sheets can be shipped out. The company keeps up with the museum interacting with its computer and microprocessor throughout the internet. Field representatives or company sales persons (as represented by "laptops" SP-A and SP-B) can also be used to send in orders resulting from museum gift shop visits or other communications. FIG. 9A also indicates how the company with its computer CPU or microprocessor creates the image sheets on printer 30 and produces kits from an internal production line (as shown). Electric/frame kits and image sheets, or fully assembled IDU's, are shipped by a common carrier to the museum shops or to specific "drop ship" museum customers.

Figure 10:
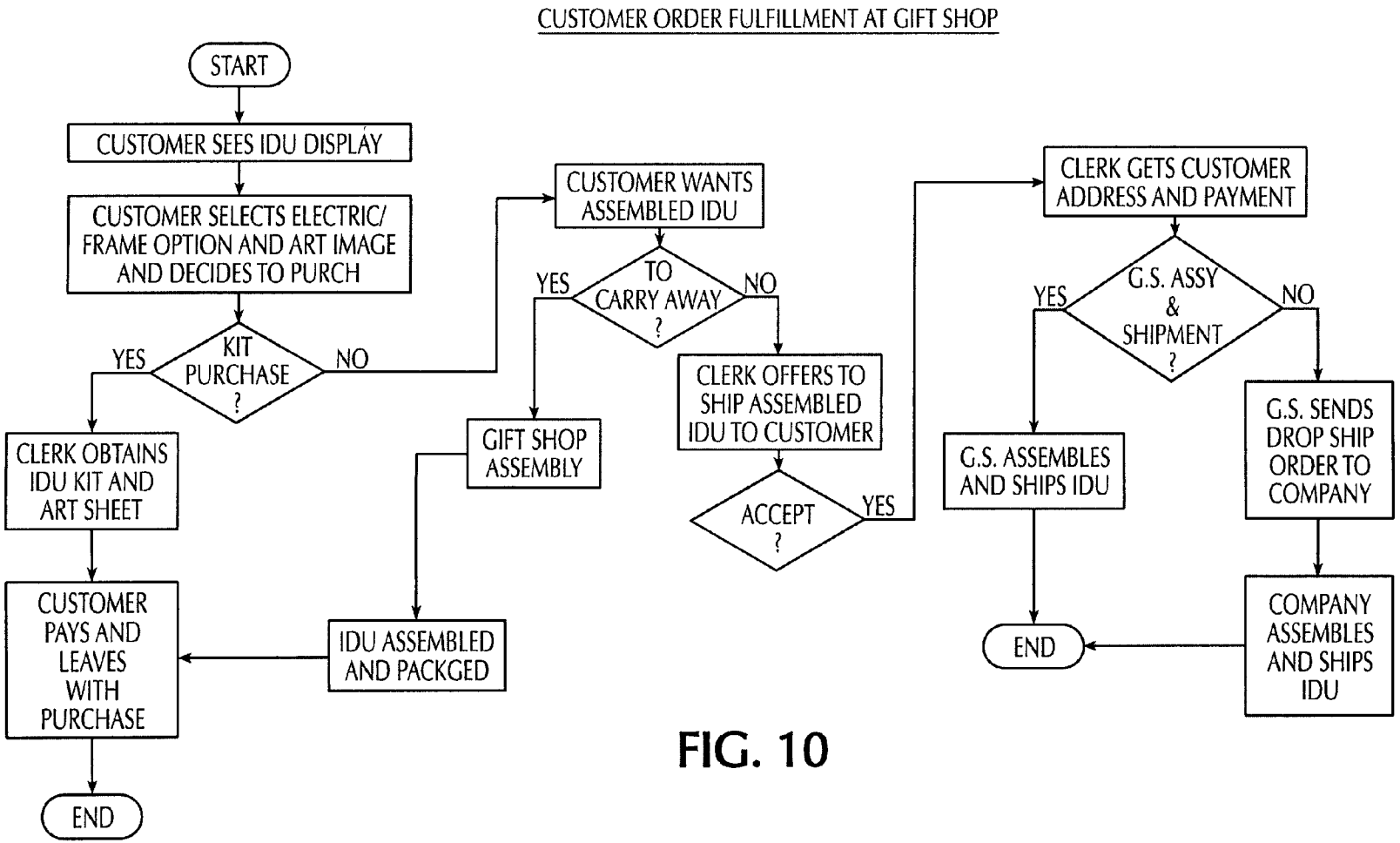
FIG. 10 is a flow chart depicting the various customer fulfillment options at a museum gift shop.

The different customer order fulfillment options discussed above in the summary are detailed in the flow chart of FIG. 10.

Although the main objective of this invention is to create an efficient method of displaying images that may be purchased at a museum shop, many other uses for an IDU unrelated to museums art exist. One is a direct internet to customer marketing method whereby the images (which may, for instance, consist of family or travel snapshots) is provided by the customer for creating an image sheet. Another possibility is advertising use of IDU's such as displays promoting a certain brand of beer at a tavern. Another is images depicting local tourist attractions for sale in souvenir shops. The oval format described may not be optimal for all applications. It is possible to use the identical manufacturing steps to create IDU's of any annular crossection by using frames that have alternate peripheral shapes.

While intended use is to illuminate the translucent image sheet, under ambient light the image sheet still displays the image thereon.

Figure 11:
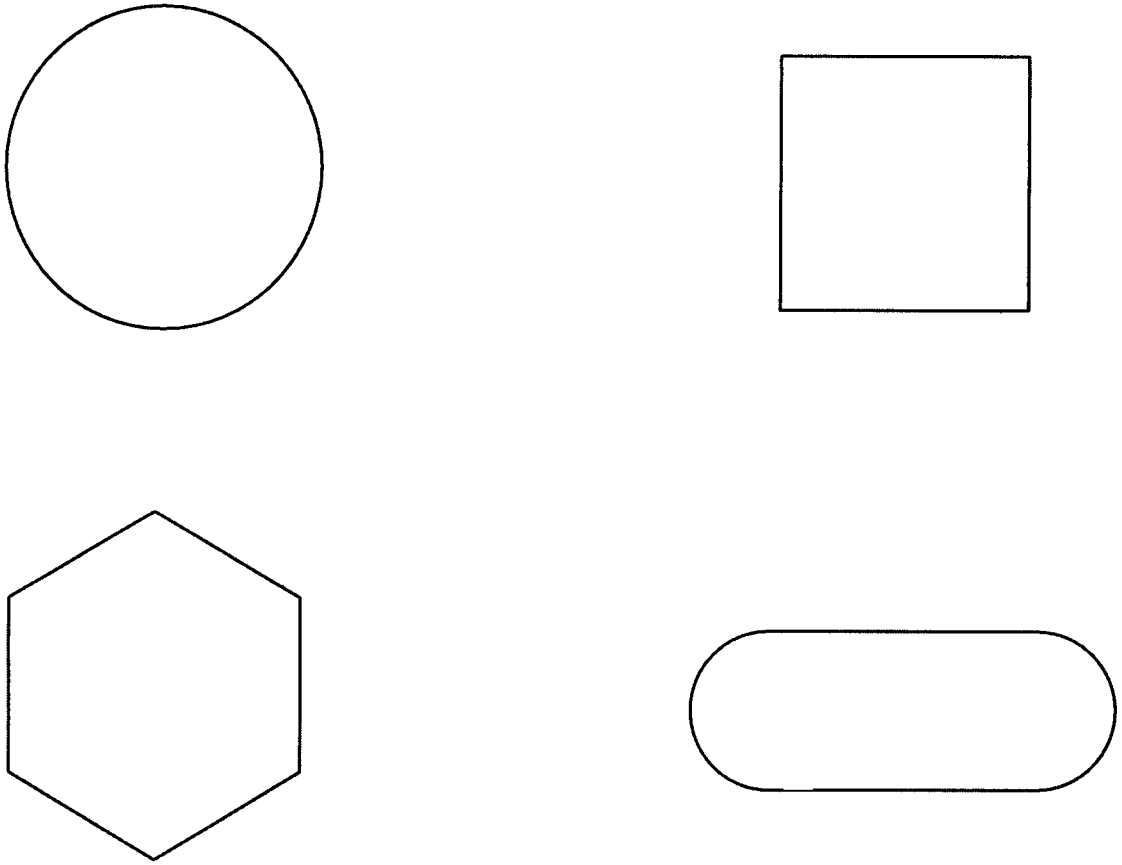
FIG. 11 is a schematic top view of four different designs of IDU shapes each in which will have the same circumference for use with the same width image sheet.

FIG. 11 schematically shows four examples of alternative top outline views of an IDU. They are drawn at the same scale to show the relative feature size for a constant circumference. The circle and extended circle shapes would be easily produced, while the sharp corners of the square and hexagonal shapes would be somewhat rounded in practice to prevent creasing of the image sheet and is applicable to any shaped polygon, such as hexagonal or pentagonal, etc.

Figure 12:
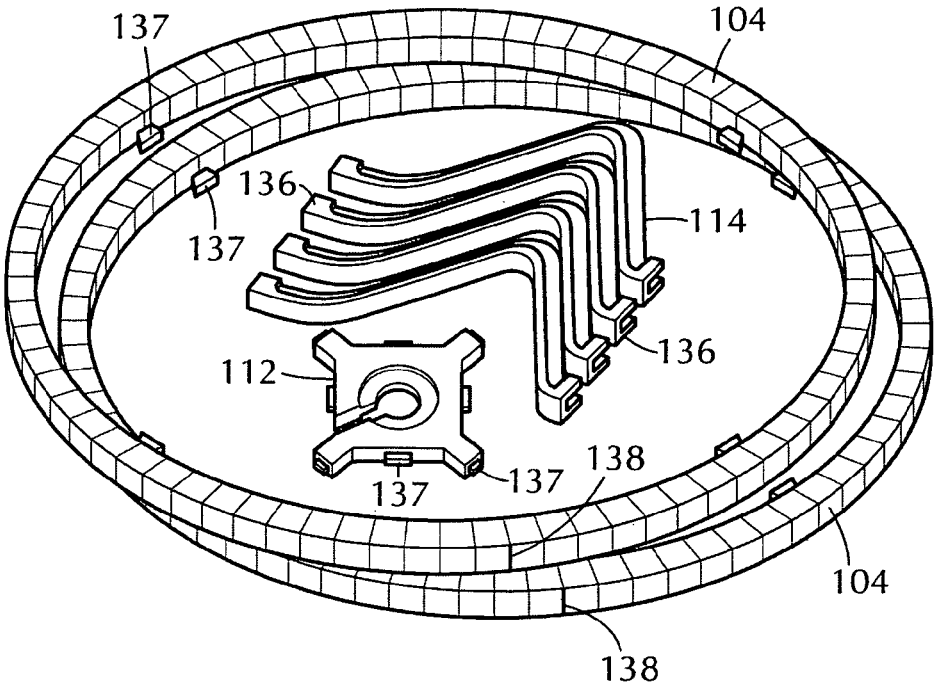
FIG. 12 is a perspective view of the separate parts of a frame kit of one type of alternate embodiment, in this case with four legs and a hub with two sets of four attachment lugs to accommodate frames with two different radii, such as, for example, an ellipse as compared to a circular rim frame. In this case, either of the rim frames may be used for the support frame since both incorporate attachment lugs.

The parts comprising a frame kit of an illuminated display unit (IDU) of an alternate embodiment are shown in FIG. 12. Two plain frames 104 with image sheet alignment marks on the outside 138, and leg attachments lugs 137 in the inside, a plurality of legs, such as, for example, four legs 114, with a coupling at each end, such as, for example, four legs 114, with a coupling at each end, such as, for example, a tapered dovetail coupling slot feature 136 at each end, and a lamp socket support hub 112 are included. For this example cooperative couplings, such as, for example, protruding lugs 137, are located on the inside of each plain frame 104 and on the outer surfaces of socket support hub 112, and the lugs 137 fit into the couplings in this example tapered slots at the leg ends 136. It is further noted that other configurations for the hub may be pro tided, so long as it is capable of holding the light source within the confines of the formed images sheet held in place by the support frame and the plain frame, wherein further the hub is connected to the support frame by a plurality of legs or spokes.

Figure 13:
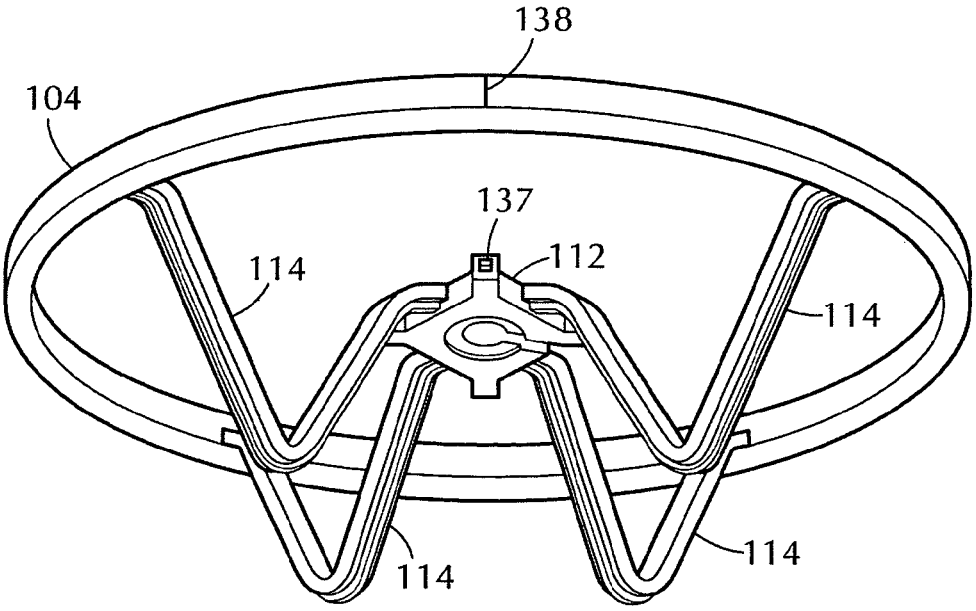
FIG. 13 is a perspective view of an assembled support frame using parts from the frame kit of FIG. 12.

FIG. 13 shows such an assembled support frame with the legs 114 down. Note that the inner lugs 137 on hub 112 are used; a different shape or circumferential size of frame may require the use of the outer lugs 137 on hub 112.

Figure 14:
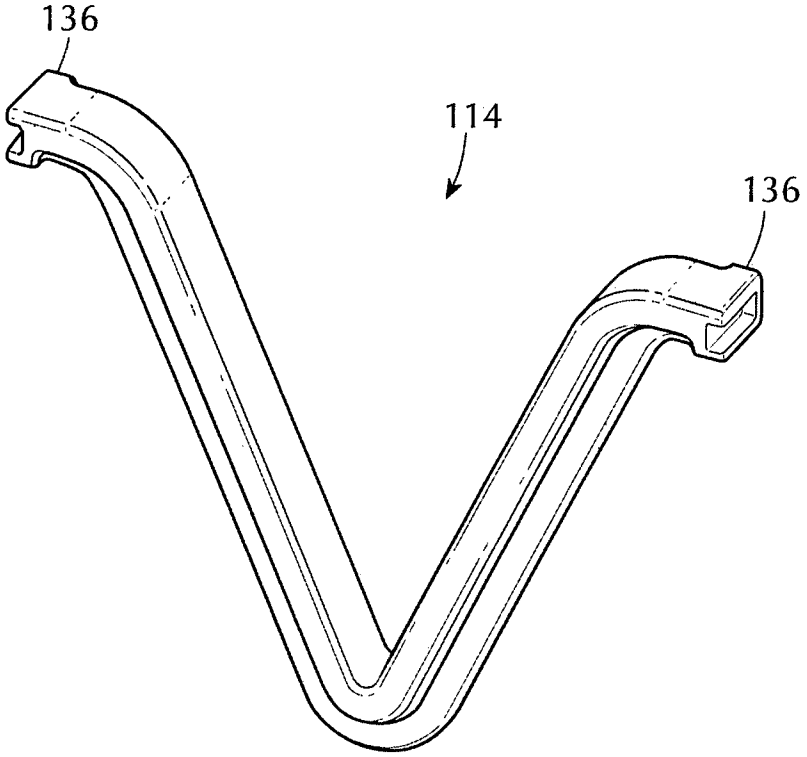
FIG. 14 is a perspective view of a single leg from the frame kit using parts from the frame kit of FIG. 12.

FIG. 14 provides a clear view of a single, preferably V-shaped leg 114 with preferably slotted leg ends 136. In this case the V is asymmetrical.

Figure 16:
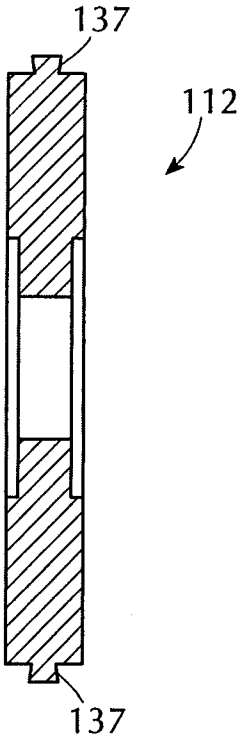
FIG. 16 is a crossectional view of the support hub of FIG. 15, when viewed along crossectional line "16-16" of FIG. 15 using parts from the frame kit of FIG. 12.
Figure 15:
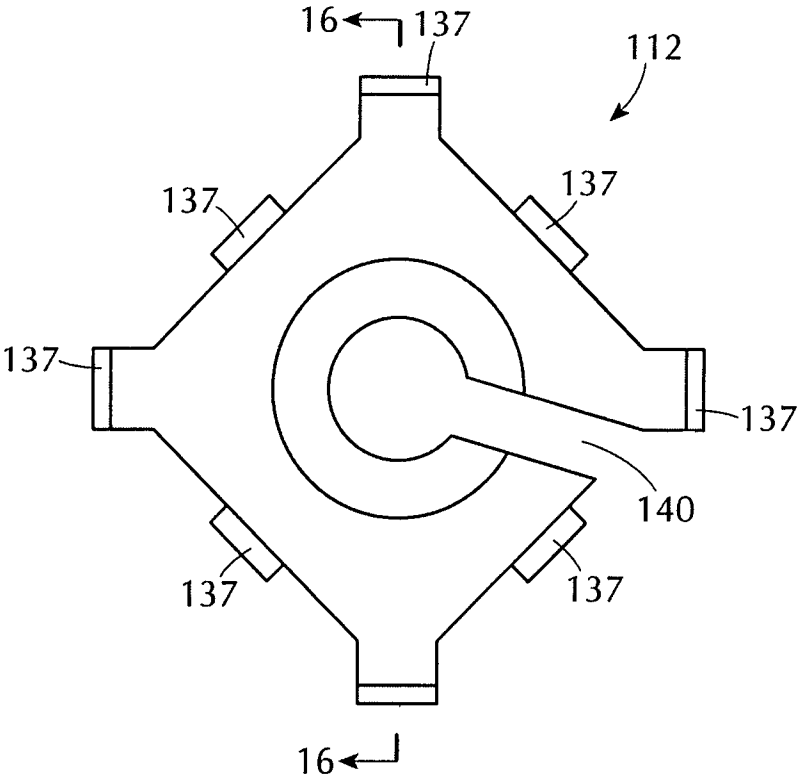
FIG. 15 is a top plan view of the socket support hub of this alternate embodiment, using parts from the frame kit of FIG. 12.

FIGS. 15 and 16 show details of lamp socket support hub 112 including lugs 137 and electrical wire access slot 140. That is one of the parts illustrated in FIG. 12.

Figure 17:
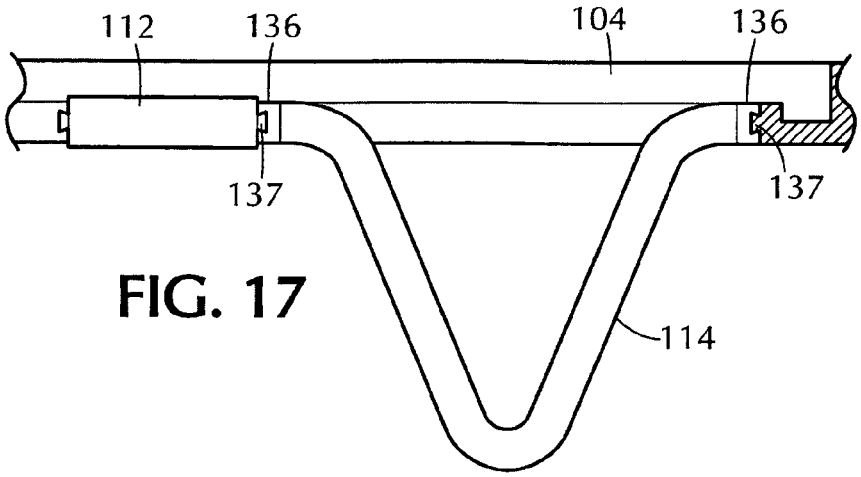
FIG. 17 is a side view in partial crossectional showing the attachment of a leg with a frame on one end and the socket support hub at the opposite end using parts from the frame kit of FIG. 12.
Figure 18:
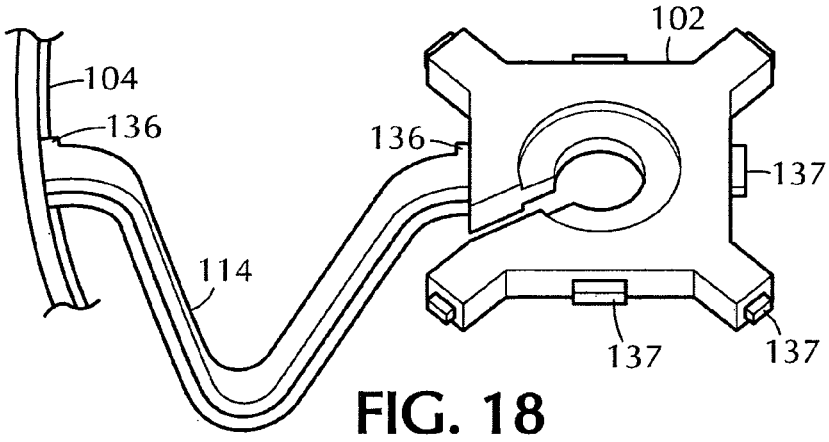
FIG. 18 is a perspective view of the parts of FIG. 17 from another viewpoint using parts from the frame kit of FIG. 12.
Figure 19:
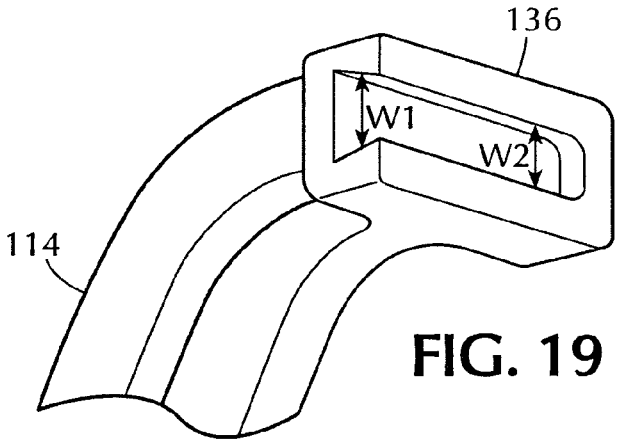
FIG. 19 is a perspective close-up detail view of a leg-end, showing the tapered dovetail attachment slot.

FIGS. 17-19 show details of an attachment system for the parts illustrated in FIG. 12 for the couplings associated with legs 114. For example, FIG. 17 is a side view showing the fit of couplings such as lugs 137 within cooperative couplings, such as tapered slots, in ends 136. FIG. 18 is a perspective view showing a similar attachment. FIG. 19 shows an enlarged leg end 136. The tapered dovetail slot (note width "w1" greater than width "w2") is shown clearly. Tapered dovetail lugs 137 are sized so that they will engage the inner walls of the slot in 136 at the mid slot position to lock the two members together.

Figure 20:
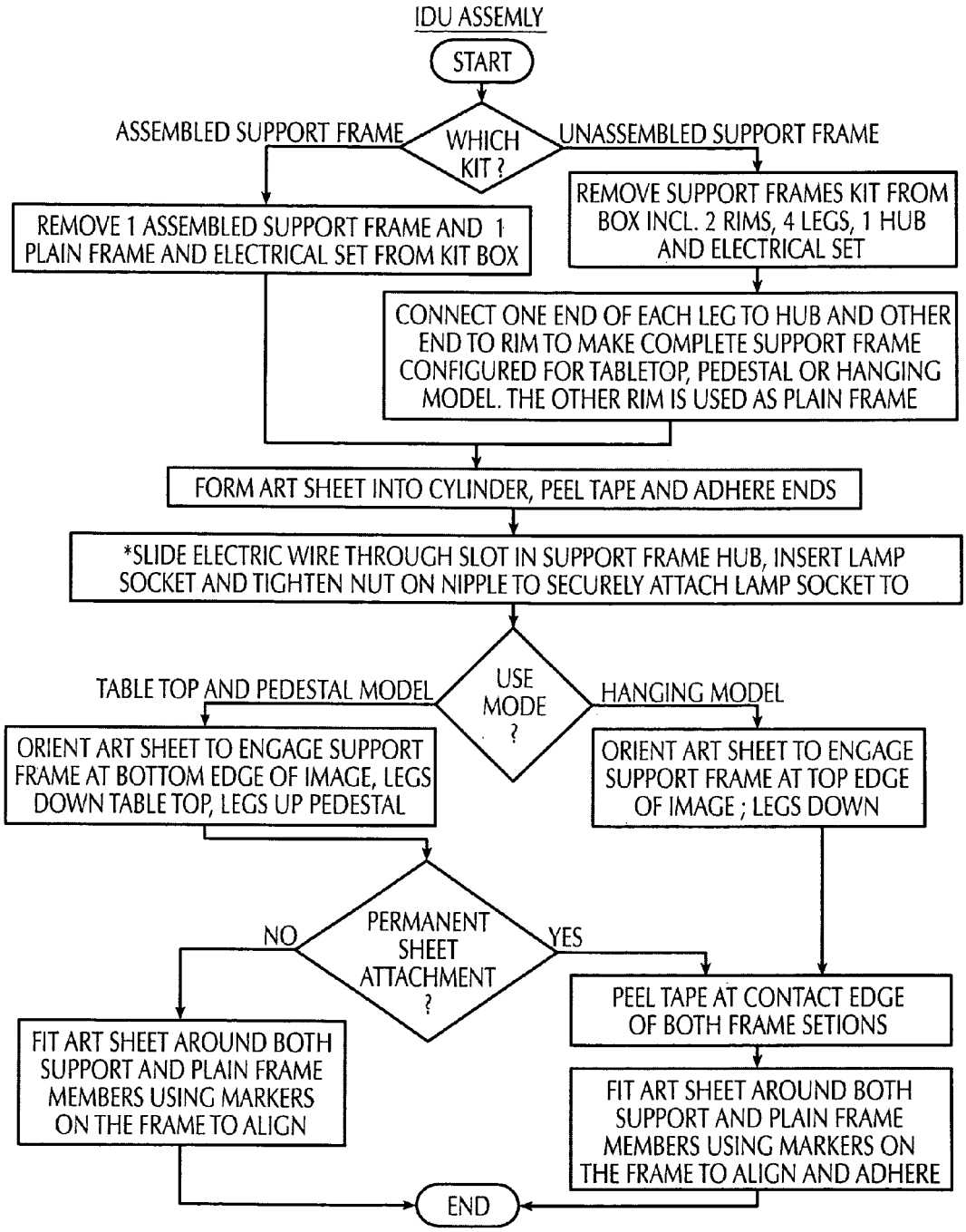
FIG. 20 is a flow chart of the assembly of an illuminated display unit (IDU), including alternate embodiments with a multi-part support rim/frame with a plurality of attachable legs.

The flow chart of IDU assembly of FIG. 20 contrasts the assembly of the previous embodiment with the one-piece molded support frame shown in FIGS. 1-11 with that of the unassembled frame kit of the alternate embodiment of FIGS. 12-26. The entire difference in procedure involves the removal of the kit parts from the box and the assembly of the support frame by connecting each leg to the rim of a plain frame and to the lamp socket support while being aware of the desired configuration. From there on, the procedure is substantially identical to that of the previous embodiment, including the production of FIG. 7 as well as the assembly and organizational computerized flow charts of FIGS. 9, 9A and 10 and the schematic view of possible shapes shown in FIG. 11.

Figure 22:
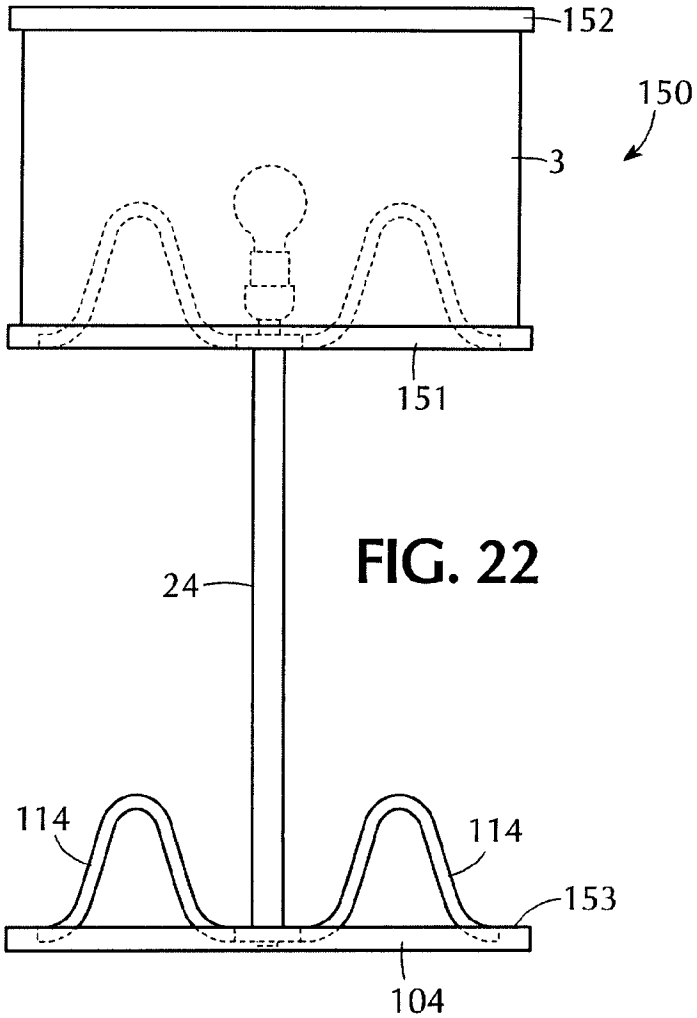
FIG. 22 is a side elevation of a pedestal supported illuminated display unit (IDU) with legs pointing upward and positioned between support and plain frame.
Figure 21:
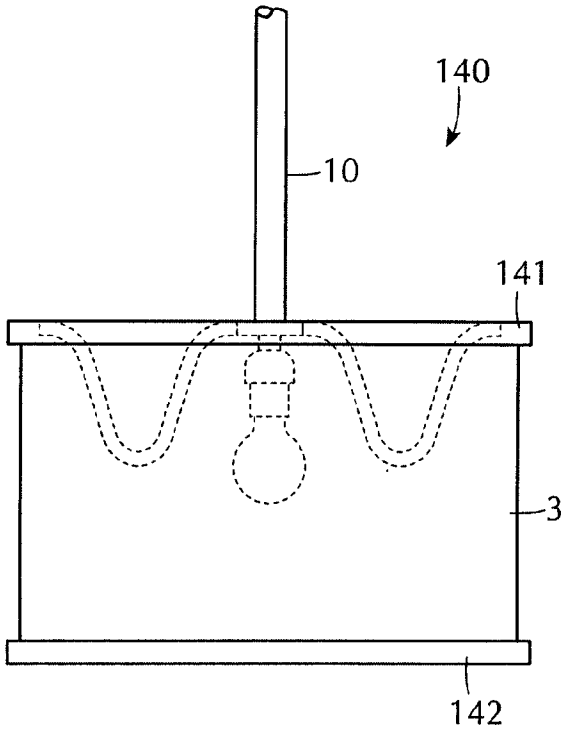
FIG. 21 is a side elevation of a hanging illuminated display unit (IDU) with legs pointing down and positioned between support and plain frame.

FIGS. 21 and 22 illustrate illuminated display unit (IDU) configurations that are not possible with the original one-piece molded support frame. A tabletop configuration using the support frame kit of this embodiment would be configured as in the original embodiment (support frame faces up with legs down); in fact FIG. 2 from the original embodiment is a good representation of it.

In FIG. 21, hanging illuminated display unit (IDU) 140 is configured such that support frame 141 is assembled with the support groove for image sheet 3 on member 104 facing down, as are legs 114. Plain frame 141 is simply a member 104 with the groove for image sheet 3 facing upward. Note that legs 114 now reside between support frame 141 and plain frame 142. This orientation is not possible with the original one-piece support frame which included the legs pointing in the opposite direction. Legs, socket support hub and lamp are shown in dashed lines as obscured by image sheet 3.

FIG. 22 illustrates a pedestal lamp 150 where support frame 151 is assembled from a member 104 facing upward and legs 114 also pointing upward. Plain frame 152 is a member 104 facing downward. Again here it can be observed that legs are positioned between plain and support frames (see dashed lines). Base 153 is assembled from a member 104 facing down and legs 114 facing up with a socket support hub in the center. Alternatively, a modified base 136 can be used (as shown in FIG. 6D).

Figure 23:
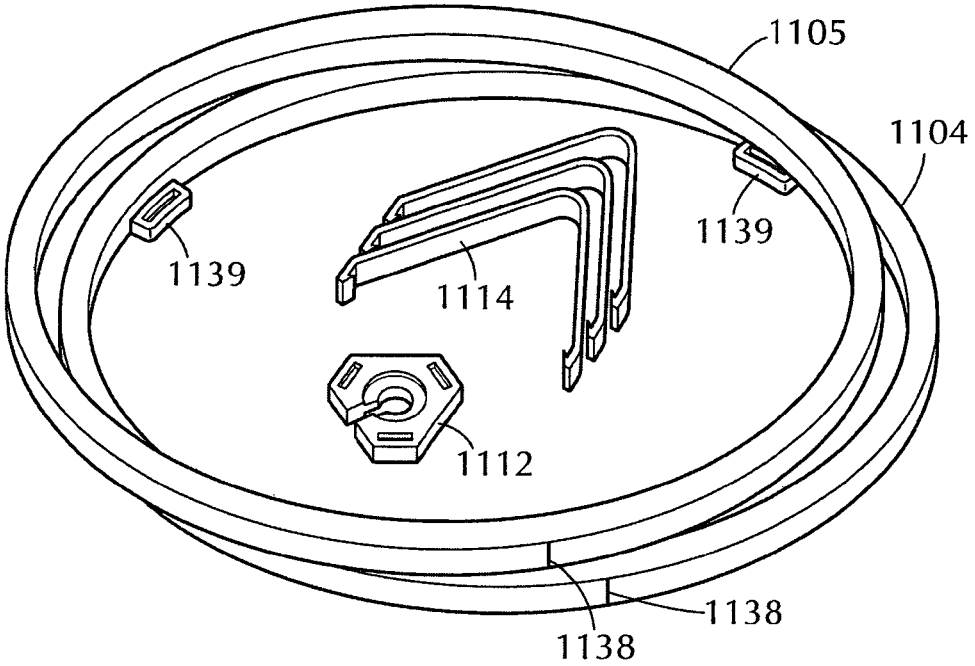
FIG. 23 is a perspective view of the separate parts of a further alternative frame kit with three legs.
Figure 27:
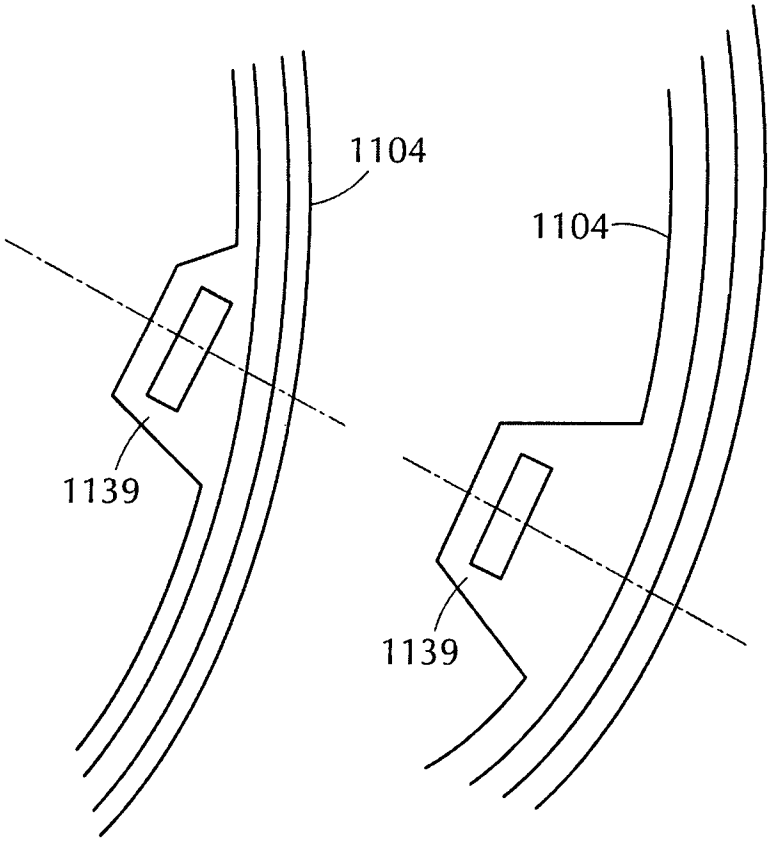
FIG. 27 is a top plan view of the leg attachment slot on two alternative frame shapes for this embodiment.

In yet, another embodiment shown in FIGS. 23 and 27, there are preferably three legs 1114 provided, and the attachment system of the legs 1114 to the hub 1104 and to the rim frame 1104 is changed to a tongue and slot system.

FIG. 23 shows the parts comprising of a frame kit of an illuminated display unit, (IDU) of this alternate embodiment. This embodiment includes one frame 1105 which does not have any provision for attachment of legs 1114 and another frame 1104 with such attachment provisions. The kit constitutes the two frames with sheet align marks on the outside 1138 and leg attachment slots 1139 on the inside, three legs 1114 with a coupling tongue at each end and a lamp socket support hub 1112 with slots for leg attachment of leg 1114.

Figure 23A:
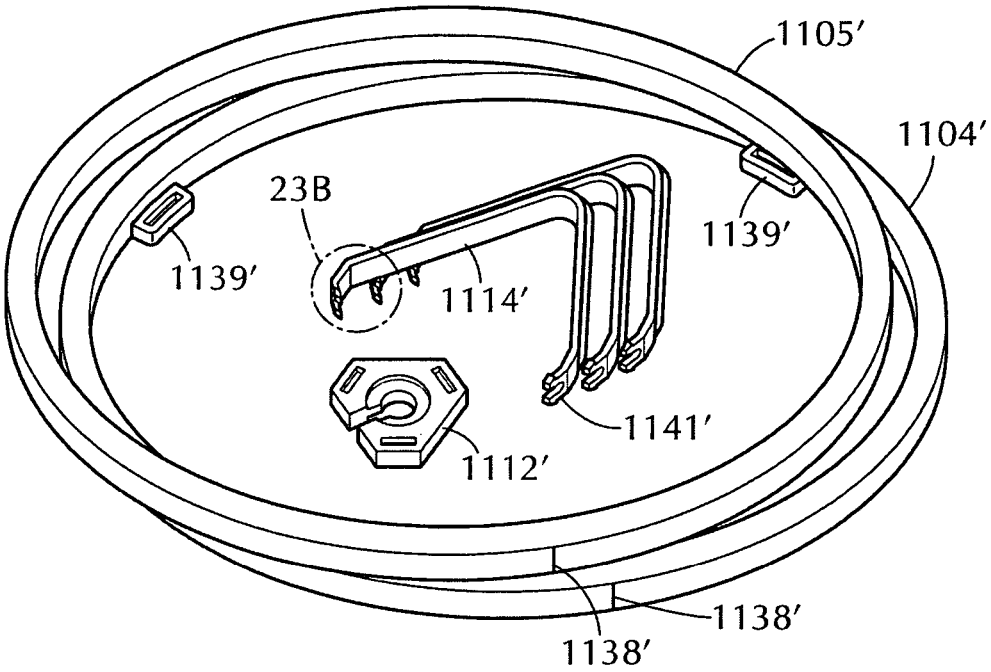
FIG. 23A is a perspective view of the separate parts of another further alternative frame kit with an equivalent set of three legs with an alternate end coupling.

FIG. 23A shows the parts comprising of a frame kit of an illuminated display unit (IDU) of a further alternative embodiment with equivalent component coupling parts. This embodiment includes one frame 1105' which does not have any provision for attachment of legs 1114' and another frame 1104" with such attachment provisions. The kit constitutes the two frames with sheet align marks on the outside 1138' and leg attachments slots 1139' on the inside three legs 1114' with a coupling tongue at each end and a lamp socket support disc 1112' with slots for leg attachment of leg 1114'.

Figure 23B:
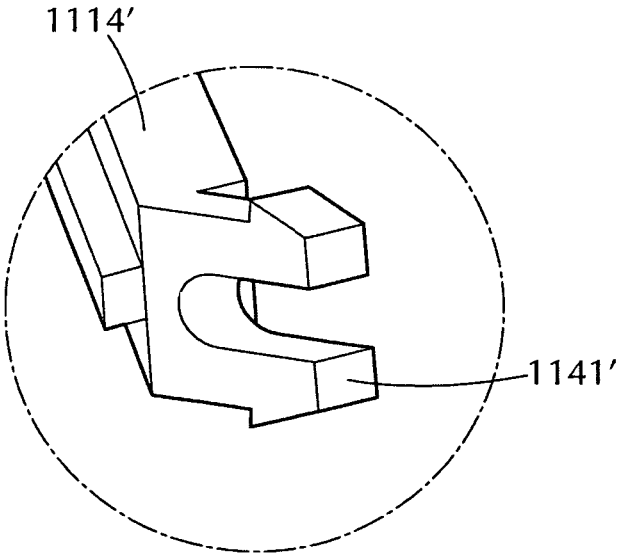
FIG. 23B is a perspective close-up detail view of the end coupling of one of the equivalent fame legs of FIG. 23A, as viewed within dashed circle line "23B" of FIG. 23A.

FIG. 23B shows the end coupling of one of the equivalent frame legs 1114' of FIG. 23A, as viewed within dashed circle line "23B" of FIG. 23A.

Figure 24:
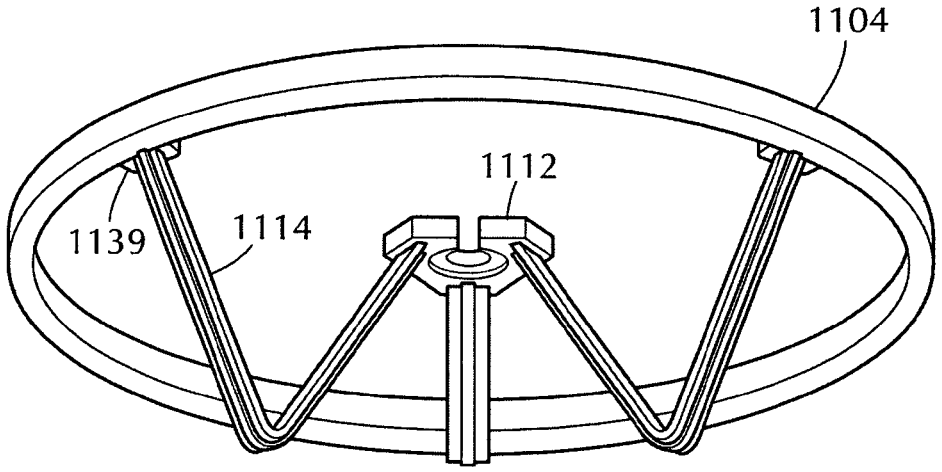
FIG. 24 is a perspective view of an assembled support frame using parts from the frame kit of FIG. 23 or 23A.
Figure 24A:
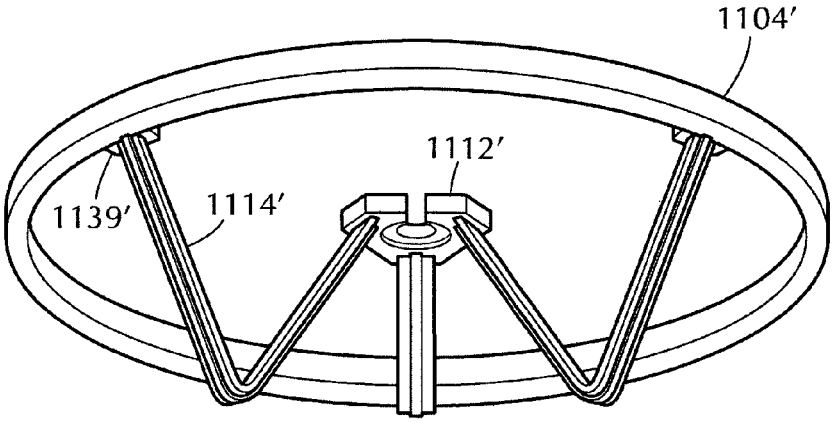

FIGS. 24 and 24A shows the assembled support frame 1104 with legs 1114 and lamp socket support hub 1112 attached.

Figure 25A:
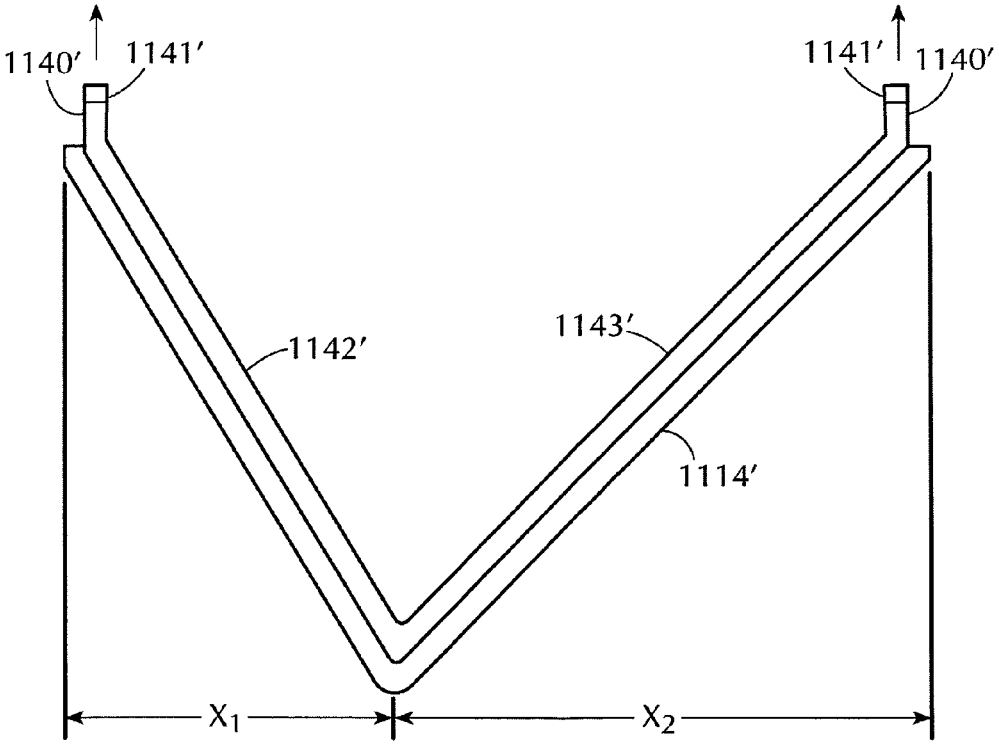
FIG. 25A depicts a leg using the alternate system of attachment of FIG. 23A.
Figure 25:
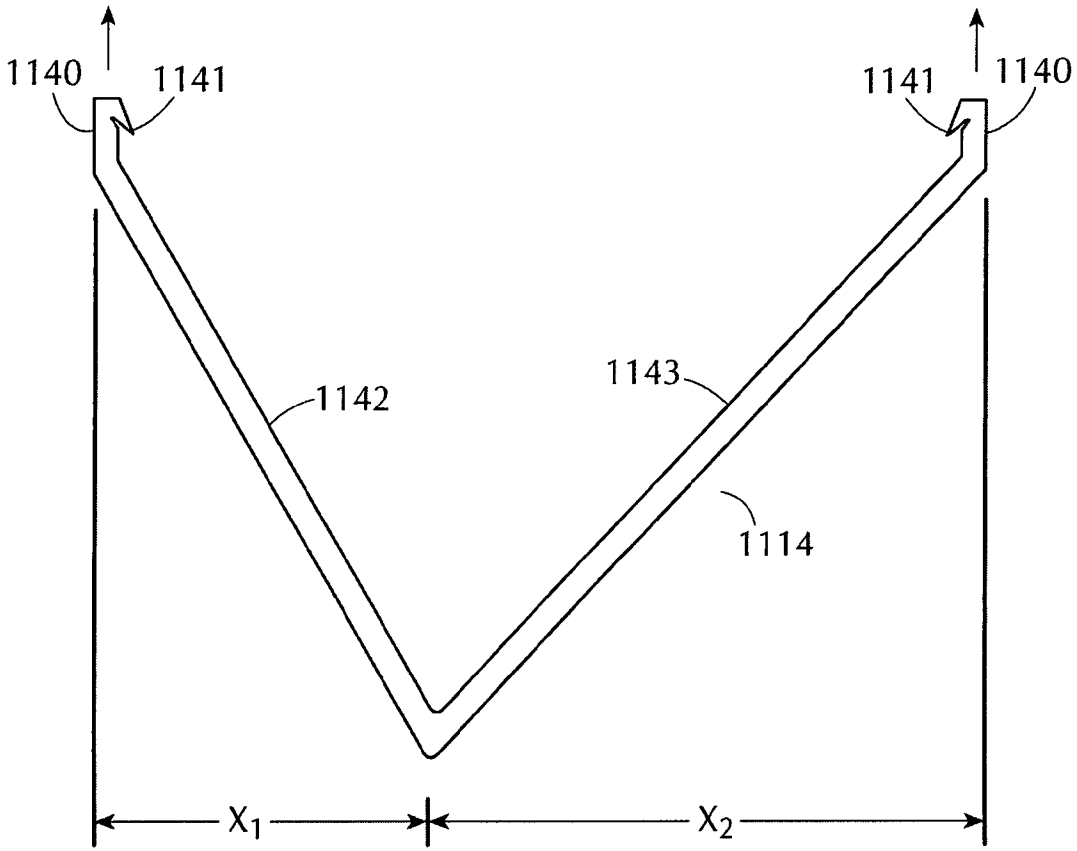
FIG. 25 depicts a leg using the system or attachment of FIG. 23 and configured in an asymmetrical V.

FIGS. 25 and 25A shows one of the legs 1114 of FIG. 23 and FIG. 23A respectively. The leg is an asymmetrical "V-shape" to enable the support of the unit to be spread farther apart and the system for attachment for the leg 1114 to the lamp support hub 1112 and to the frame 1104. The attachment details are shown clearly in this figure. Each leg 1114 has two attachment extensions 1140 at an angle to the angled leg portions 1142 and 1143 of each leg 1114. Extensions 1140 are angled vertically for insertion into and through slots or holes, such as for example, rectangular holes/slots 1139 in support frame 1104 and lamp support hub 1112. As the extensions 1140 are pushed in toward the step region, molded cantilevered tongues 1141 are compressed until they again snap out locking extensions in slots or holes, such as for example, rectangular slots/holes 1139. The "V" shape of legs 1114 is preferably asymmetric to place the vertex closer to the rim (X1) than to the lamp support hub 1112 at the center (X2) affording better stability. Tongue 1140 has a cantilevered tip which is spring loaded, so that it compresses as tongue 1140 is inserted into leg attachment slot/hole 1139 and decompresses outward when through the slot/hole 1139, thereby locking leg 1114 in place in respective slots/holes 1139 in frame 1104 at one end and in lamp support hub 1112 at the other end.

Figure 26:
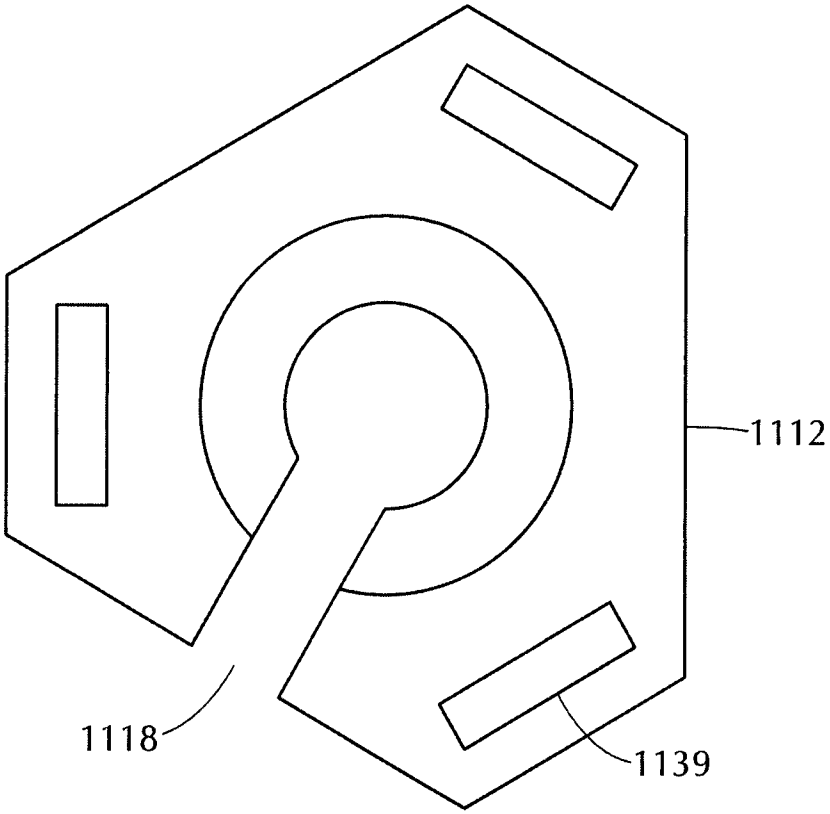
FIG. 26 is a top plan view of a socket support hub of the embodiment in FIG. 23 or 23A.

FIG. 26 shows details of the lamp socket support hub 1112 including leg attachment slots/holes 1139 for legs of FIG. 23 or FIG. 23A and electrical wire access slot 1118.

FIG. 27 shows examples of the leg attachment slots 1139 configured for a circular rim frame 1104 and an elliptical rim frame 1104. The slot on the circular rim frame 1104 is positioned a distance inside the rim frame 1104 to illustrate provisions to accommodate a leg of one size to fit frames with a different radial difference from the hub lamp support hub 1112 to the rim/frame 1104.

In a further alternate embodiment, the frame of the illuminate display unit (IDU is comprised of multiple component parts, and the image sheet may be printed on a coated art paper designed for inkjet printing. The image sheet is retained in a non-permanent method using frame inserts in the support and plain frame members.

Figure 28:
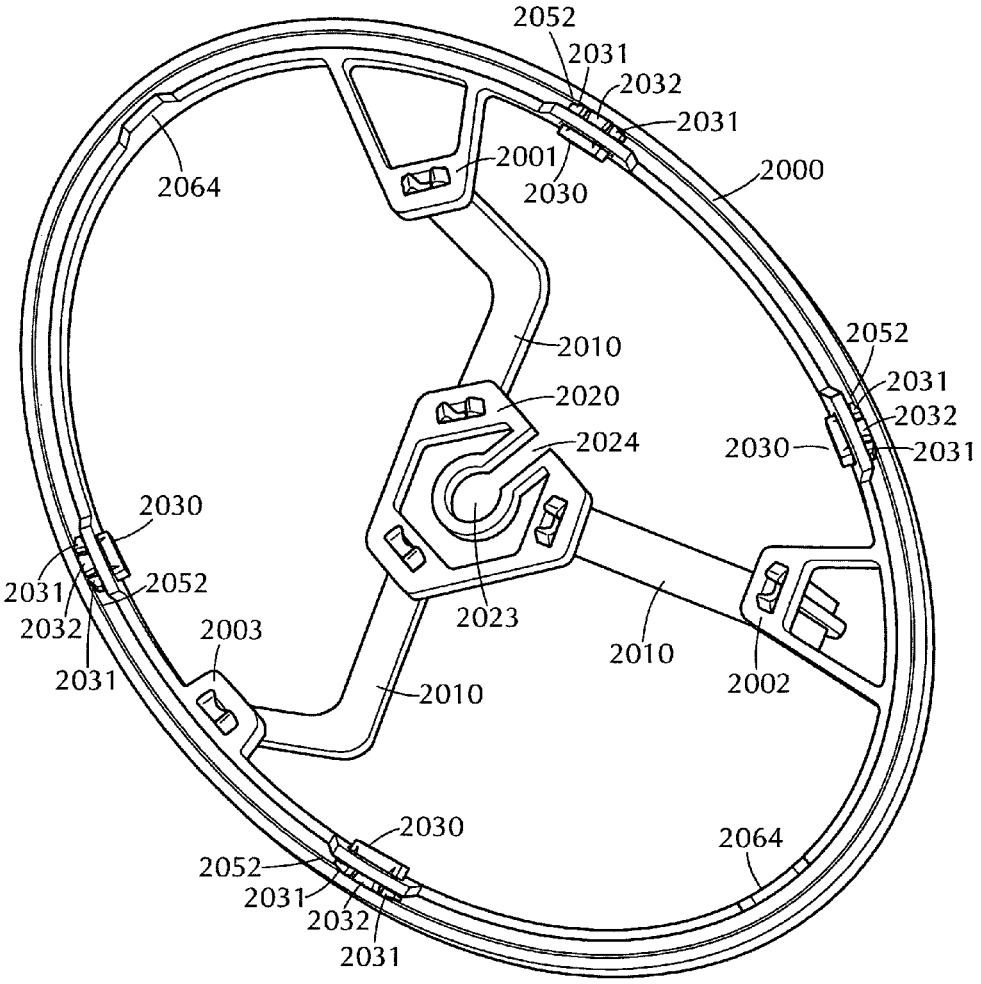
FIG. 28 is a perspective view of one of the support frame with projections with slots for the attachment of legs and triangular socket support hub of a further embodiment of an IDU of this invention.

FIG. 28 shows an assembled support frame of this embodiment 2000 having integrally molded attachments 2001, 2002, and 2003 with slots (marked X) at each respective slot attachment to accept one end (marked X) at one end of each respective leg member for insertion of three identical leg members 2010. The distal end (marked O) of each of the legs is inserted into a rectangular slot (marked O) of each respective slot of the central hub 2020 in the triangular socket support hub 2020 which completes the assembly. Note that the three leg attachments (2001, 2002, and 2003) are asymmetric but the locations of their attachment points around an oval rim 2000 conspire to place triangular hub 2020 in the center. Hub 2020 will accept attachment of a lamp socket with a threaded nipple at hole 2023 and permit entry of electrical cord through slot 2024. Integral molded horizontal rim slots 2004 are used for the frame inserts retaining the image sheet. The rim slots 2004 are located within lugs projecting above the inner rim of the support frame 2000, which, together with the lugs 2064, also projecting above the inner rim of the support frame 2000 and located at both ends of the major axis of the frame 2000, facilitate the insertion of the image sheet 2052 into the circumferential rim slots within support frame 2000 and plain frame 2040.

Figure 29:
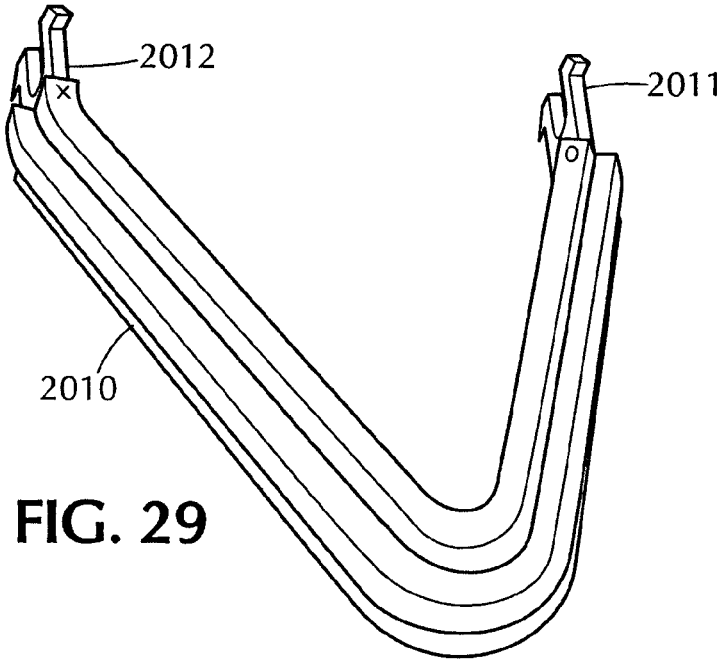
FIG. 29 is a perspective view of one of three identical legs of the further alternate embodiment.

FIG. 29 shows one of three legs 2010 with frame engaging end 2011 (marked X) and hub engaging end 2012 (marked O).

Figure 30:
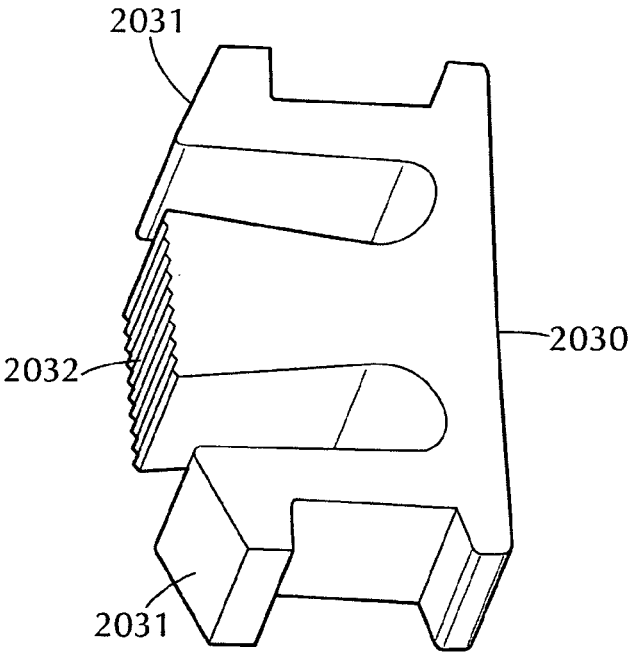
FIG. 30 is a perspective view of the basic design of a frame insert of this embodiment.
Figure 31:
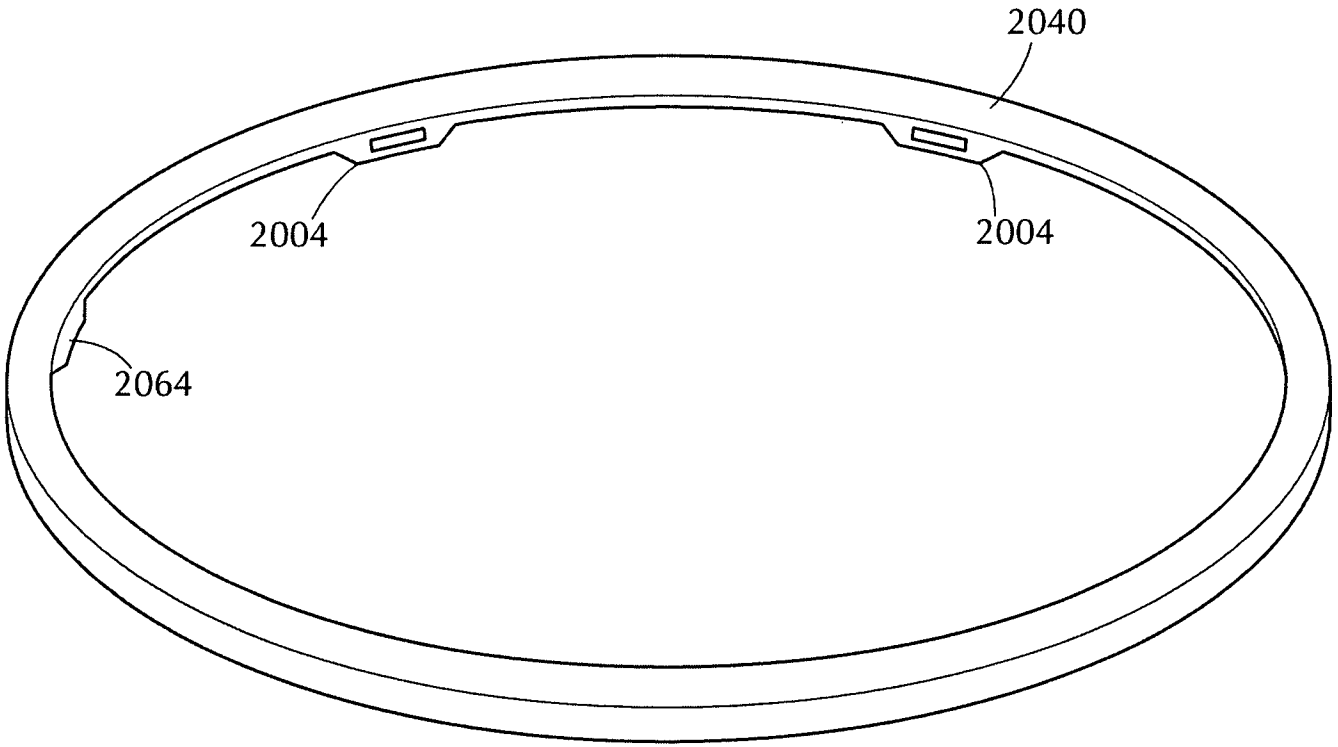
FIG. 31 is a perspective view of the plain frame rim of this embodiment with slots for inserts but without projections for leg attachment.
Figure 32:
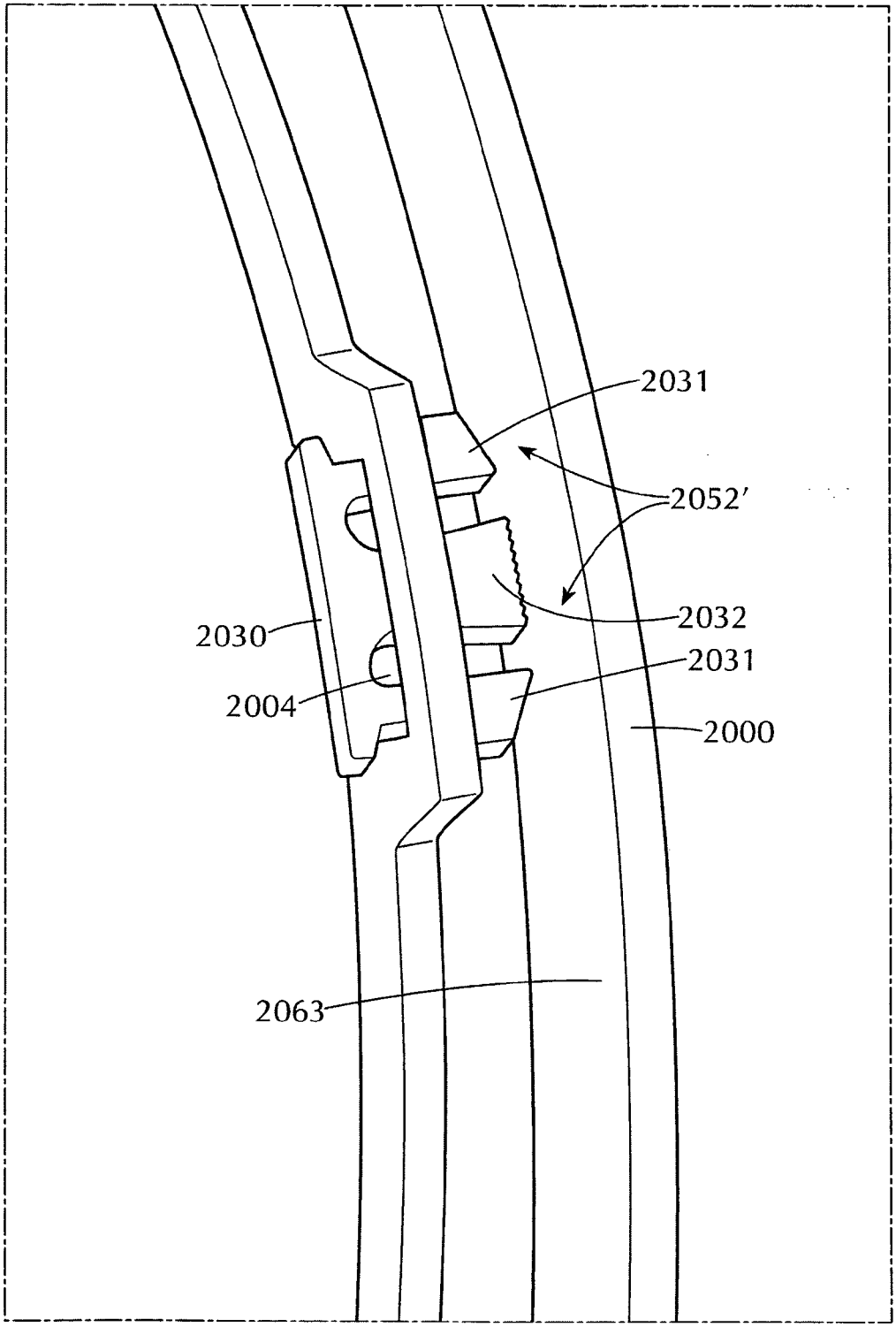
FIG. 32 is a perspective detail showing a frame insert FIG. 30 inserted into one of four horizontal slots in a frame member.
Figure 33A:
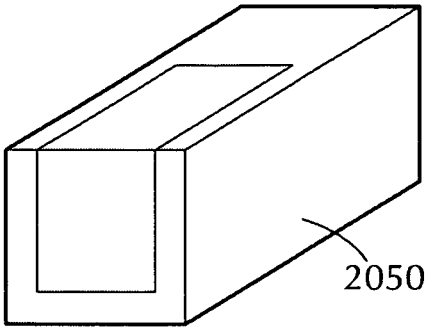
Figure 33B:
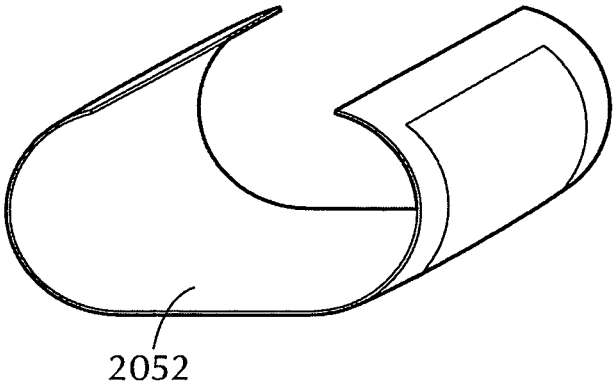
Figure 33C:
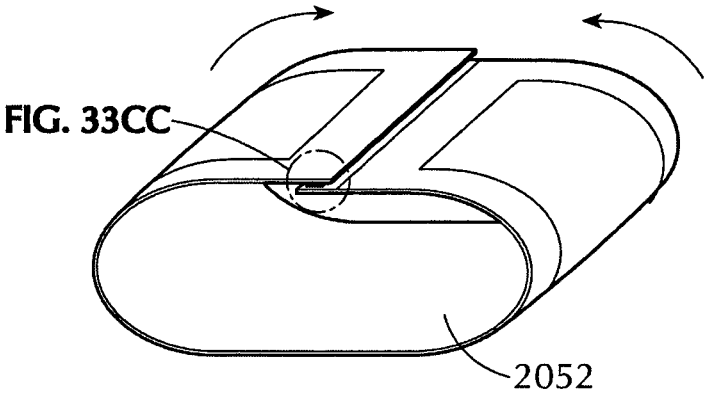
Figure 33C:
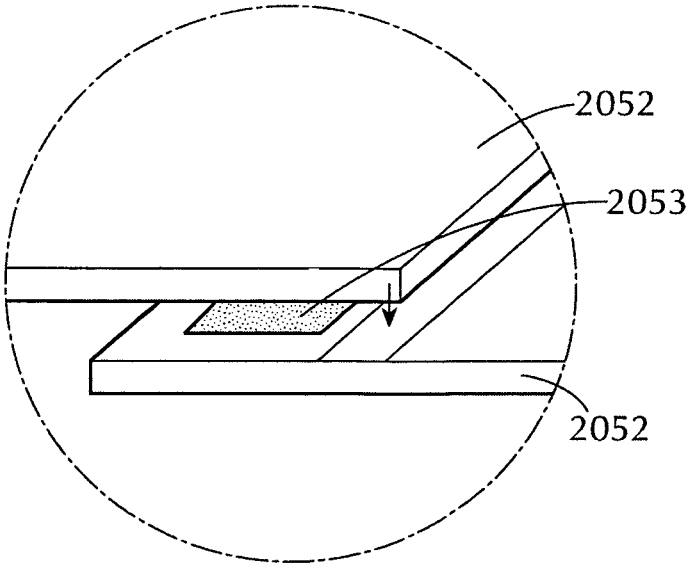
Figure 33D:
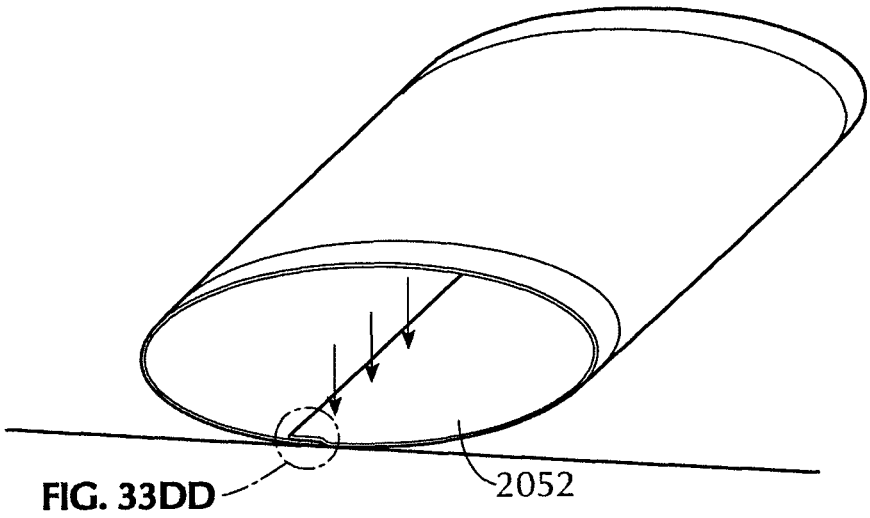
Figure 33D:
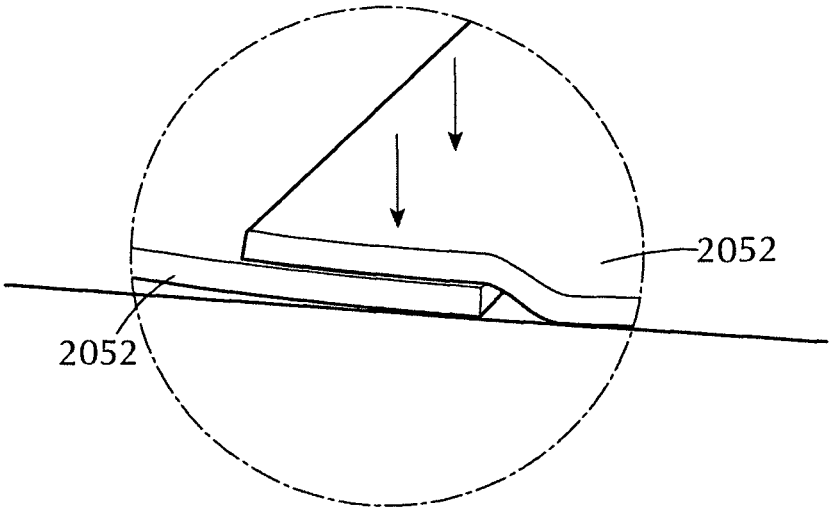
Figure 33E:
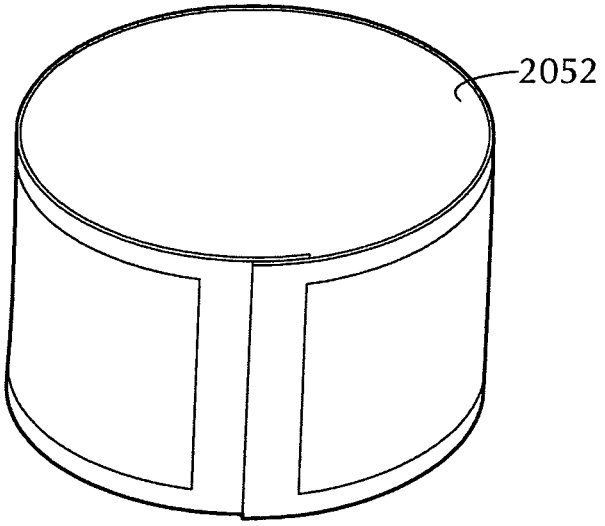
Figure 34A:
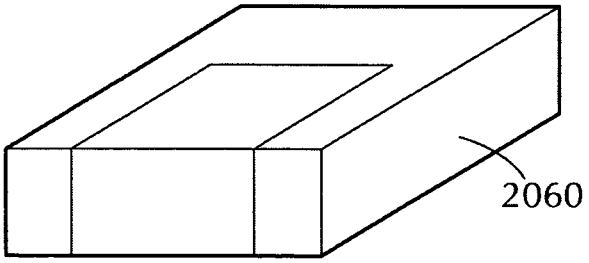
Figure 34B:
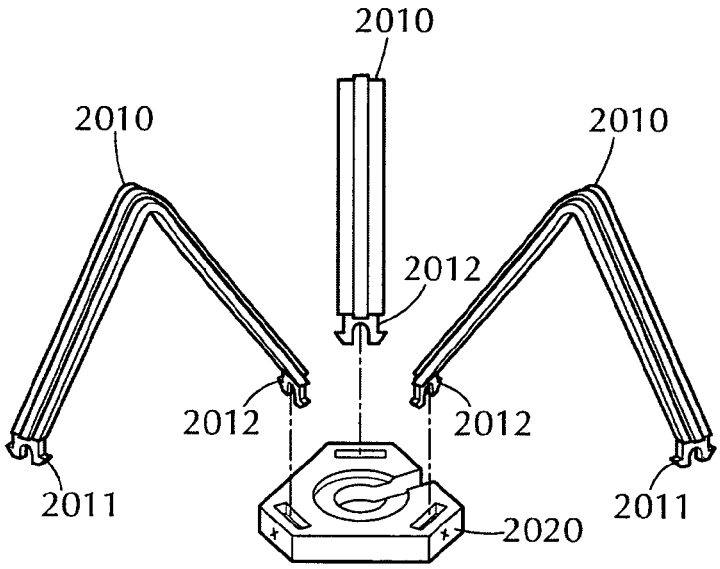
Figure 34D:
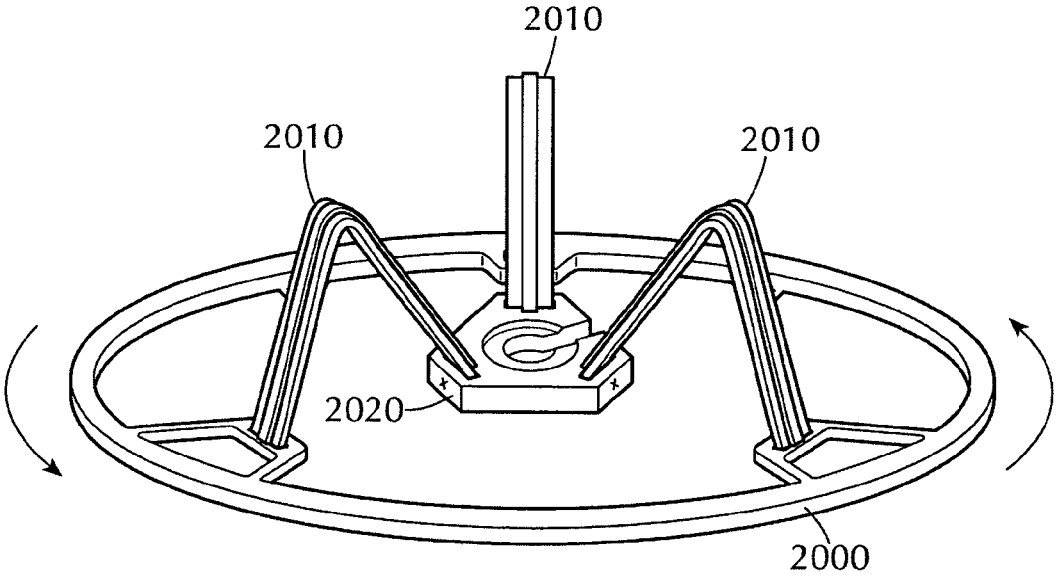
Figures 34C, 34E:
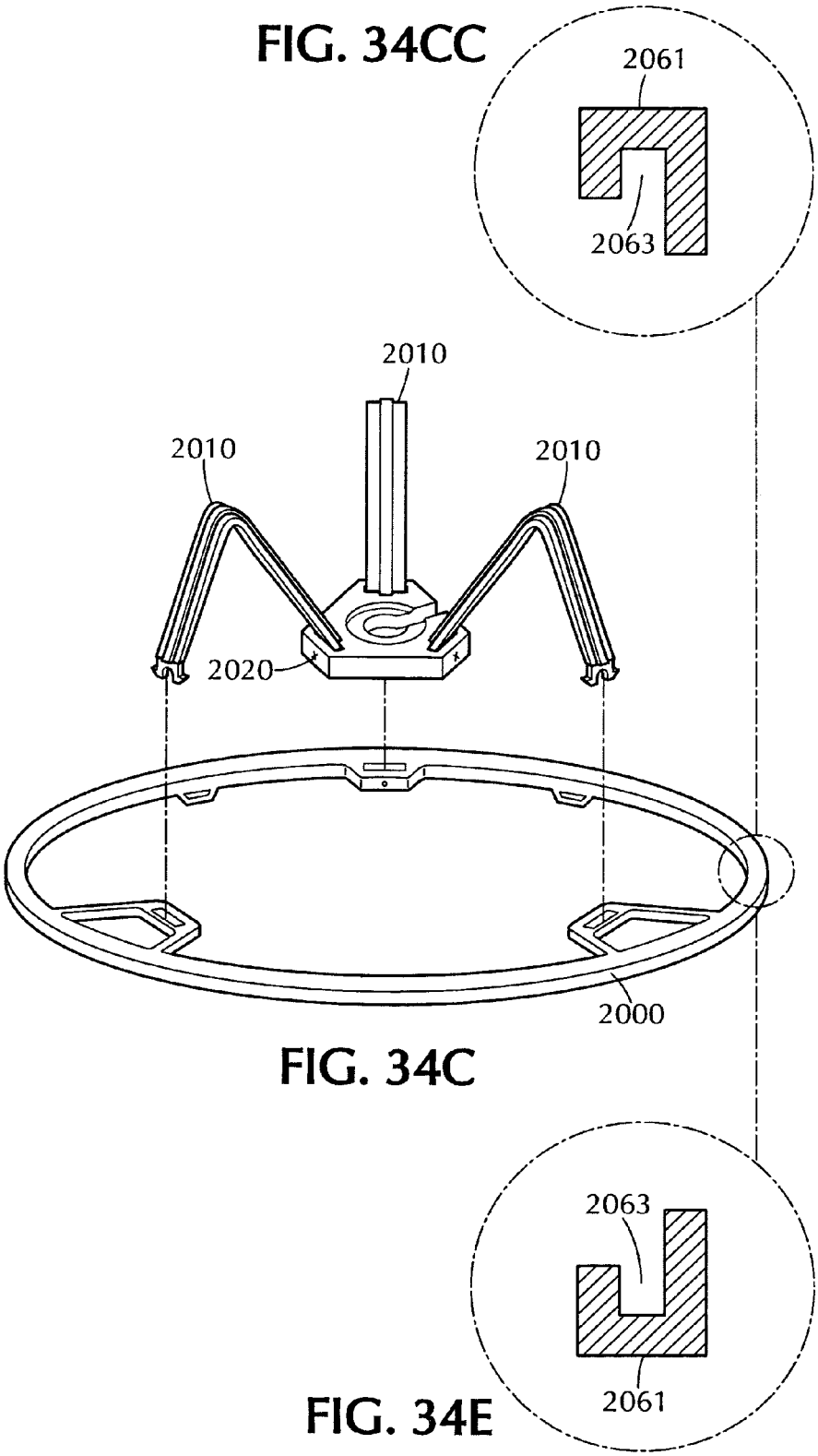

FIG. 30 shows one of the frame inserts 2030 that are inserted through horizontal slots 2004 in both the support frame 2000 and the plain frame 2040 to retain the image sheet by impingement with central member end 2032. FIG. 31 shows an outer perspective view of the plain frame rim 2040 of this embodiment with slots 2004 for inserts 2030 but without projection attachments 2001, 2002, and 2003 for leg attachment that are shown in FIG. 28. As shown in FIG. 32, wing members 2031 compress on insertion then snap back, thereby locking into slots 2004 to hold the insert in position pressing the image sheet 2052 against the outer rim slot surface of the outer circumferential rim slot 2063 of outer circumferential frame portion 2061 of frame 2000. Inserts 2030 may be made of an elastomeric resin with high durometer. Materials such as polyurethane and silicone exhibit the desirable features discussed. Note the serrated end 2032 which (enhances grip on the surface of image sheet 2052. Perspective view detail FIG. 32 also shows the resilient frame insert 2030 inserted in a horizontal slot 2004 edge of rim 2000. A crossectional detail view of the outer circumferential frame portion 2061 with rim slot 2063 in a region away from a slot 2004 is shown at FIGS. 34CC and 34E. The image sheet 2052 edge is pressed between end 2032 of a resilient insert 2030 and the long outer wall of recess slot 2063 as shown in FIGS. 32, 34CC and 34E. The location of the region in which the image sheet 2052 is located in FIGS. 30A and 32 is indicated by arrows identified as reference numeral 2052', but because these views in FIGS. 30A and 32 are not cross sections, the actual image sheet 2052 is not illustrated.

Figure 30A:
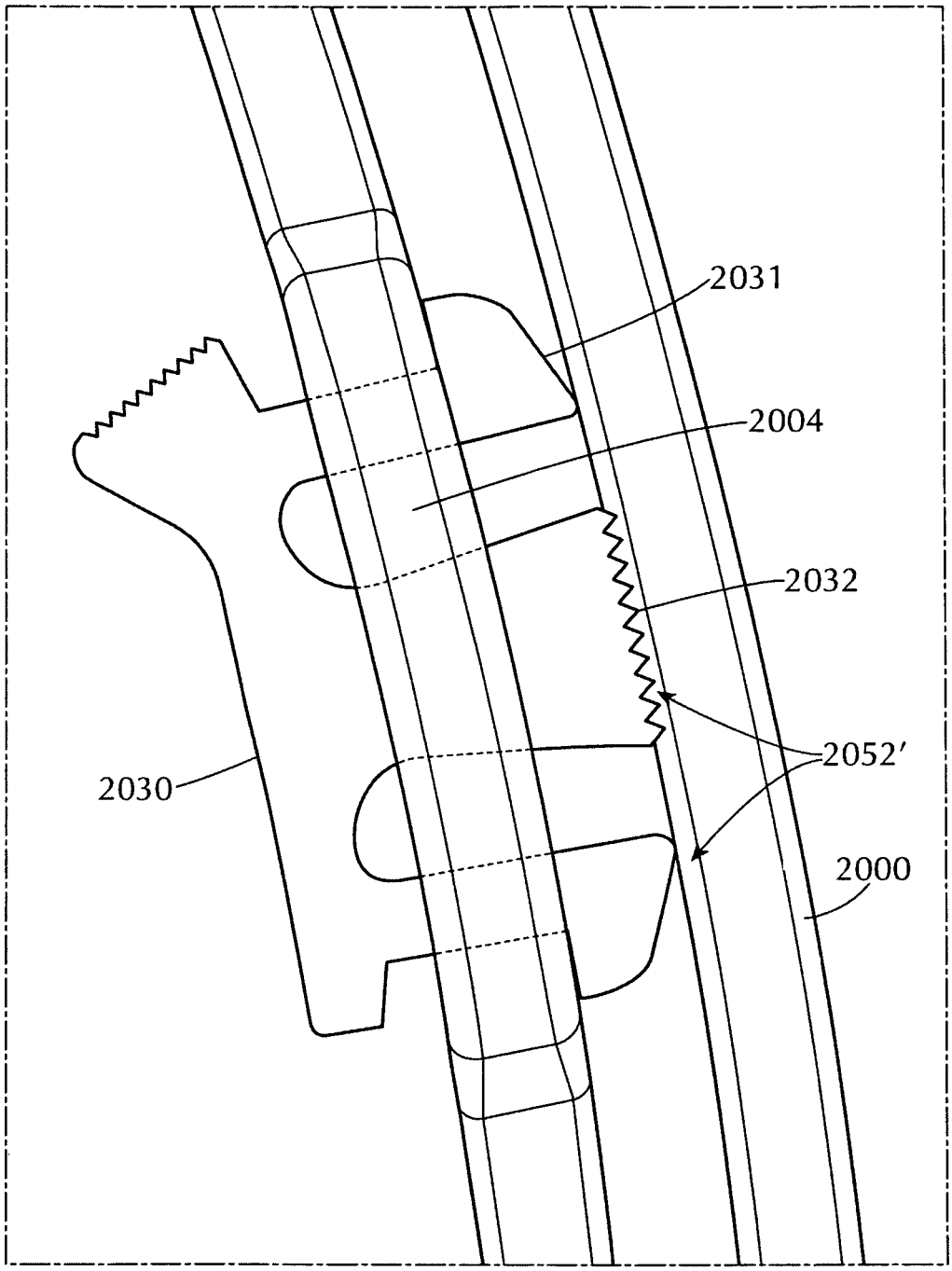
FIG. 30A is a perspective view of an alternate design of a frame rim insert of this embodiment.

FIG. 30A shows an alternate design for the frame insert 2030 inserted into a horizontal frame slot 2004.

The assembly details for the image sheet for either a table top or a pendant type IDU, taking an image sheet 2052 from package box A 2050 through forming it into a cylinder for frame attachment using adhesive strip 2053 to attach the free edges, is shown is the sequence of drawings of FIGS. 33A-33E. The comments in the brief descriptions of the drawings are sufficient to follow the steps.

The assembly details of the support frame for a table top IDU from package box B 2060 through completion are shown in the steps of FIGS. 34A-34D. Note that detail 34CC shows the crossection 2062 of rim 2000 with the rim slot 2063 facing down. The same assembly steps but with an inverted rim 2000 as shown in detail of FIG. 34E would be used for assembly of a support frame for a pendant IDU.

Figure 35A:
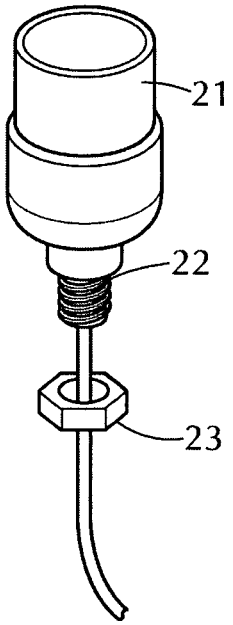
Figure 35B:
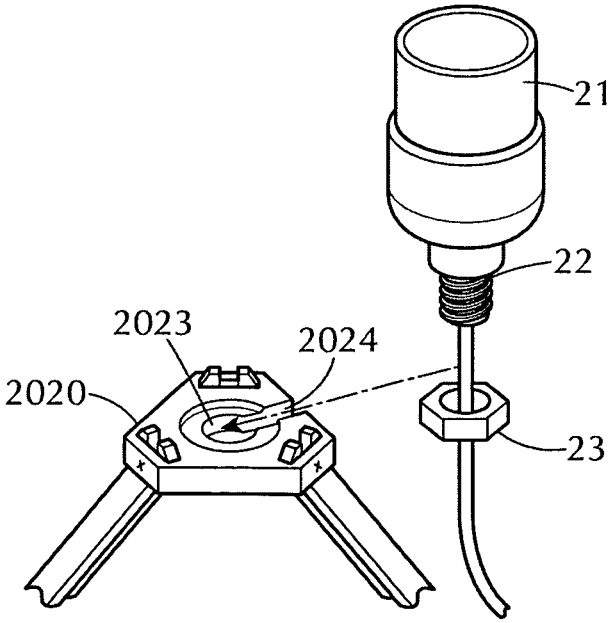
Figure 35C:
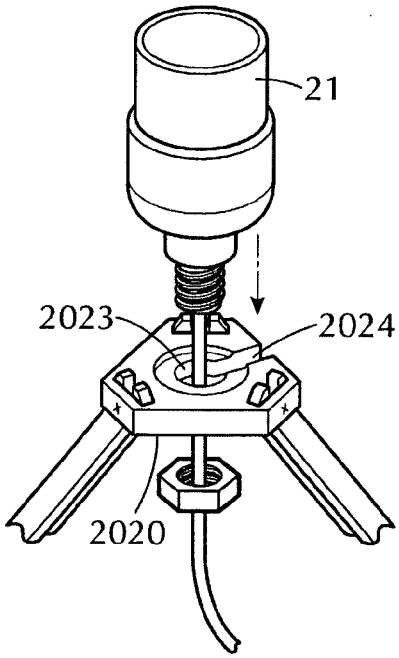
Figure 35D:
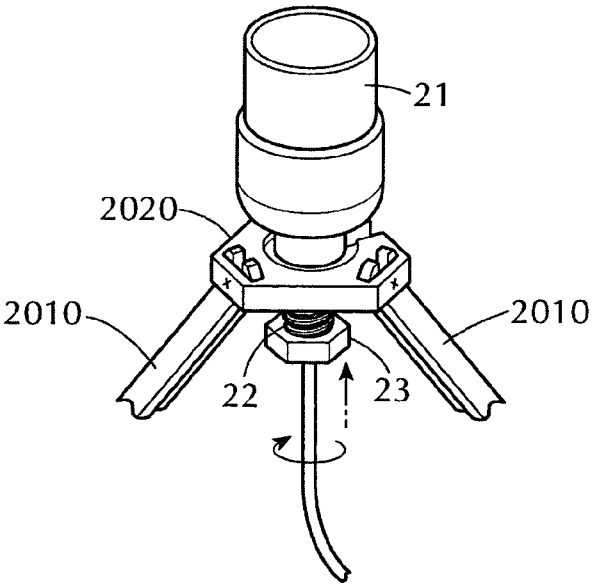
Figure 35E:
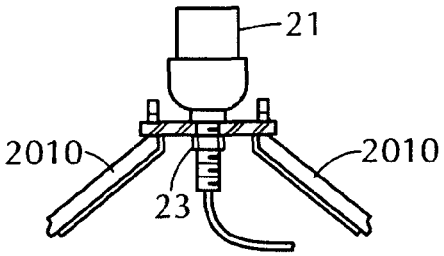
Figure 35F:
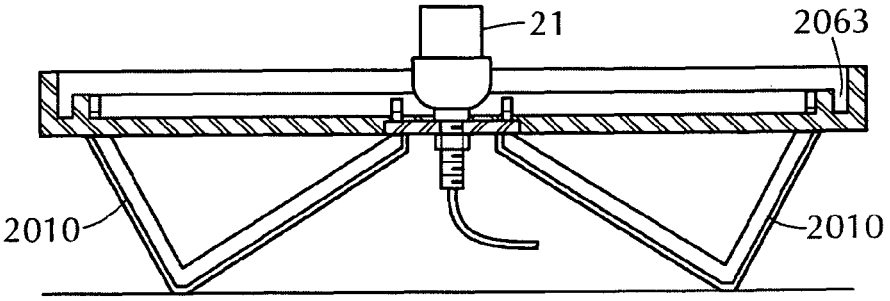
Figure 35G:
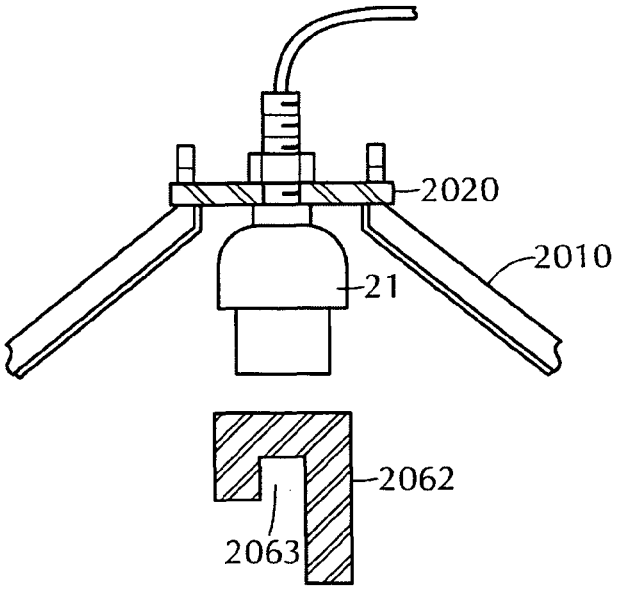
FIG. 35G shows side elevation details of socket and rim slot as used in a pendant IDU with orientation opposite to that of FIG. 35F.

The attachment of the bulb socket, which is part of the electrical subassembly, to the hub of the support frame for a table top IDU is illustrated in FIGS. 35A (showing bulb socket 21, with threaded nipple attached 22 and nut 23 threaded onto the electric cable) through the completed attachment of FIG. 35F. FIG. 35B shows the slot in the hub which enables the electric cord of a fully assembled cord set to be inserted in the hub 2020. The details are explained in the brief description of this figure sequence. The detail of FIG. 35G shows the different orientation of the bulb socket 21 as well as the rim slot 2063 for the assembly sequence for a pendant IDU.

Figure 36B:
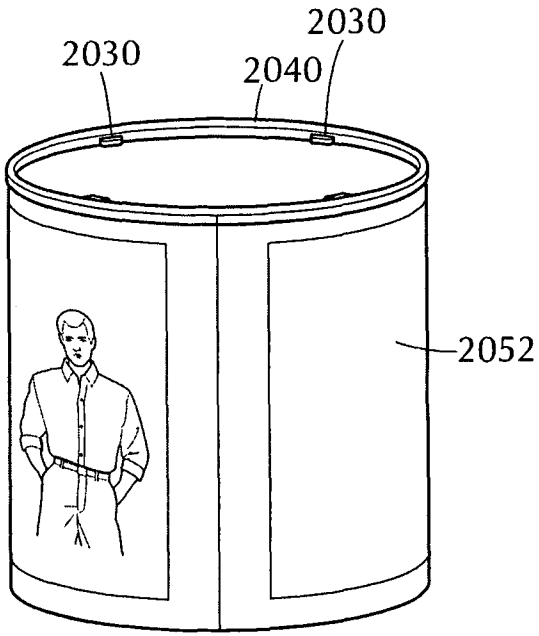
Figure 36A:
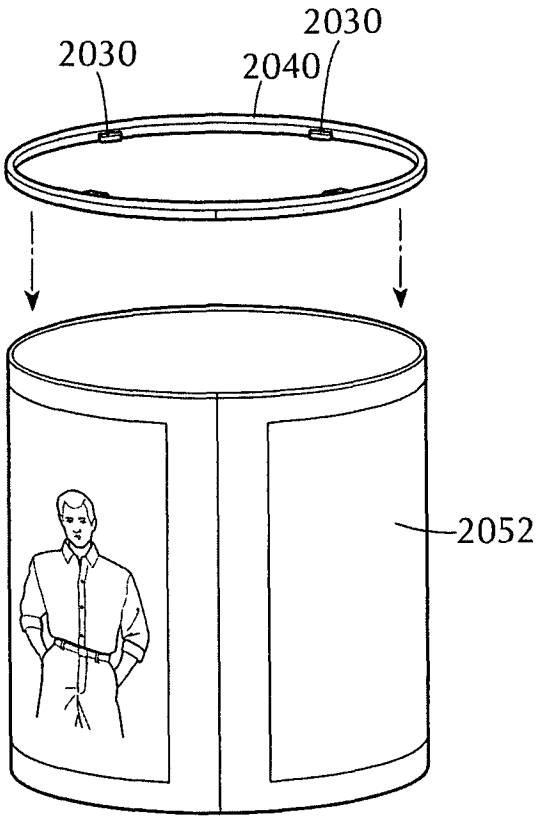
Figure 36C:
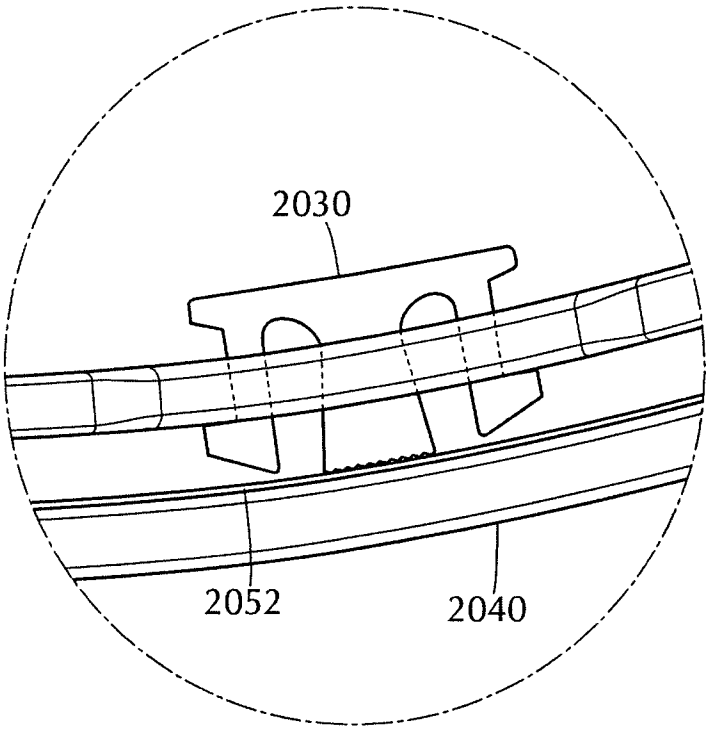
Figure 36C:
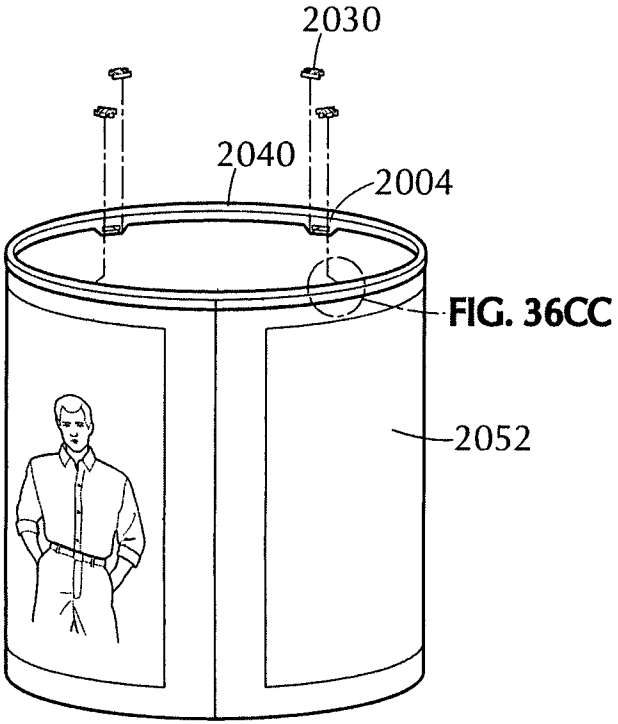
Figure 36E:
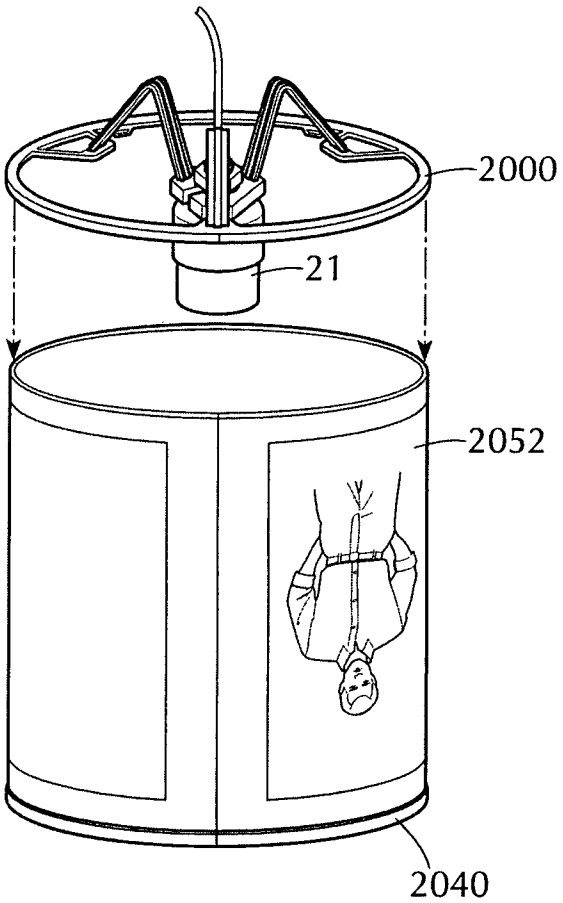
Figure 36D:
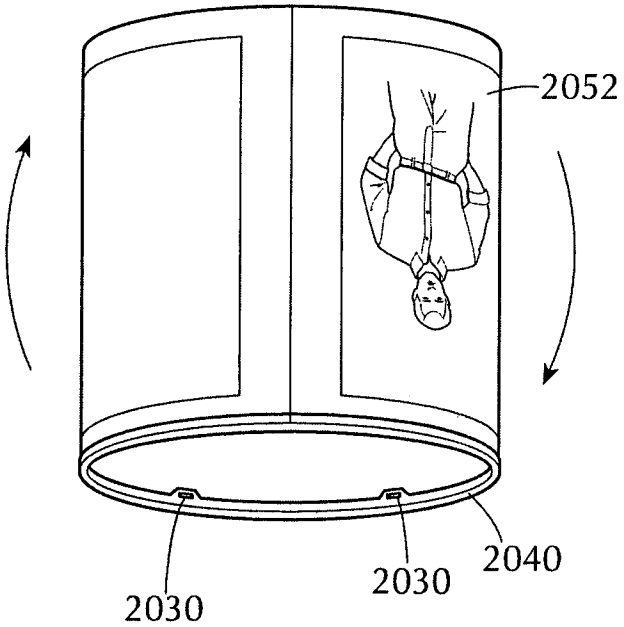
Figure 36G:
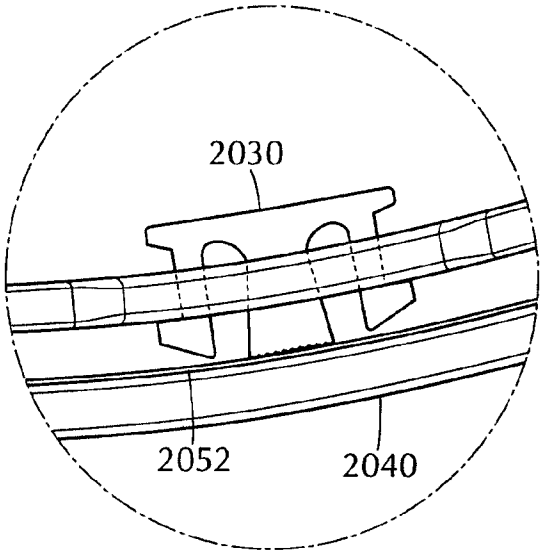
Figure 36G:
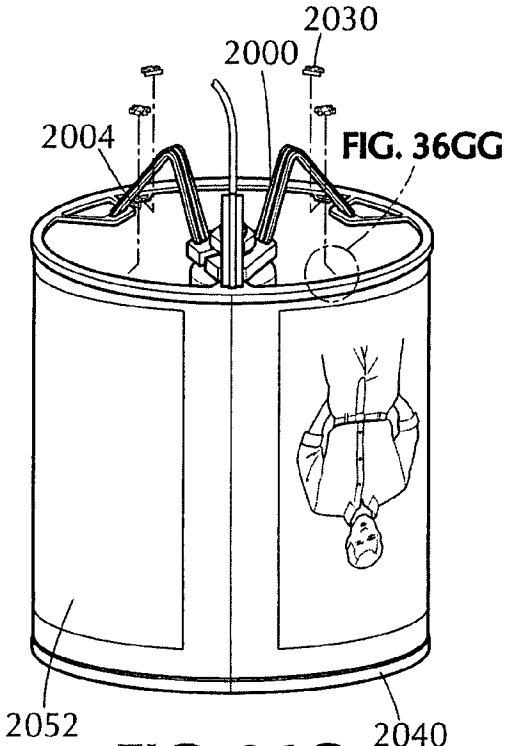
Figure 36F:
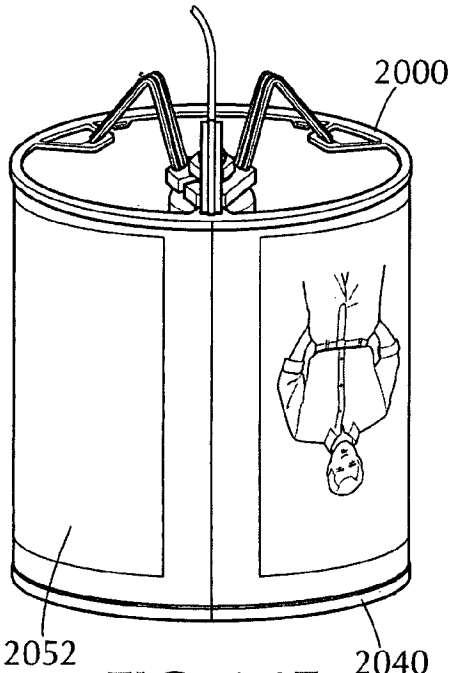
Figure 36I:
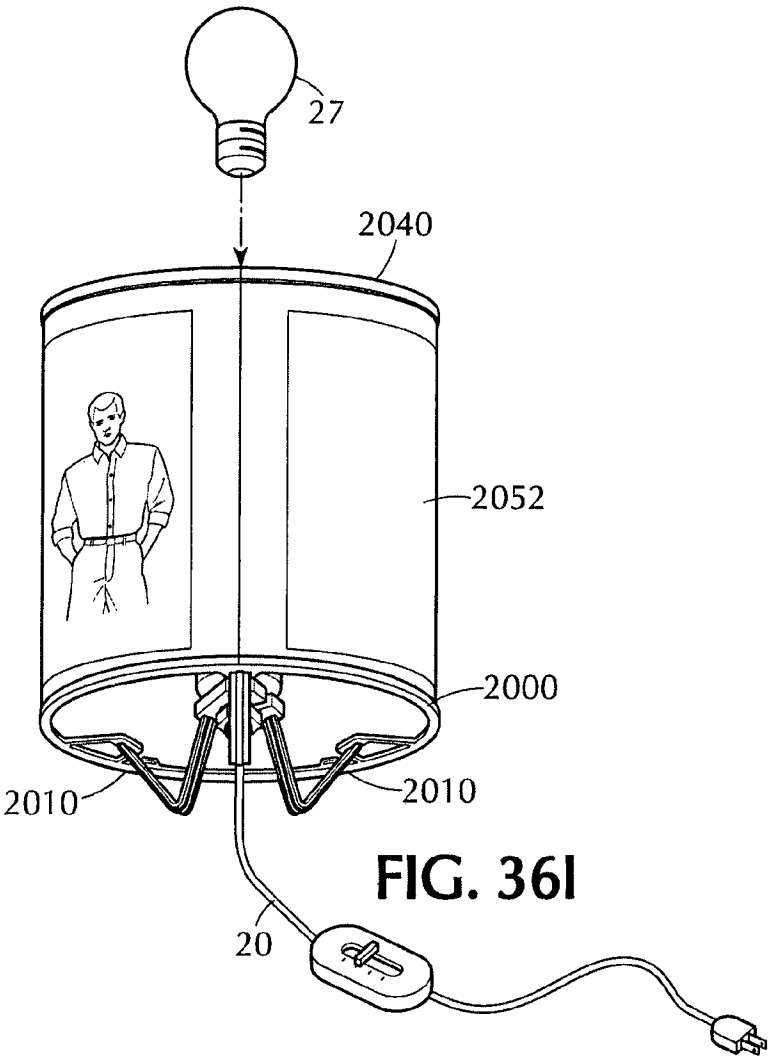
Figure 36H:
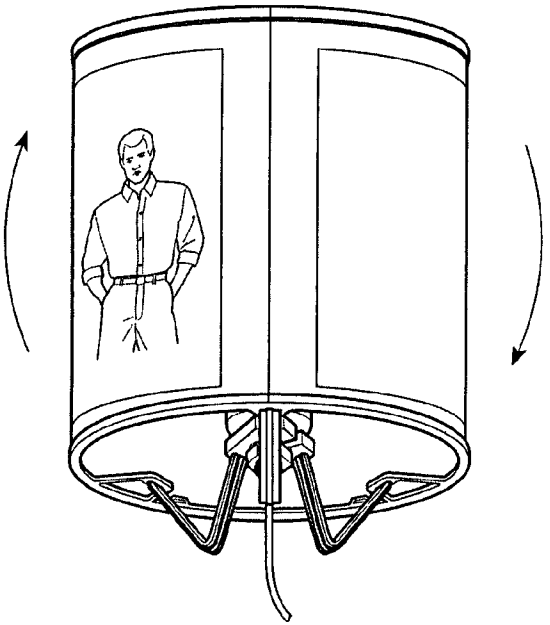
Figure 37B:
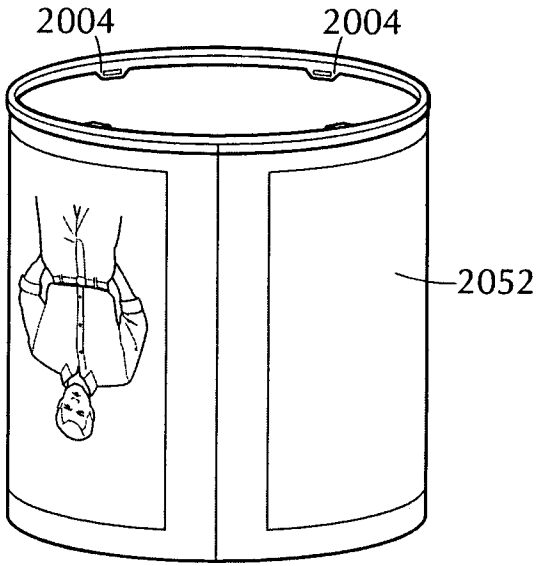
Figure 37A:
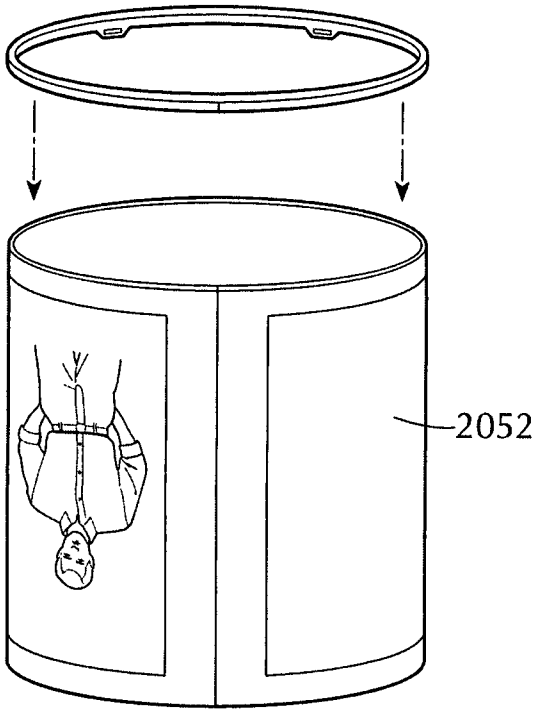
Figure 37C:
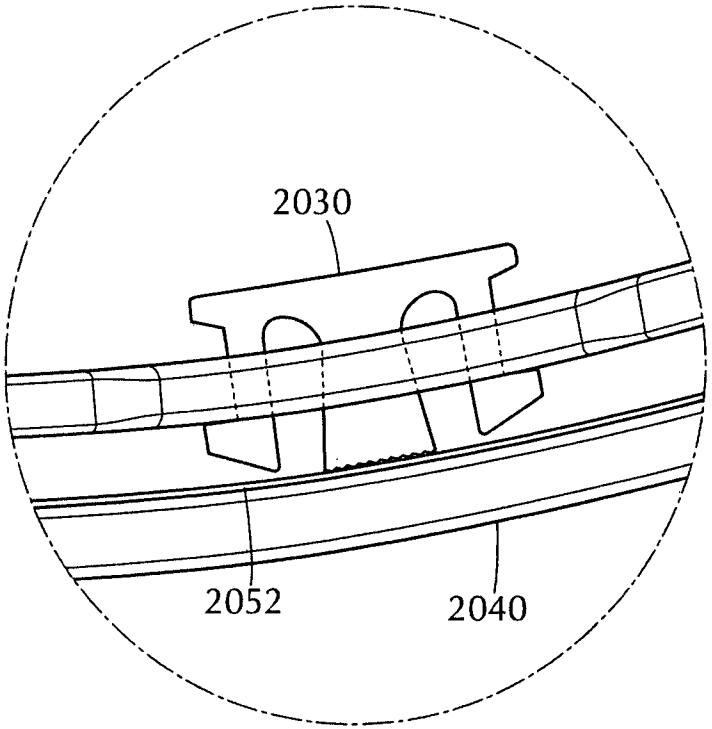
Figure 37C:
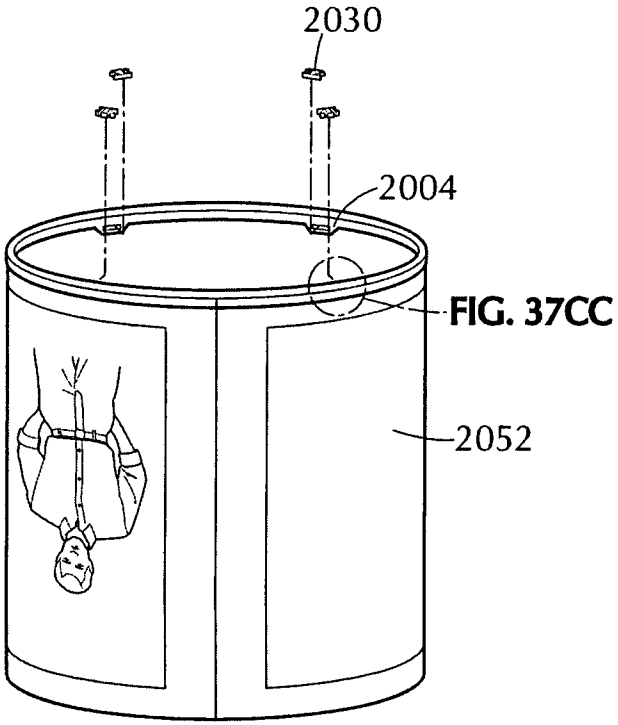
Figure 37E:
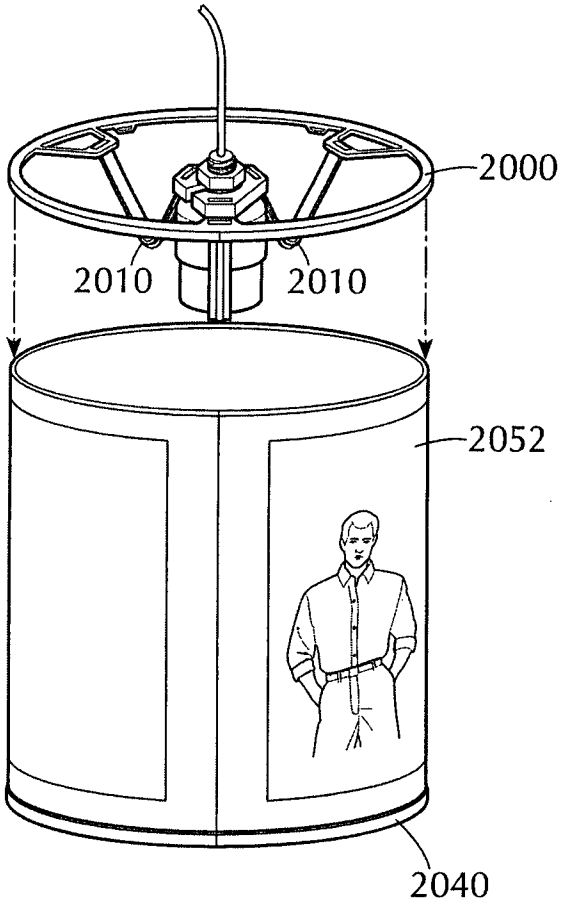
Figure 37D:
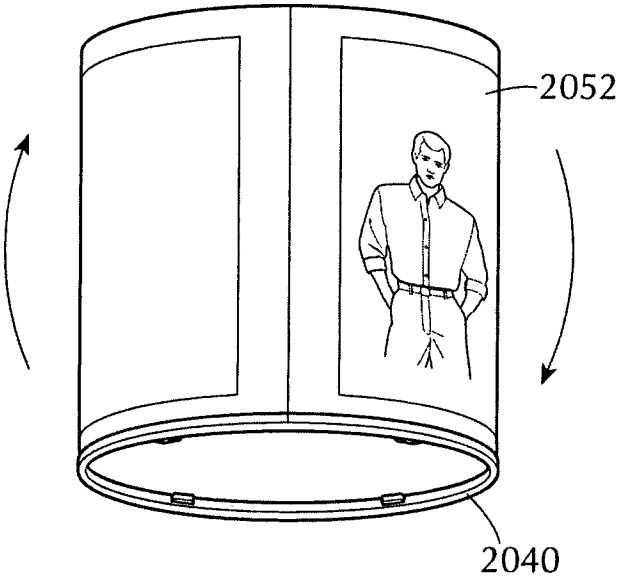
Figure 37G:
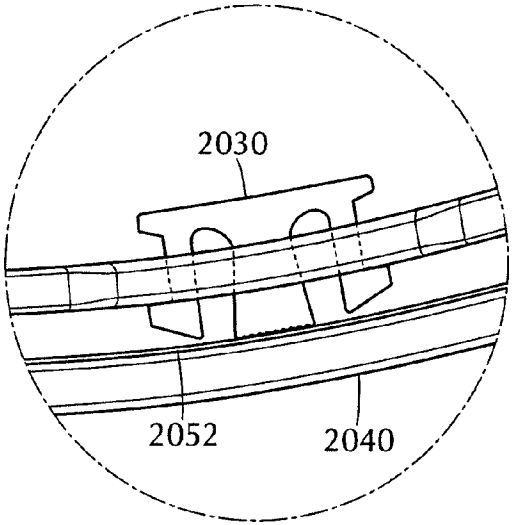
Figure 37G:
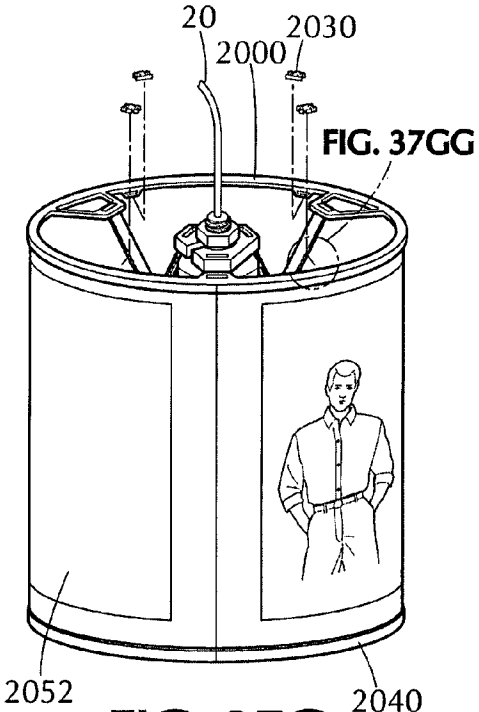
Figure 37F:
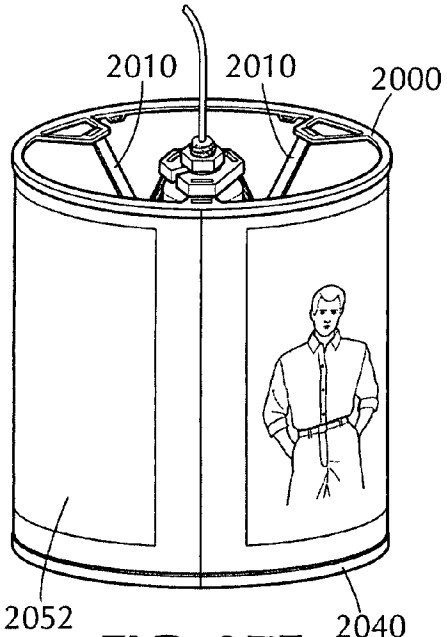
Figure 37H:
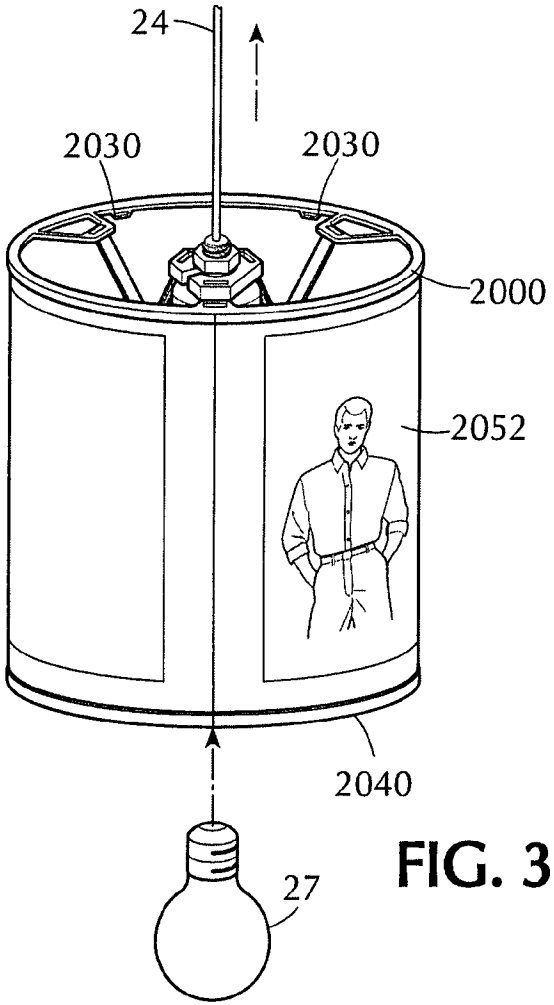

The attachment of the image sheet to the frame for a table top IDU is detailed in the sequence of FIGS. 36A-36I. In reviewing these figures, note that image sheet 2052 orientation as depicted by the human form. FIGS. 36D and 36H show the details for the next assembly sequence. Details of each illustration can be gleaned from the components in the brief descriptions of the drawings. This sequence ends in the completed table top IDU.

A similar sequence of FIGS. 37A-37H details of the same parts assembled for a pendant IDU.

Figure 38:
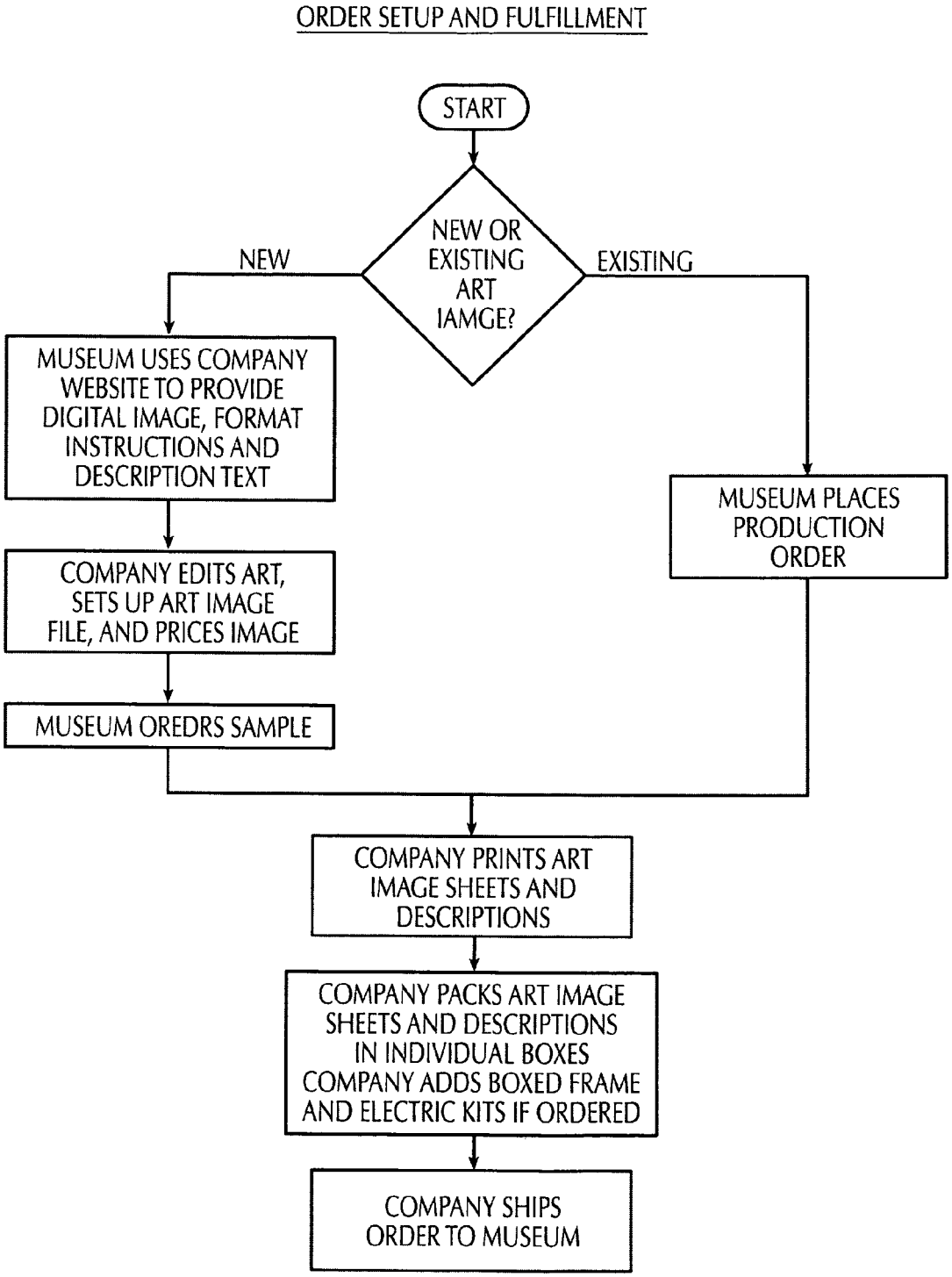
FIG. 38 is a flow chart of the order set-up for a new or previously ordered museum image for use with this further alternate embodiment.

In this further alternate embodiment, the order set-up flow chart of FIG. 9 for previous embodiments is modified at FIG. 38 to reflect changes incorporating an enhanced company web site. One change is that the museum (or the institution or business or individual customer) can format their art directly on the company website as this now has the required software to make this possible. These changes streamline the communications and save time.

Figure 39:
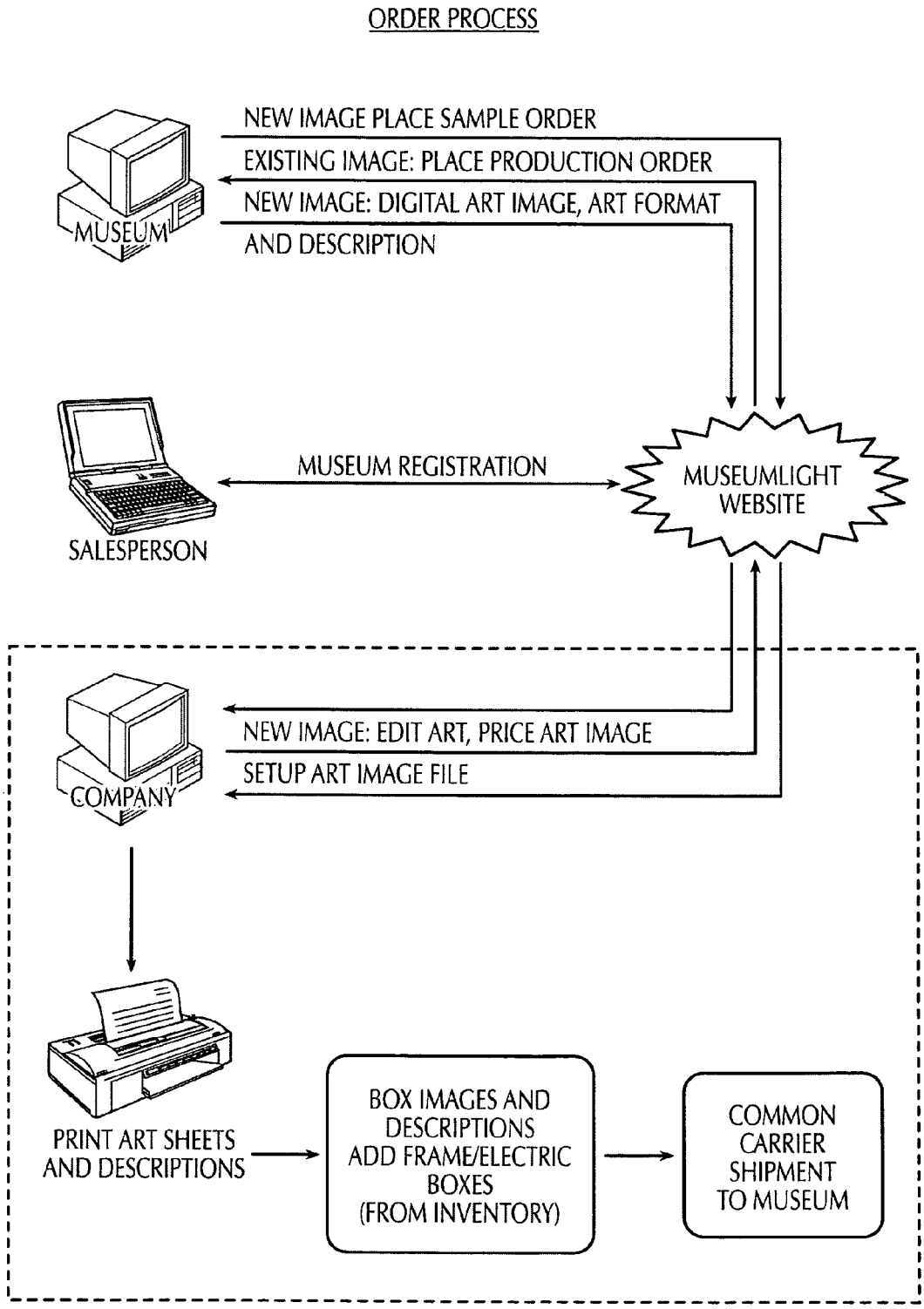
FIG. 39 is a block diagram reflecting the hardware and network entities in implementing the flow chart of FIG. 38.
Figure 40:
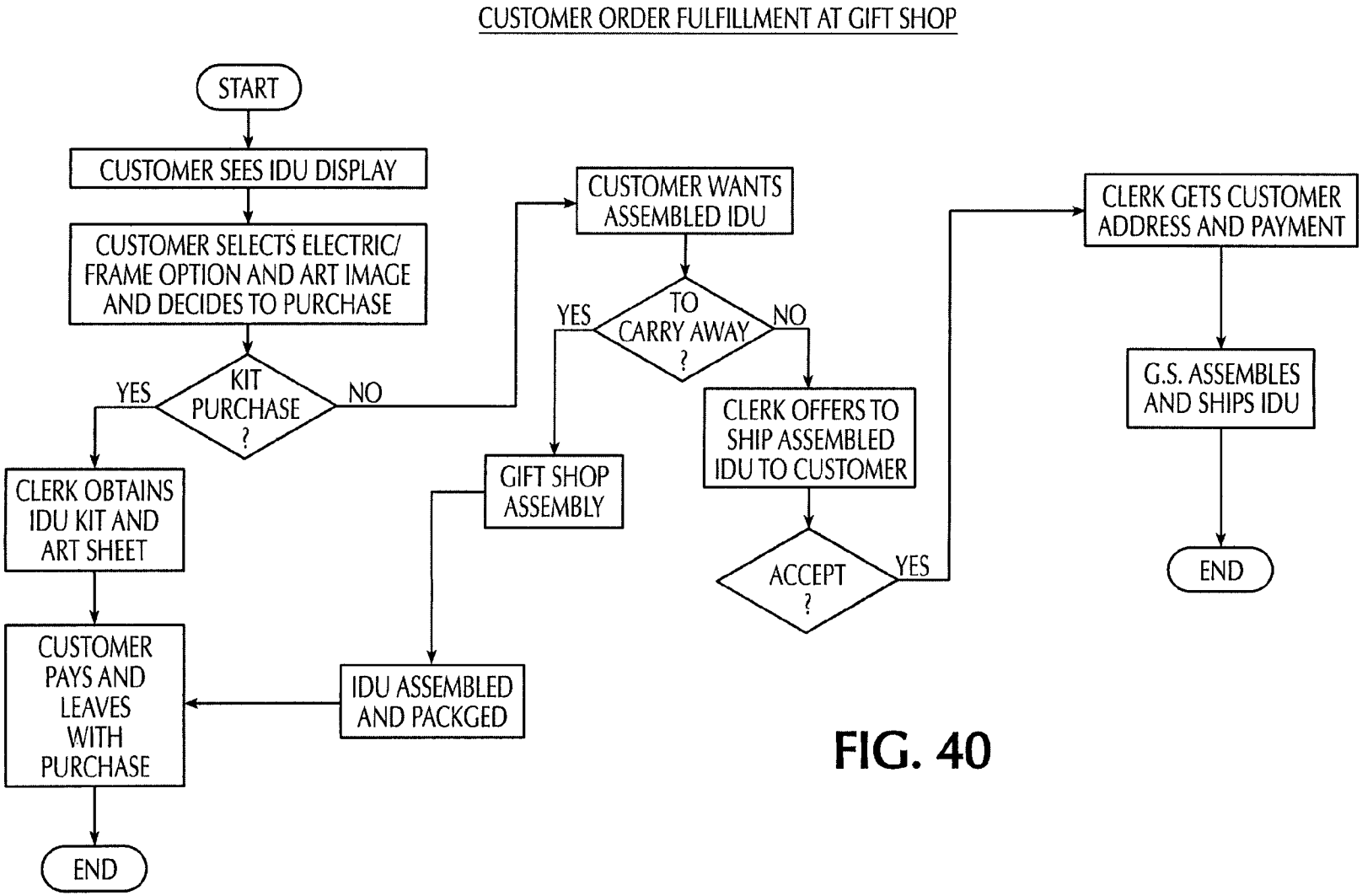
FIG. 40 is a flow chart depicting the customer fulfillment options at a museum gift shop for this further alternate embodiment.

While the block diagram of FIG. 39 is similar to that of FIG. 9A of earlier embodiments, FIG. 39 shows the actual communicating pairs through the Internet for IAU pricing and image file setup. The customer fulfillment flow chart of FIG. 10 for previous embodiment has been simplified at FIG. 40 for this further alternate embodiment to eliminate the drop ship request option to the company.

While the foregoing illustrations depict a light source including a lamp with an AC socket and electrical cord connected to an AC power source, it is known that other light sources could be utilized, such as light emitting diode lamps, or DC powered lamps with DC power sources, such as batteries or other low voltage power sources.

In the foregoing description, certain terms and visual depictions are used to illustrate the preferred embodiment. However, no unnecessary limitations are to be construed by the terms used or illustrations depicted, beyond what is shown in the prior image, since the terms and illustrations are exemplary only a, and are not meant to limit the scope of the present invention.

It is further known that other modifications may be made to the present invention, without departing the scope of the invention, as noted in the appended Claims.

We claim:

1. An illuminated display unit comprising:

a translucent image sheet having respective top and bottom peripheral edges and a pair of opposite side edges;

wherein the pair of opposite side edges are capable of being joined together to form a cylinder;

a first frame for retaining the top or bottom peripheral edge of the translucent image sheet;

a second frame for retaining the top or bottom peripheral edge of the translucent image sheet;

at least one fastener for securing the translucent image sheet to each of the first and second frames, wherein the top and bottom peripheral edges of the translucent image sheet are fastened into place using multiple resilient inserts which lock into the first and second frames and impinge on the top and bottom peripheral edges of the translucent image sheet without the use of adhesives or any other attachment device damaging the image sheet;

wherein the translucent image sheet is releasable from the first and second frames by releasing the at least one fastener from the first and second frames; and a light source attached to at least one of the first and second frames for illuminating the translucent image sheet from within the cylindrical shape of the image sheet.

2. The illuminated display unit of claim 1, wherein the first frame and the second frame each form a closed loop.

3. The illuminated display unit of claim 2, wherein the first frame and the second frame each contain an engagement surface for receiving the top or bottom edge of the translucent image sheet.

4. The illuminated display of claim 3, wherein the engagement surface is a slot.

5. The illuminated display of claim 3, wherein the engagement surface is a shoulder edge.

6. The illuminated display unit as in claim 1 wherein the light source comprises a pre-wired electrical cord set comprising at least one of the following: (a) a lamp socket with a nipple, a nut, an attached pulley line cord, and a ceiling canopy unit or track attachment device at the distal end, (b) a lamp socket with a nipple, a nut, an attached line cord, a lamp control and a wall plug at the distal end, (c) a lamp socket with a nipple, a tube internally threaded at both ends, a second nipple, a nut, an attached line cord, a lamp control and a wall plug at the distal end, and (d) a lamp socket with a nipple, a tube internally threaded at both ends, a second nipple, a lamp support base, a nut, an attached line cord, a lamp control and a wall plug at the distal end.

7. The illuminated display unit of in claim 1 wherein the first frame or the second frame is engageable with a plurality of radially extending leg members;

wherein each leg member has a coupling for separately engaging the leg member to the first frame or the second frame, and wherein each leg member also has a coupling for supporting engaging the leg member to a lamp socket support hub.

8. The illuminated display frame of claim 7, wherein the first frame or the second frame serves as a support frame for the unit.

9. The illuminated display frame of claim 8, wherein the plurality of radially extending leg members are capable of being connected to the first frame or the second frame in an upward or downward position relative to the plane of the first frame or the second frame.

10. The illuminated display of claim 7 wherein the lamp socket support hub has a hole and a radial slot, and wherein the hole has a diameter large enough to accept a nipple attached to a lamp socket, and the radial slot has a width smaller than the hole diameter but large enough to allow access to the hole for the electric wire of a cord set, thereby permitting insertion of the wire of an electric cord set into the socket support hub without disassembling the cord set, and wherein the hole permits the lamp socket to be securely attached to the socket support hub either way up relative to the plane of the lamp socket support hub.

11. The illuminated display unit of claim 8 wherein the plurality of radially extending leg members are aligned in the vertical plane of the support frame thereby also forming supports for table-top use of the display unit.

12. The illuminated display unit of claim 11 further comprising a frame to support the illuminated display unit on a pedestal tube for table-top use.

13. The illuminated display unit of claim 2 wherein the shape of the circumference of the closed loops of the first frame and the second frame is composed of curved sections.

14. The illuminated display unit of claim 2 wherein the shape of the circumference of the closed loops of the first and second frames is composed of straight sections.

15. The illuminated display unit of claim 1 in which the shape of the circumference of the loops of the first frame and the second frame is composed of both curved and straight sections.

16. The illuminated display unit of claim 1 wherein the translucent image sheet is paper.

17. The illuminated display unit of claim 1 wherein the translucent image sheet is plastic.

18. The illuminated display unit of claim 1 wherein translucent image sheet is fabric.

19. The illuminated display unit of claim 1 wherein the translucent image sheet is laminated.

20. The illuminated display unit of claim 3 wherein the at least one fastener for securing the translucent image sheet is removable and is captured within a cutout in a side surface of the first or second frames.

21. The illuminated display unit of claim wherein said resilient inserts comprise:

a base;

a projection; and a plurality of wing members extending up from the base; wherein the wing members interlock with the frames: and wherein the projection compresses against the image sheet after insertion and holds the translucent image sheet in place within the respective frame.

22. The illuminated display unit of claim 11 wherein the plurality of radially extending leg members are V-shaped in the vertical plane of the support frame.

23. The illuminated display unit of claim 1 wherein the illuminated display unit is provided in a fully assembled condition or a ready to assemble condition with instructions to assemble.

24. An illuminated display unit comprising:

a translucent image sheet having respective top and bottom peripheral edges and a pair of opposite side edges;

wherein the pair of opposite side edges are capable of being joined together to form the translucent image sheet into a cylindrical lampshade;

a first frame for retaining the top or bottom of the cylindrical lampshade using resilient inserts that lock into the first frame and impinges on the cylindrical lampshade;

a second frame for retaining the top or bottom of the cylindrical lampshade using resilient inserts that lock into the second frame and impinges on the cylindrical lampshade;

the cylindrical lampshade being held securely without the use of adhesives or any other attachment device damaging the image sheet;

wherein the cylindrical lampshade is releasable from the first and second frames by releasing the resilient inserts from the first and second frames; and a light source attached to at least one of the first and second frames for illuminating the translucent image sheet from within the cylindrical lamp shade.

* * * * *

UNITED STATES PATENT AND TRADEMARK OFFICE

CERTIFICATE OF CORRECTION

PATENT NO. : 8,931,192 B2
APPLICATION NO. : 13/345416
DATED : January 13, 2015
INVENTOR(S) : Brian Acworth It is certified that error appears in the above-identified patent and that said Letters Patent is hereby corrected as shown below:

Title Page, please insert,

--(30)

Foreign Application Priority Data 1019865.3 (GB) 24 November 2010
10194003.9 (EP) 07 December 2010--

Signed and Sealed this
First Day of March, 2016

Michelle K. Lee

Michelle K. Lee
*Director of the United States Patent and Trademark Office*